US005362617A

United States Patent [19]

Morigaki et al.

[11] Patent Number: 5,362,617

[45] Date of Patent: Nov. 8, 1994

[54] SILVER HALIDE PHOTOGRAPHIC LIGHT-SENSITIVE MATERIAL

[75] Inventors: Masakazu Morigaki; Kohzaburoh Yamada; Nobuo Seto; Yasuhiro Yoshioka, all of Kanagawa, Japan

[73] Assignee: Fuji Photo Film Co., Ltd., Kanagawa, Japan

[21] Appl. No.: 59,981

[22] Filed: May 12, 1993

[30] Foreign Application Priority Data

May 15, 1992 [JP] Japan ..... 4-148009
Jan. 20, 1993 [JP] Japan ..... 5-023464

[51] Int. Cl.[5] ..... G03C 1/08; G03C 7/26; G03C 7/32

[52] U.S. Cl. ..... 430/556; 430/557; 430/388; 430/389; 430/551

[58] Field of Search ..... 430/556, 557, 388, 389, 430/551

[56] References Cited

U.S. PATENT DOCUMENTS

| | | | |
|---|---|---|---|
| 4,026,709 | 5/1977 | Piller et al. | 96/100 |
| 4,268,591 | 5/1981 | Tschopp | 430/556 |
| 4,511,649 | 4/1985 | Ogawa et al. | 430/553 |
| 4,758,501 | 7/1988 | Buckland et al. | 430/389 |
| 4,824,771 | 4/1989 | Buckland et al. | 430/388 |
| 5,118,599 | 6/1992 | Lau et al. | 430/556 |
| 5,194,369 | 3/1993 | Mihayashi et al. | 430/544 |
| 5,212,052 | 5/1993 | Sakanoue et al. | 430/557 |
| 5,238,803 | 8/1993 | Ichijima et al. | 430/557 |

FOREIGN PATENT DOCUMENTS

| | | |
|---|---|---|
| 0447969 | 3/1991 | European Pat. Off. . |
| 0482552 | 10/1991 | European Pat. Off. . |
| 1-180547 | 7/1989 | Japan . |
| 1-191141 | 8/1989 | Japan . |

*Primary Examiner*—Charles L. Bowers, Jr.
*Assistant Examiner*—Geraldine Letscher
*Attorney, Agent, or Firm*—Sughrue, Mion, Zinn, Macpeak & Seas

[57] ABSTRACT

A light-sensitive material comprising a support provided thereon at least one layer containing a coupler represented by the following Formula (I):

Formula (I)

wherein A represents a group represented by the following Formula (a), (b) or (c):

Formula (a)

Formula (b)

Formula (c)

wherein the groups are as defined in the specification provided that at least one of the groups represented by A, B and Z has at least one of the partial structures represented by the following Formulas (P-I) to (P-V):

Formula (P-I)

Formula (P-II)

(Abstract continued on next page.)

-continued
Formula (P-III)
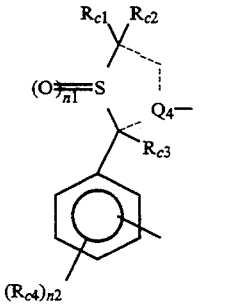
-continued
Formula (P-IV)
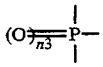
Formula (P-V)
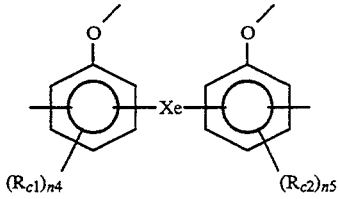
wherein the substituent groups are as defined in the specification.
20 Claims, No Drawings

SILVER HALIDE PHOTOGRAPHIC LIGHT-SENSITIVE MATERIAL

FIELD OF THE INVENTION

The present invention relates to a silver halide photographic light-sensitive material (hereinafter referred to simply as a light-sensitive material). More specifically, the present invention relates to a light-sensitive material containing a novel yellow coupler capable of providing a fast dye image by development processing.

BACKGROUND OF THE INVENTION

In general, a light-sensitive material has silver halide emulsion layers which are sensitive to the three original colors of red, green and blue. A color image is reproduced by the subtractive method in which the three color formers (couplers) contained in the respective emulsion layers are subjected to development into a color having a complementary color to the color to which each of the layers is sensitive. This color image obtained by photographically processing the light-sensitive material generally consists of an azomethine dye or indoaniline dye formed by the reaction of the oxidation product of an aromatic primary amine developing agent with a coupler.

However, such a light-sensitive material is still insufficient to meet the demand for a high quality material. Significantly, a developed dye obtained from a yellow dye-forming coupler still has several problems which have to be overcome. Firstly, the absorption coefficient of the developed dye is small compared with those of dyes obtained from a magenta dye-forming coupler and a cyan dye-forming coupler, and this necessitates the use of more yellow coupler in order to obtain the same density as magenta and cyan coupler-based materials. Secondly, the hue thereof is not necessarily sufficient for accurately reproducing an original color. Thirdly, the developed dye and unreacted coupler are not stable in light, humidity and heat, and exposure to sunlight over a long period of time and storage at high temperature and humidity cause the dye image to fade and discolor and cause the background to color. These problems cause deterioration of the image quality.

In order to solve these problems, it has been proposed to improve the couplers and include additives, for example, a specific phenol series compound and a sulfonamide series compound. However, these proposals do not sufficiently solve the problems.

Meanwhile, it is known to use an anti-fading agent and a UV absorber for the couplers. Known anti-fading agents include, for example, hindered piperidines, hindered phenols, amides, hydrazines, bisphenols, a phosphrous compound, and a thiane compound.

However, while these compounds improve the fastness of an image, the improvement is insufficient. In addition, they are scarcely effective in improving the color developing characteristics or in increasing the absorption coefficient of the dye.

The improvement in performance by using additives (for example, the above anti-fading agent and UV absorber) is limited. This has resulted in increasing attempts to improve performance by modifying the structural design of the coupler itself.

Proposals to improve the fastness of an image by using couplers having specific groups are disclosed in JP-A-1-180547 (the term "JP-A" as used herein means an unexamined Japanese patent application), JP-A-1-191141, U.S. Pat. Nos. 4,824,771 and 4,758,501. However, while the fastness of the image has been improved, it is unsatisfactory, since hue is changed, fog is generated and dispersion is inferior.

Further, yellow couplers having phosphoric acid or phosphonic ester and amide groups are proposed in U.S. Pat. No. 4,026,709. However, while they have excellent solubility, they provide an image having insufficient fastness, and hue or color developability have not yet reached a satisfactory level. The couplers described in U.S. Pat. Nos. 5,194,369 and 5,118,599, European Patent Publications 447969 and 482552, and JP-A-4-184434 have insufficient light fastness and also have a problem in that color developability is lowered due to the change in development processing composition.

SUMMARY OF THE INVENTION

Accordingly, a first object of the present invention is to provide a light-sensitive material capable of providing a color image which is not faded and discolored during storing over a long period of time.

A second object of the present invention is to provide a light-sensitive material which is improved in hue and color developability.

A third object of the present invention is to provide a light-sensitive material generating less fog and having excellent photographic performance and less generation of stain at the unexposed portion.

Intensive investigations made by the present inventors have resulted in finding that the above and other objects can be achieved by a silver halide color photographic light-sensitive material comprising on a support at least one layer containing a coupler represented by the following Formula (I):

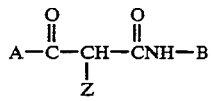

Formula (I)

wherein A represents a group represented by the following Formula (a), (b) or (c):

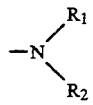

Formula (a)

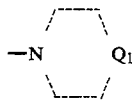

Formula (b)

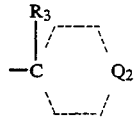

Formula (c)

wherein $R_1$ and $R_2$ may be the same or different and each represents an aliphatic group, an aromatic group or a heterocyclic group; $Q_1$ represents an organic group necessary to form a nitrogen-containing heterocyclic ring; $R_3$ represents a monovalent organic group; $Q_2$ represents an organic group necessary to form a 3- to 6-membered ring; provided that $R_3$ is not a hydrogen atom and is not combined with $Q_2$ to form a ring; B represents an aromatic group or a heterocyclic group; Z represents a hydrogen atom or a group capable of splitting off upon a coupling reaction with the oxidation product of an aromatic primary amine developing agent; provided that at least one of the groups represented by A, B and Z has at least one of the partial structures represented by the following Formulas (P-I) to (P-V):

Formula (P-I)

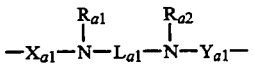

Formula (P-II)

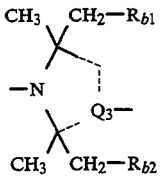

Formula (P-III)

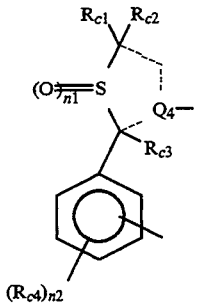

Formula (P-IV)

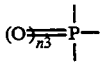

Formula (P-V)

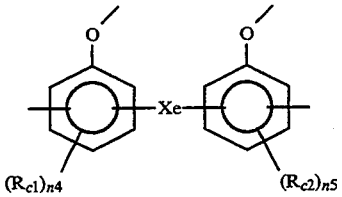

wherein $L_{a1}$ represents a bond or an organic group having an atom number of 1 to 8 contributing to a bonding distance between —N($R_{a1}$)— and —N($R_{a2}$)—; $X_{a1}$ and $Y_{a1}$ may be the same or different and each represents —CO—, —SO— or —$SO_2$—; provided that, when $L_{a1}$ is a bond or an oxalyl group, $X_{a1}$ and $Y_{a1}$ may represent a bond at the same time; $R_{a1}$ and $R_{a2}$ may be the same or different and each represents a hydrogen atom, an aliphatic group, an aromatic group, a heterocyclic group, an acyl group, a sulfonyl group, a sulfinyl group, a sulfamoyl group, a carbamoyl group, an aliphatic oxycarbonyl group, or an aromatic oxycarbonyl group; provided that when the Z group in Formula (I) contains a partial structure represented by Formula (P-1), the partial structure does not form a ring in a heterocyclic ring by splitting off a nitrogen atom; provided that when the group contains the partial structure represented by Formula (P-1), the partial structure does not form a primary chain for a polymer or oligomer; $R_{b1}$ and $R_{b2}$ may be the same or different and each represents a hydrogen atom or an aliphatic group; $Q_3$ represents an organic group necessary to form a 5- to 6-membered nitrogen-containing heterocyclic ring; $R_{c1}$ represents an aliphatic group, an aromatic group or a heterocyclic group; $R_{c2}$ and $R_{c3}$ may be the same or different and each represents a hydrogen atom or a group defined for $R_{c1}$; $Q_4$ represents an organic group necessary to form a thiane ring; $n_1$ represents 0, 1 or 2; $R_{c4}$ represents a substituent; $n_2$ represents an integer of 0 to 4; when $n_2$ is 2 or more, the plurality of $R_{c4}$ groups may be the same or different; $n_3$ represents 0 or 1; $R_{e1}$ and $R_{e2}$ may be the same or different and each represents a substituent; $n_4$ and $n_5$ may be the same or different and each represents an integer of 0 to 3; $X_e$ represents a single bond, —O—, —S—, —C($R_{e3}$)($R_{e4}$)—, or

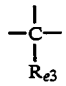

where $R_{e3}$ and $R_{e4}$ may be the same or different and each represents a hydrogen atom, an aliphatic group, or an aromatic group; and $R_{a1}$ and $R_{a2}$, $R_{a1}$ and $L_{a1}$, $R_{a2}$ and $L_{a1}$, and plural $R_{e1}$ groups or plural $R_{e2}$ groups may combine with each other to form a 5- to 7-membered ring.

DETAILED DESCRIPTION OF THE INVENTION

The present invention will be explained below in further details.

When the respective groups described in the present specification contain an aliphatic portion, the aliphatic portion may be linear, branched or cyclic, saturated or unsaturated, and unsubstituted or substituted, and has a carbon number of from 1 to about 50. Examples, alkyl, alkenyl, alkynyl, cycloalkyl, and cycloalkenyl.

When the respective groups described in the present specification contain an aromatic portion, the aromatic portion represents an aromatic hydrocarbon portion (aryl) and may be a monocyclic ring or condensed ring. It may be unsubstituted or substituted and has a carbon number of from 6 to about 50.

When the respective groups described in the present specification contain a heterocylic ring portion, the heterocylic ring portion has, for example, a nitrogen atom, an oxygen atom, a sulfur atom, and a phosphorous atom as a hetero atom. It may be a saturated ring or unsaturated ring, a monocyclic ring or condensed ring, and unsubstituted or substituted, and has a carbon number of from 1 to about 50.

The free valencies shown in the partial structures represented by Formulas (P-I) to (P-V) correspond to the valencies of A, B and Z. Accordingly, assuming that the structures of Formulas (P-I) to (P-V) are bonded to a coupler, the coupler is bonded to at least one of the free valencies, and the organic groups are substituted at the remaining free valencies. If two or more free valencies are present in the partial structure, they may be combined with the monovalent organic groups, respectively or may be combined with a di- or trivalent organic group to form a 5- to 7-membered ring.

In the present invention, the monovalent organic group represents a hydrogen atom, a lone pair electron, or a substituent group, which will be defined below.

The di- or trivalent organic group is a group obtained by removing two or three hydrogen atoms from a compound containing an aliphatic group, an aromatic group, a heterocyclic ring and a functional group, and examples include methylene, ethylene, pentamethylene, propylene, 1,2,3-propanetriyl, p-phenylene, o-phenylene, naphthalene-1,4,5-triyl, biphenyl-4,4'-diyl, methylenedioxy, ethylenedioxy, carbonyldioxy, oxalyl, malonyl, maleoyl, phthaloyl, 2,3,5-hexanetricarbonyl, ureilene, thio, oxy, sulfonyl, 2-oxobutane-1,3-diyl, methylene-1,4-phenylene, piperadine-1,4-diyl, and 1,3,5-triazine-2,4,6-triyl.

The term "substituent" used herein includes, for example, an aliphatic group, a aromatic group, a heterocyclic group, an aliphatic acyl group, an aromatic acyl group, an aliphatic acyloxy group, an aromatic acyloxy group, an aliphatic acylamino group, an aromatic acylamino group, an aliphatic oxy group, an aromatic oxy group, a heterocyclic oxy group, an aliphatic oxycarbonyl group, an aromatic oxycarbonyl group, a heterocyclic oxycarbonyl group, a carbamoyl group, a sulfamoyl group, an aliphatic sulfonyl group, an aromatic sulfonyl group, an aliphatic sulfinyl group, an aromatic sulfinyl group, a sulfonamide group, an aliphatic amino group, an aromatic amino group, a heterocyclic amino group, an aliphatic thio group, an aromatic thio group, a heterocyclic thio group, a sulfamoylamino group, a cyano group, a nitro group, a sulfo group, a carboxyl group, a hydroxyl group, a ureido group, a hydroxyamino group, an unsubstituted amino group, a formyl group, and a halogen atom. These groups may further be substituted with the same groups.

The sulfamoyl group may be, for example, an N-aliphatic sulfamoyl group, an N-aromatic sulfamoyl group, an N-aliphatic acylsulfamoyl group, an N-aliphatic sulfonyl-sulfamoyl group, or an N-carbamoylsulfamoyl group as well as an unsubstituted sulfamoyl group. Similarly, the carbamoyl group may be an N-aliphatic carbamoyl group, an N-aromatic carbamoyl group, an N-aliphatic acylcarbamoyl group, an N-aliphatic sulfonylcarbamoyl group, or an N-sulfamoylcarbamoyl group as well as an unsubstituted carbamoyl group.

Preferred examples of the substituents defined above include an aliphatic group, an aromatic group, an aliphatic acylamino group, an aromatic acylamino group, an aliphatic oxy group, an aromatic oxy group, an aliphatic oxycarbonyl group, an aromatic oxycarbonyl group, a carbamoyl group, a sulfamoyl group, an aliphatic amino group, an aliphatic thio group, a sulfamoylamino group, a hydroxyl group, a ureido group and halogen atom.

The coupler represented by Formula (I) will be explained below in detail.

In Formulas (a) to (c) which represent A, when $R_1$ or $R_2$ represents an aliphatic group, it is a linear, branched, cyclic, substituted or unsubstituted aliphatic group having a carbon number of 1 to 50, preferably 1 to 30, and more preferably 1 to 20. Examples of the aliphatic group include methyl, ethyl, propyl, butyl, cyclopropyl, allyl, t-octyl, i-butyl, dodecyl, and 2-hexyldecyl.

When $R_1$ and $R_2$ represent a heterocyclic group, it is a 3- to 12-membered, preferably 5- to 6-membered, saturated or unsaturated, substituted or unsubstituted, and monocyclic or condensed heterocyclic group having a carbon number of 1 to 50, preferably 1 to 30, and more preferably 1 to 20, and containing at least one or more of, for example, a nitrogen atom, an oxygen atom and a sulfur atom as a hetero atom. Examples of the heterocyclic group include 3-pyrolydinyl, 1,2,4-triazole-3-yl, 2-pyridyl, 4-pyrimidinyl, 3-pyrazolyl, 2-pyrrolyl, 2,4-dioxo-1,3-imidazolidine-5-yl, and pyranyl.

When $R_1$ or $R_2$ represents an aromatic group, it is a substituted or unsubstituted aromatic group having a carbon number of 6 to 50, preferably 6 to 30, and more preferably 6 to 20. Phenyl and naphthyl are representative examples of the aromatic group.

A preferred group represented by Formula (a), is a group in which $R_1$ is an alkyl group. Particularly preferred is an alkyl group having a carbon number of 1 to 10. $R_2$ is preferably an alkyl group or an aromatic group.

The nitrogen-containing heterocyclic group formed by $Q_1$ together with =N— is a 3- to 12-membered, preferably 5- to 6-membered, substituted or unsubstituted, saturated or unsaturated, monocyclic or condensed heterocyclic group having a carbon number of 1 to 50, preferably 1 to 30, and more preferably 1 to 20. The heterocyclic group may contain, for example, an oxygen atom or sulfur atom other than a nitrogen atom as a hetero atom. Examples of this heterocyclic group include pyrolidino, piperidino, morpholino, 1-piperadinyl, 1-indolinyl, 1,2,3,4-tetrahydroquinoline-1-yl, 1-imidazolidinyl, 1-pyrazolyl, 1-pyrrolinyl, 1-pyrazolidinyl, 2,3-dihydro-1-indazolyl, 2-isoindolinyl, 1-indolyl, 1-pyrrolyl, 4-thidine-s,s-dioxo-4-yl, and benzoxazine-4-yl. In particular, the heterocyclic group formed by $Q_1$ is preferably 1-indolinyl.

$R_3$ is a monovalent organic group excluding a hydrogen atom, and preferably is an aliphatic group having a carbon number of 1 to 50, (more preferably 1 to 30), an aromatic group having a carbon number of 6 to 50 (more preferably 6 to 30), a halogen atom, or a cyano group.

$Q_2$ is an organic group necessary to form a 3- to 6-membered ring and may contain an unsaturated bond and a hetero atom in the ring. Examples of the group formed by $Q_2$ include cyclopropyl, cyclobutyl, cyclopentyl, 2-cyclobutene-1-yl, 2-cyclopentene-1-yl, bicyclo[2,1,0]pento-5-yl, bicyclo[3,1,0]hexy-6-yl, oxetane-3-yl, thietane-3-yl, oxolane-3-yl, oxolane-2-yl, thiolane-2-yl, N-alkylpyrrolidinyl, N-alkylpyrrolidine-3-yl, 2-oxabicyclo[3,2,0]pento-6-yl, 1,3-dioxolane-2-yl, 1,3-dioxane-5-yl, 2,2-dimethyl-1,3-dioxane-5-yl, 1,3-dioxane-2-yl, and 1,4-dioxane-2-yl.

Preferably, $Q_2$ is an organic group necessary to form a 3- to 5-membered ring or an organic group necessary to form a 6-membered heterocyclic ring.

The respective groups defined in Formulas (a) to (c) may further be substituted with the substituents defined above and may be condensed with a carbon ring, aromatic ring or heterocyclic ring.

Of the substituents with which the respective groups defined in Formulas (a) and (b) may be substituted, preferred substituents include an alkoxy group, a halogen atom, an alkoxycarbonyl group, an acyloxy group, an acylamino group, a sulfonyl group, a carbamoyl group, a sulfamoyl group, a sulfonamide group, a nitro group, an alkyl group, and an aryl group.

Of the substituents with which the respective groups defined for $R_3$ in Formulas (c) may be substituted, preferred substituents include a halogen atom, an alkyl group, an alkoxy group, a nitro group, an amino group, a carbonamide group, a sulfonamide group, and an acyl group. Preferred substituents with which $Q_2$ may be substituted include a halogen atom, a hydroxyl group, an alkyl group, an aryl group, an acyl group, an alkoxy group, an aryloxy group, a cyano group, an alkoxycarbonyl group, an alkylthio group, and an arylthio group.

When B represents an aromatic group, it is a substituted or unsubstituted aryl group having a carbon number of 6 to 50, preferably 6 to 30, and more preferably 6 to 20. Examples of B groups include a phenyl group and a naphthyl group.

When B represents a heterocyclic group, it is the same groups as the heterocyclic groups listed for $R_1$ or $R_2$.

The respective groups defined for B may further be substituted with the substituents defined above. It is preferred that at least one of the substituents is a halogen atom, an alkyl group, an alkoxy group, an aryloxy group, an alkoxycarbonyl group, an aliphatic or aromatic sulfonyl group, an N-aliphatic or aromatic sulfamoyl group, an N-aliphatic or aromatic carbamoyl group, an N-aliphatic or aromatic sulfonylsulfamoyl group, an N-carbamoylsulfamoyl group, an N-aliphatic or aromatic acylsulfamoyl group, an N-aliphatic or aromatic sulfonylcarbamoyl group, an N-sulfamoylcarbamoyl group, an N-aliphatic or aromatic acylamino group, or an N-aliphatic or aromatic sulfonamide group.

The aromatic group is preferred as B, and a particularly preferred example is a phenyl group having at least one substituent at the ortho position.

Z may be either a hydrogen atom or a conventionally known splitting group. Preferred groups for Z include a nitrogen-containing heterocyclic group bonded to a coupling site via a nitrogen atom, an aromatic oxy group, an aromatic thio group, a heterocyclic oxy group, a heterocyclic thio group, an acyloxy group, a carbamoyloxy group, an alkylthio group, or a halogen atom. More preferred groups for Z include a nitrogen-containing heterocyclic group bonded to a coupling site via a nitrogen atom, or an aromatic oxy group.

These splitting groups may be a non-photographically useful group, a photographically useful group, and a precursor thereof (for example, a development inhibitor, a development accelerator, a desilver accelerator, a fogging agent, a dye, a hardener, a coupler, a developing agent oxidation product scavenger, a fluorescent dye, a developing agent, or an electron transfer agent).

When Z is a photographically useful group, a conventionally known group is suitable. Examples include the photographically useful groups or the splitting groups (for example, a timing group) for releasing photographically useful groups, described in U.S. Pat. Nos. 4,248,962, 4,409,323, 4,438,193, 4,421,845, 4,618,571, 4,652,516, 4,861,701, 4,782,012, 4,857,440, 4,847,185, 4,477,563, 4,438,193, 4,628,024, 4,618,571, and 4,741,994, and European Patent Publications 193,389A, 348,139A, and 272,573A.

When Z represents a nitrogen-containing heterocyclic group bonded to a coupling site via a nitrogen atom, it is preferably a 5- or 6-membered, substituted or unsubstituted, saturated or unsaturated, monocyclic or condensed heterocyclic group having a carbon number of 1 to 55, (preferably 1 to 30, and more preferably 1 to 15). An oxygen atom or sulfur atom may be present as a hetero atom in addition to a nitrogen atom. Preferred examples of the heterocyclic group include 1-pyrazolyl, 1-imidazolyl, pyrrolino, 1,2,4-triazole-2-yl, 1,2,3-triazole-2-yl, benzotriazolyl, benzimidazolyl, imidazolidine-2,4-dione-3-yl, oxazolidine-2,4-dione-3-yl, 1,2,3-triazolidine-3,5-dione-4-yl, imidazolidine-2,4,5-trione-3-yl, 2-imidazolinone-1-yl, 3,5-dioxomorpholino, and 1-indazolyl. When these heterocyclic groups have substituents, the substituent may be the same as the substituent groups for $R_1$ described above. It is preferred that one of the substituents is an alkyl group, an alkoxy group, a halogen atom, an alkoxycarbonyl group, an aryloxycarbonyl group, an alkylthio group, an acylamino group, a sulfonamide group, an aryl group, a nitro group, a carbamoyl group, a cyano group, and a sulfonyl group.

When Z represents an aromatic oxy group, it is a substituted or unsubstituted aromatic oxy group preferably having a carbon number of 6 to 50 (more preferably a carbon number of 6 to 30, more preferably 6 to 10). A substituted or unsubstituted phenoxy group is particularly preferred. When it has a substituent, examples of the substituent include the substituents enumerated above for $R_1$. Of them, it is preferred that at least one of the substituents is an electron attractive group, and examples thereof include a sulfonyl group, an alkoxycarbonyl group, a sulfamoyl group, a halogen atom, a carbamoyl group, a nitro group, a cyano group, and an acyl group.

When Z represents an aromatic thio group, it is a substituted or unsubstituted aromatic thio group preferably having a carbon number of 6 to 50 (more preferably a carbon number of 6 to 30, more preferably 6 to 10). A substituted or unsubstituted phenylthio group is particularly preferred. When it has a substituent, examples of the substituent include the substituents listed above for $R_1$. Of them, it is preferred that at least one of the substituents is an alkyl group, an alkoxy group, a sulfonyl group, an alkoxycarbonyl group, a sulfamoyl group, a halogen atom, a carbamoyl group, or a nitro group.

When Z represents a heterocyclic oxy group, it is a 3-to 12-membered, preferably 5- or 6-membered, substituted or unsubstituted, saturated or unsaturated, and monocyclic or condensed heterocyclic oxy group having a carbon number of 1 to 50 (more preferably 1 to 20, more preferably 1 to 10) at the portion of the heterocyclic group. The heterocyclic oxy group contains, for example, at least one or more of a nitrogen atom, an oxygen atom and a sulfur atom as a hereto atom. Examples of the heterocyclic group include a pyridyloxy group, a pyrazolyloxy group, and a furyloxy group. When these heterocyclic oxy groups have substituents, examples thereof include the substituents enumerated above for $R_1$. Of them, it is preferred that one of the substituents is an alkyl group, an aryl group, a carboxyl group, an alkoxy group, a halogen atom, an alkoxycarbonyl group, an aryloxycarbonyl group, an alkylthio group, an acylamino group, a sulfonamide group, a nitro group, a carbamoyl group, and a sulfonyl group.

When Z represents a heterocyclic thio group, it is a 3-to 12-membered, preferably 5- or 6-membered, substituted or unsubstituted, saturated or unsaturated, and monocyclic or condensed heterocyclic oxy group having a carbon number of 1 to 50 (more preferably 1 to 20, more preferably 1 to 10) at the portion of the heterocyclic group. The heterocyclic thio group contains, for example, at least one or more of a nitrogen atom, an oxygen atom and a sulfur atom as a hereto atom. Examples of the heterocyclic thio group include a tetrazolylthio group, a 1,3,4-thiadiazolylthio group, a 1,3,4-oxadiazolylthio group, a 1,3,4-triazolylthio group, a benzimidazolylthio group, a benzothiazolylthio group, and a 2-pyridylthio group. When these heterocyclic thio groups have substituents, examples thereof include the substituents enumerated above for $R_1$. Of them, it is preferred that at least one of the substituents is an alkyl group, an aryl group, a carboxyl group, an alkoxy group, a halogen atom, an alkoxycarbonyl group, an aryloxycarbonyl group, an alkylthio group, an acylamino group, a sulfonamide group, a nitro group, a carbamoyl group, a heterocyclic group, and a sulfonyl group.

When Z represents an acyloxy group, it is a monocyclic or condensed and substituted or unsubstituted aromatic acyloxy group preferably having a carbon number of 6 to 50, (more preferably a carbon number of 6 to 30, more preferably 6 to 10), or a substituted or unsubstituted aliphatic acyloxy group preferably having a carbon number of 2 to 50 (more preferably a carbon number of 2 to 30, more preferably 2 to 20). When these groups have the substituents, examples of the substituent include substituents enumerated above for $R_1$.

When Z represents a carbamoyloxy group, it is an aliphatic, aromatic or heterocyclic, substituted or unsubstituted carbamoyloxy group preferably having a carbon number of 1 to 50 (more preferably a carbon number of 1 to 30, more preferably 1 to 20). Examples thereof include N,N-diethylcarbamoyloxy, N-phenylcarbamoyloxy, 1-imidazolylcarbonyloxy, and 1-pyrrolocarbonyloxy. When these groups have substituents, examples of the substituent include the substituents enumerated above for $R_1$.

When Z represents an alkylthio group, it is a linear, branched or cyclic, saturated or unsaturated, substituted or unsubstituted alkylthio group preferably having a carbon number of 1 to 50 (more preferably a carbon number of 1 to 30, more preferably 1 to 20). When these groups have substituents, examples of the substituent include the substituents enumerated above for $R_1$.

Of the groups represented by Formulas (a) to (c), preferred are groups represented by the following Formulas (a-1), (b-1), (b-2) and (c-1):

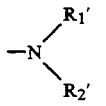
Formula (a-1)

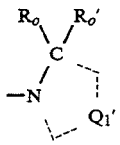
Formula (b-1)

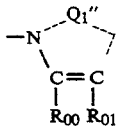
Formula (b-2)

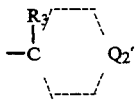
Formula (c-1)

In Formulas (a-1) to (c-1), $R_1'$ represents an alkyl group; $R_2'$ represents an alkyl group or an aromatic group; $Q_1'$ and $Q_1''$ each represents an organic group which forms a nitrogen-containing heterocyclic ring; $R_0$, $R_0'$, $R_{00}$ and $R_{01}$ may be the same or different and each represents a hydrogen atom or a substituent; $R_0$ and $R_0'$, and $R_{00}$ and $R_{01}$ may be combined with each other to form a 5- to 7-membered ring; $R_3'$ represents a halogen atom or an alkyl group; $Q_2'$ represents an organic group which forms a 3- to 6-membered hydrocarbon ring; provided that the alkyl group represented by $R_3'$ is not combined with $Q_2'$ to form a ring.

The alkyl group represented by $R_1'$, $R_2'$ or $R_3'$ is a linear, branched or cyclic, substituted or unsubstituted alkyl group having a carbon number of 1 to 50, preferably a carbon number of 1 to 30, more preferably a carbon number of 1 to 20.

The aromatic group represented by $R_2'$ is defined the same as the aromatic group represented by $R_2$. Of the groups represented by Formula (a-1) to (b-2), the preferred groups are the groups represented by Formulas (b-1) and (b-2). More preferred are the groups represented by Formula (b-2). Of the groups represented by Formula (b-2), preferred are the groups represented by Formula (b-2'):

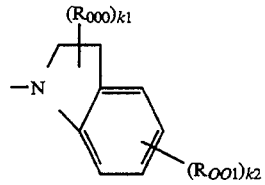
(b-2')

wherein $R_{000}$ and $R_{001}$ each represents a substituent; $k_1$ represents 0 to 2 and $k_2$ represents 0 to 4. When a plurality of $R_{000}$ and $R_{001}$ groups are present, they may be the same as or different from each other.

Preferred examples of $R_{000}$ include an aliphatic group and an aromatic group.

Preferred examples of $R_{001}$ include an aliphatic group, an aromatic group, a halogen atom, an aliphatic oxy group, an aliphatic oxycarbonyl group, an aromatic oxycarbonyl group, a carbamoyl group, a sulfamoyl group, an aromatic oxy group, an aliphatic acylamino group, an aromatic acylamino group and nitro group.

Of the groups represented by Formula (c-1), it is preferred that $R_3'$ is an alkyl group, particularly preferably methyl, ethyl, propyl, or benzyl.

Of the substituents with which $Q_2'$ may be substituted, preferred is a halogen atom or an alkyl group. Of the hydrocarbon rings formed by $Q_2'$, preferred is a 3- to 5-membered saturated hydrocarbon ring, particularly preferably a cyclopropane ring.

In the present invention, A is most preferably the group represented by Formula (c-1).

The partial structure which is present in at least one of the groups represented by A, B or Z will be explained below.

$L_{a1}$ represents a bond or an organic group having an atom number of 1 to 8 contributing to bonding distance between —N($R_{a1}$)— and —N($R_{a2}$)—, wherein "the atom number contributing to the bonding distance" means the number of carbon atoms, nitrogen atoms, oxygen atoms or a sulfur atoms present on a straight chain connecting —N($R_{a1}$)— and —N($R_{a2}$). The atom number contributing to the bonding distance is more preferably 1 to 5, more preferably 1 to 3, and most preferably 1 or 2. Examples of these groups include, a di- to trivalent aliphatic group having a carbon number of 1 to 30, a di- to trivalent aromatic group having a carbon number of 6 to 36, a di- to trivalent heterocyclic group having a carbon number of 1 to 30, an aliphatic dioyl group having a carbon number of 2 to 30, an aliphatic trioyl group having a carbon number of 3 to 30, an aromatic dioyl group having a carbon number of 6 to 36, an aromatic trioyl group having a carbon number of 6 to 36, an aliphatic disulfonyl group having a carbon number of 1 to 30, an aliphatic trisulfonyl group having a carbon number of 1 to 30, an aromatic disulfonyl group having a carbon number of 6 to 36, an aromatic trisulfonyl group having a carbon number of 6 to 36, an oxalyl group, an alkylenecarbonyl group having a carbon number of 2 to 30, an arylenecarbonyl group having a carbon number of 7 to 37, an alkyelenesulfonyl group having a carbon number of 1 to 30, an arylenesulfonyl group having a carbon number of 6 to 36, an alkylenephenylene group having a carbon number of 7 to 37, an alkyleneoxyalkylene group having a carbon number of 2 to 32, an alkylenethioalkylene group having a carbon number of 2 to 32, an alkylenecarbonylalkylene group having a carbon number of 3 to 33, and an alkyleneaminoalkylene group having a carbon number of 2 to 32. Preferred is a di- to trivalent aliphatic group, a di- to trivalent aromatic group, or a di-to trivalent group obtained by combining the aliphatic group and aromatic group. More preferred is a divalent aliphatic group or aromatic group. Particularly preferred is ethylene, propylene, 1,2- or 1,3-phenylene, or oxalyl.

$X_{a1}$ and $Y_{a1}$ each represents —CO—, —SO— or —$SO_2$—. Further, when $L_{a1}$ is a bond or an oxalyl group, $X_{a1}$ and $Y_{a1}$ may be a bond at the same time. Preferred is —CO— or —$SO_2$— and more preferred is —CO—.

More particularly, $R_{a1}$ and $R_{a2}$ each represents a hydrogen atom, an aliphatic group (preferably having a carbon number of 1 to 20, more preferably 1 to 10, for example, methyl, ethyl, n-propyl, i-butyl, t-butyl, benzyl, cyclohexyl, allyl, n-octyl, and n-hexadecyl), an aromatic group (preferably having a carbon number of 6 to 26, more preferably 6 to 16, for example, phenyl and naphthyl), a heterocyclic group (preferably having a carbon number of 1 to 20, more preferably 1 to 10, for example, furyl, thienyl, pyrrolyl, imidazolyl, chromanyl, pyrrolinyl, pipelidyl, morpholinyl, xanthenyl, 1,3,5-triazine-2-yl, and thiane-2-yl), an aliphatic or aromatic acyl group (preferably having a carbon number of 1 to 26, more preferably 1 to 16, for example, acetyl, butanoyl, tetradecanoyl, and benzoyl), an aliphatic or aromatic sulfonyl group (preferably having a carbon number of 1 to 26, more preferably 1 to 16, for example, methanesulfonyl, dodecanesulfonyl, and benzenesulfonyl), an aliphatic or aromatic sulfinyl group (preferably having a carbon number of 1 to 26, more preferably 1 to 16, for example, ethanesulfinyl, octanesulfinyl, and toluenesulfinyl), a carbamoyl group (preferably having a carbon number of 1 to 26, more preferably 1 to 16, for example, N-ethylcarbamoyl, N-butyl-N-phenylcarbamoyl, N,N-dioctylcarbamoyl, and N-phenylcarbamoyl), a sulfamoyl group (preferably having a carbon number of 0 to 26, more preferably 1 to 16, for example, N-propylsulfamoyl, N, N-dibenzylsulfamoyl, and N-phenylsulfamoyl), or an aliphatic oxy- or aromatic oxycarbonyl group (preferably having a carbon number of 2 to 26, more preferably 1 to 26, for example, methoxycarbonyl, cyclopentyloxycarbonyl, hexadecyloxycarbonyl, and phenyloxycarbonyl). Particularly preferred as $R_{a1}$ and $R_{a2}$ is a hydrogen atom or an alkyl group having a carbon number of 1 to 10.

$R_{b1}$ and $R_{b2}$ each represents a hydrogen atom or an aliphatic group (preferably having a carbon number of 1 to 24, more preferably 1 to 10, for example, methyl, ethyl, n-propyl, i-butyl, cyclohexyl, benzyl, n-octyl, and n-hexadecyl). Particularly preferred as $R_{b1}$ and $R_{b2}$ is a hydrogen atom.

$Q_3$ represents an organic group necessary to form a 5-to 6-membered nitrogen-containing heterocyclic ring. Examples of the nitrogen-containing heterocyclic ring formed by $Q_3$ include a pyrrolidine ring, an imidazoline ring, a piperazine ring, a piperidine ring, a morpholine ring, and an isoindoline ring. Particularly preferred is the piperidine ring.

$R_{c1}$ represents an aliphatic group (preferably having a carbon number of 1 to 24, more preferably 1 to 10, for example, methyl, ethyl, n-propyl, cyclopentyl, i-butyl, t-octyl, benzyl, and hexadecyl), an aromatic group (preferably having a carbon number of 6 to 26, more preferably 6 to 16, for example, phenyl and naphthyl), or a heterocyclic group (for example, thienyl, pyrrolyl, and chromanyl). $R_{c2}$ and $R_{c3}$ each represents a hydrogen atom or the groups defined for $R_{c1}$. $R_{c1}$ is preferably an aromatic group, and $R_{c2}$ and $R_{c3}$ are particularly preferably a hydrogen atom.

$Q_4$ represents an organic group necessary to form a thiane ring which is a 6-membered saturated ring, and $n_1$ represents 0, 1 or 2. $R_{c4}$ represents a substituent, more preferably an aliphatic group, an aromatic group, a heterocyclic group, a halogen atom, an aliphatic oxy group, an aromatic oxy group, an amino group, an acylamino group, a sulfonamide group, an aliphatic thio group, an aromatic thio group, an acyl group, a sulfonyl group, or a hydroxyl group. $n_2$ represents an integer of 0, and 1 to 4. $n_3$ represents 0 or 1.

$R_{e1}$ and $R_{e2}$ each represents a substituent as defined above, and each are preferably an aliphatic group, an aromatic group, a heterocyclic group, an acylamino group, a sulfonamide group, a hydroxyl group, an aliphatic oxy group, an aromatic oxy group, an aliphatic thio group, an aromatic thio group, an aliphatic or aromatic oxycarbonyl group, a carbamoyl group, a sulfamoyl group, a ureido group, an amino group, a halogen atom, and an acyloxycarbonyl group. $n_4$ and $n_5$ each represents an integer of 0 and 1 to 3. $X_e$ represents a single bond, —O—, —S—, —$C(R_{e3})(R_{e4})$—, or $$-\overset{|}{\underset{|}{C}}-$$
$R_{e3}$ $X_e$ is preferably —S—, —$C(R_{e3})(R_{e4})$—, or the group represented by the above formula.

$R_{e3}$ and $R_{e4}$ each represents a hydrogen atom, an aliphatic group (preferably having a carbon number of 1 to 20, more preferably 1 to 10, for example, methyl, ethyl, n-propyl, i-propyl, t-butyl, cyclohexyl, benzyl, n-octyl, n-dodecyl, n-hexadecyl, and allyl), or an aromatic group (preferably having a carbon number of 6 to 26, more preferably 6 to 16, for example, phenyl and naphthyl). $R_{e3}$ and $R_{e4}$ each are preferably a hydrogen atom or an aliphatic group.

$R_{a1}$ and $R_{a2}$, $R_{a1}$ and $L_{a1}$, $R_{a2}$ and $L_{a1}$, and plural $R_{e1}$ groups or plural $R_{e2}$ groups (when plural $R_{e1}$'s and $R_{e2}$'s are present) may be combined with each other to form a 5- to 7-membered ring. The respective groups defined in Formulas (P-I) to (P-V) may further be substituted with the substituents described above.

Of the groups represented by Formulas (P-I) to (P-V), preferred groups are represented by the following Formulas (P-I-1) to (P-V-1):

Formula (P-I-1)

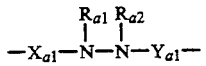

Formula (P-I-2)

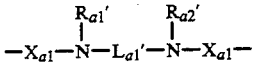

Formula (P-I-3)

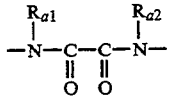

Formula (P-I-4)

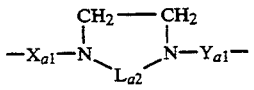

Formula (P-II-1)

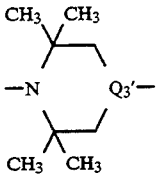

Formula (P-III-1)

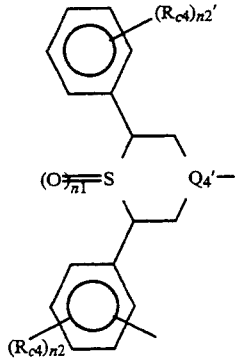

Formula (P-IV-1)

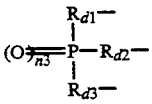

Formula (P-V-1)

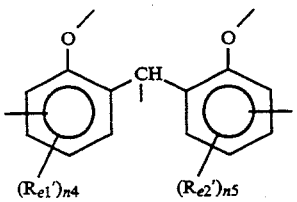

In Formulas (P-I-1) to (P-V-1), $X_{a1}$ $Y_{a1}$, $R_{a1}$, $R_{a2}$, $R_{c4}$, $n_1$, $n_2$, $n_3$, $n_4$, and $n_5$ are defined the same as those defined in Formulas (P-I) to (P-V).

$R_{a1}'$ and $R_{a2}'$ may be the same or different and each represents a hydrogen atom, an aliphatic group, an aromatic group, an aliphatic or aromatic acyl group, or an aliphatic or aromatic sulfonyl group. $L_{a1}'$ represents a di- to trivalent aliphatic group, a di- to trivalent aromatic group, or a di- to trivalent group formed by combining an aliphatic group and an aromatic group (for example, alkylphenylene and alkenylenephenylene), each having an atom number of 1 to 8 contributing to a bonding distance between —N($R_{a1}$)— and —N($R_{a2}$)—. These groups may have the substituents described above and may contain a hetero atom and a functional group in the groups. Examples of the group having a hetero atom and functional group include, ethyleneoxyethylene, ethylenethioethylene, ethylenecarbonylethylene, methylenephenylenemethylene, methylenepiperazine-1,4-ylmethylene, ethylenesulfonylethylene, 3-methyl-3-azapentane-1,5-diyl, and 3-azapentane-1,3,5-triyl. In $L_{a1}'$, the atom number contributing to a bonding distance between —N($R_{a1}'$)— and —N($R_{a2}'$)— is preferably 2 to 5, more preferably 2 to 3, and most preferably 2. $L_{a1}'$ is preferably a divalent aliphatic or aromatic group, more preferably an alkylene group or a phenylene group each allowed to have a substituent. The alkylene group is preferably ethylene which may have a substituent, and the phenylene group is preferably 1,2-phenylene which may have a substituent.

$L_{a2}$ represents a divalent aliphatic group, and these groups may have a substituent. Also, it may have a hetero atom and a functional group in the group. $L_{a2}$ has an atom number contributing to a bonding distance of preferably 1 to 5, more preferably 2 to 3. $L_{a2}$ is preferably a divalent alkylene group, more preferably ethylene or propylene which may have a substituent.

=$Q_3'$— represents an organic group necessary to form a 6-membered ring and is preferably an organic group forming a 6-membered ring with a carbon atom, a nitrogen atom, an oxygen atom, or a sulfur atom, more preferably an organic group forming a 6-membered ring with the carbon atoms.

$n_2'$ represents an integer of 0 to 5 and =$Q_4'$— represents an organic group necessary to form a thiane ring which is a 6-membered saturated ring.

$R_{d1}$ to $R_{d3}$ may be the same or different and each represents a divalent aliphatic group, a divalent aromatic group, a divalent heterocyclic group, an oxygen atom, a sulfur atom, and —N($R_{d0}$)—, wherein $R_{d0}$ represents a hydrogen atom, an aliphatic group, an aromatic group, or a heterocyclic atom. $R_{e1}'$ and $R_{e2}'$ may be the same or different and each represents an aliphatic group, an aromatic group, a heterocyclic group, an aliphatic, aromatic or heterocyclic oxy group, an aliphatic, aromatic or heterocyclic thio group, an aliphatic, aromatic or heterocyclic acylamino group, an aliphatic, aromatic or heterocyclic sulfonamide group, an imide group, a carbamoyl group, a sulfamoyl group, a ureido group, an aliphatic, aromatic or heterocyclic oxycarbonyl group, an aliphatic, aromatic or heterocyclic acyl group, or a halogen atom.

Of the compounds represented by Formulas (P-I-1) to (P-I-4), the compounds represented by Formulas (P-I-1), (P-I-3) and (P-I-4) are preferred, and the compounds represented by Formula (P-I-4) are more preferred.

The embodiment in which the group represented by these Formulas (P-I) to (P-V) is a partial structure of A, B or Z will be explained below.

Where the group represented by Formulas (P-I) to (P-V) is the partial structure of Formula (a), which is A of Formula (I), an aliphatic group, aromatic group or heterocyclic group of $R_1$ or $R_2$ may have the group represented by Formulas (P-I) to (P-V). Preferred is the embodiment in which the aliphatic group, aromatic group or heterocyclic group of $R_1$ or $R_2$ is an aliphatic group, aromatic group or heterocyclic group which is substituted with the group represented by the following Formula (P-I-a), (P-II-a-1), (P-II-a-2), (P-III-a), (P-IV-a), (P-V-a-1), (P-V-a-2), or (P-V-a-3).

(P-I-a)

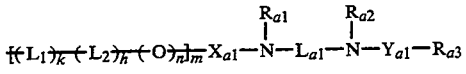

(P-II-a-1)

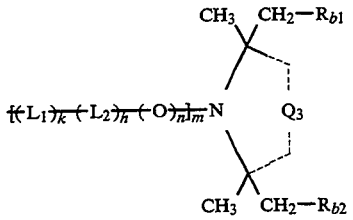

(P-II-a-2)

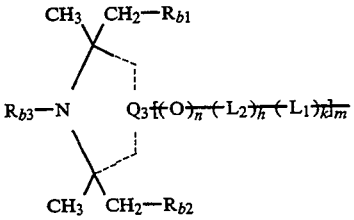

(P-III-a)

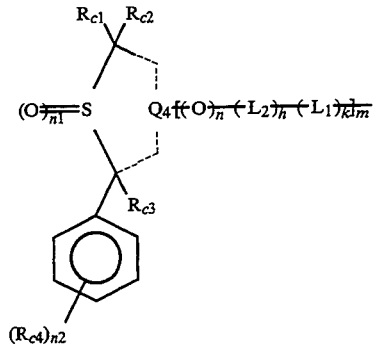

(P-IV-a)

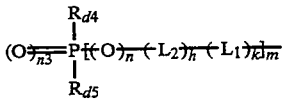

(P-V-a-1)

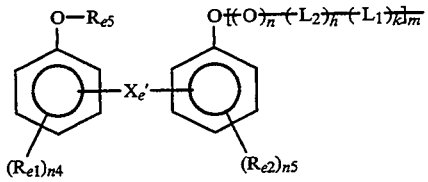

(P-V-a-2)

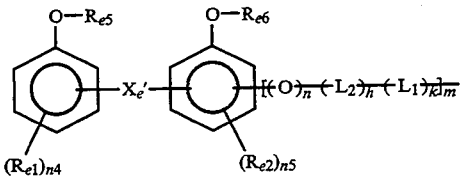

(P-V-a-3)

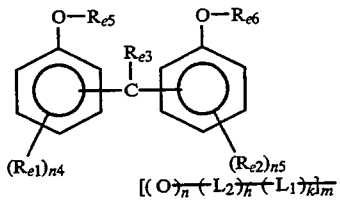

wherein $L_1$ represents a linkage group formed by combining at least one of —CO— and —$SO_2$— with —NH—, —CO—, or —COO—*; the mark * represents a bond to $L_2$; $L_2$ represents an alkylene group or an arylene group; k, h and n each represents 0 or 1; m represents an integer of 0 and 1 to 3; $R_{a3}$ represents an aliphatic group or an aromatic group; $R_{b3}$ represents a hydrogen atom, an aliphatic group, an aliphatic oxy group, or an aliphatic or aromatic acyl group; $R_{d4}$ and $R_{d5}$ each represents an aliphatic group, an aromatic group, an aliphatic oxy group, an aromatic oxy group, an aliphatic amino group, or an aromatic amino group; $L_2$, $R_{d4}$ and $R_{d5}$ may be combined with each other to form a ring; $R_{e5}$ and $R_{e6}$ each represents a hydrogen atom, an aliphatic acyl group, or an aliphatic group; $X_e'$ represents a single bond, —O—, —S—, or —C($R_{e3}$)-($R_{e4}$)—; and the other groups are defined the same as those defined in Formulas (P-I) to (P-V).

Examples of $L_1$ include —NHCO—*, —CONH*—, —$NHSO_2$—*, —$SO_2NH$—*, —NHCONH—*, —$SO_2NHCO$—*, —$SO_2NHSO_2$—*, —$SO_2NH$-CONH—*, —$CONHSO_2NH$—*, —CONHCO—*, —CO—*, and —COO—*. The alkylene group of $L_2$ is preferably a linear, branched or cyclic alkylene group having a carbon number of 1 to 20, and the arylene group thereof is preferably a phenylene group having a carbon number of 6 to 36.

When m is 2 or 3, a plurality of [$(L_1)_k$—$(L_2)_h$—$(O)_n$] groups may be the same or different.

More specifically, $R_{a3}$ represents an aliphatic group (preferably having a carbon number of 1 to 50, more preferably 1 to 30, for example, phenoxymethyl, tridecyl, and 2,4-t-butylphenoxy-1-ethylmethyl), or an aromatic group (preferably having a carbon number of 6 to 56, more preferably 7 to 36, for example, 4-t-amylphenyl and 3-t-amyl-6-butoxyphenyl).

In particular, $R_{b3}$ represents a hydrogen atom, an aliphatic group (preferably having a carbon number of 1 to 30, more preferably 1 to 20, for example, methyl and benzyl), an aliphatic oxy group (preferably having a carbon number of 1 to 30, more preferably 1 to 20, for example, methoxy and butoxy), or an aliphatic or aromatic acyl group (preferably having a carbon number of 1 to 30, more preferably 1 to 20, for example, acetyl, acryloyl and benzoyl).

$R_{d4}$ and $R_{d5}$ each represents an aliphatic group (preferably having a carbon number of 1 to 40, more preferably 1 to 30, for example, butyl, t-butyl, 2-ethylhexyl, pentyl, dodecyl, and cyclohexyl), an aromatic group (preferably having a carbon number of 6 to 36, more preferably 6 to 26, for example, phenyl and 4-t-butylphenyl), an aliphatic oxy group (preferably having a carbon number of 1 to 40, more preferably 1 to 30, for example, ethoxy, i-propyloxy, butoxy, t-butoxy, hexyloxy, 2-ethylhexyloxy, decyloxy, dodecyloxy, and cyclohexyloxy), an aromatic oxy group (preferably having a carbon number of 6 to 36, more preferably 6 to 26, for example, phenoxy and 4-t-butylphenoxy), an aliphatic amino group (preferably having a carbon number of 1 to 40, more preferably 1 to 30, for example, octylamino, dihexylamino, and dibutylamino), or an aromatic amino group (preferably having a carbon number of 6 to 40, more preferably 6 to 30, for example, phenylamino and 2,4-dibutylphenylamino).

$R_{e5}$ and $R_{e6}$ each represents a hydrogen atom, an aliphatic acyl group (preferably having a carbon number of 1 to 30, more preferably 1 to 20, for example, acetyl and acryloyl), or an aliphatic group (preferably having a carbon number of 1 to 30, more preferably 1 to 20, for example, benzyl).

Where the group represented by Formulas (P-I) to (P-V) is the partial structure of Formula (b), which is A of Formula (I), the nitrogen-containing heterocyclic ring formed by $Q_1$ may be substituted with the group having a group represented by Formulas (P-I) to (P-V) as a partial structure. Preferred is the embodiment in which the nitrogen-containing heterocyclic ring formed by $Q_1$ is substituted with the group represented by Formulas (P-I-a), (P-II-a-1), (P-II-a-2), (P-III-a), (P-IV-a), (P-V-a-1), (P-V-a-2), or (P-V-a-3).

Where the group represented by Formulas (P-I) to (P-V) is the partial structure of Formula (c), which is A of Formula (I), $R_3$ may have the group represented by Formulas (P-I) to (P-V) or the 3- to 6-membered ring formed by $Q_2$ may be substituted with the group having a group represented by Formulas (P-I) to (P-V) as a partial structure. Preferred is the embodiment in which the 3- to 6-membered ring formed by $Q_2$ is substituted with the group represented by above Formulas (P-I-a), (P-II-a1), (P-II-a-2), (P-III-a), (P-IV-a), (P-V-a-1), (P-V-a-2), or (P-V-a-3).

Where the group represented by Formulas (P-I) to (P-V) is the partial structure of B in Formula (I), an aromatic group or heterocyclic group of B may have the group represented by Formulas (P-I) to (P-V). Preferred is the embodiment in which the aromatic group or heterocyclic group of B is an aromatic group or heterocyclic group substituted with the group represented by above Formulas (P-I-a), (P-II-a-1), (P-II-a-2), (P-III-a), (P-IV-a), (P-V-a-i), (P-V-a-2), or (P-V-a-3).

Where the group represented by Formulas (P-I) to (P-V) is the partial structure of Z in Formula (I), the group of Z (hereinafter referred to as a splitting group) which can be split off upon a coupling reaction with the oxidation product of an aromatic primary amine developing agent may have the group represented by Formulas (P-I) to (P-V). Preferred is the embodiment in which the splitting group of Z is a splitting group substituted with the group represented by above Formulas (P-I-a), (P-II-a-1), (P-II-a-2), (P-III-a), (P-IV-a), (P-V-a-1), (P-V-a-2), or (P-V-a-3).

In the present invention, it is preferred that the group represented by Formulas (P-I) to (P-V) is the partial structure of A or B in Formula (I), and more preferred it is the partial structure of B.

It is preferred that the group represented by Formula (P-IV), of the groups represented by Formulas (P-I) to (P-V), is present, since hue and color developability are excellent, and the reduction of color developability against the fluctuation of a development processing composition is small.

The coupler of the present invention having the partial structure represented by Formula (P-IV) will be explained below in further detail.

In Formula (P-IV), it is preferred that $n_3$ is 0 for image fastness. Also, it is preferred that $n_3$ is 1 for hue and color developability and particularly preferred in the present invention.

That is, of the groups represented by Formula (P-IV), the groups which are particularly excellent for image fastness, hue and color developability can be represented by Formula (P-IV-1'):

Formula (P-IV-1')

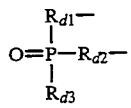

wherein $R_{d1}$, $R_{d2}$ and $R_{d3}$ are defined the same as those defined in Formula (P-IV-1).

A coupler having the group represented by Formula (P-IV-1') for a partial structure is represented preferably by Formula (II):

Formula (II)

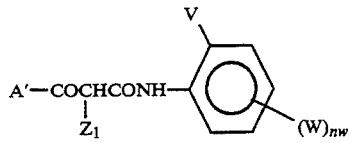

wherein A' is defined the same as A defined in Formula (I); $Z_1$ represents a nitrogen-containing heterocyclic group which is bonded to a coupling site via the nitrogen atom; V represents a halogen atom, an alkoxy group, or an aryloxy group; W represents a substituent; $n_w$ represents 1 or 2; provided that at least one of A', V and W has the partial structure represented by Formula (P-IV-1').

The preferred range of A is the same as explained in Formula (I), and $Z_1$ is defined the same as the nitrogen-containing heterocyclic group which is bonded to a coupling site via the nitrogen atom in the explanation of Z in Formula (I). The preferred range thereof also is the same.

It is preferred that the partial structure represented by Formula (P-IV-1') is included in V or W and more preferred is the case in which it is included in W.

Where W has the partial structure represented by Formula (P-IV-1'), it is preferred that W is represented by Formula (P-IV-a'):

Formula (P-IV-a')

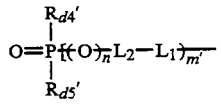

wherein $L_1$, $L_2$ and n are defined the same as those defined in Formula (P-IV-a); m' represents 1 or 2; $R_{d4}'$ and $R_{d5}'$ each represents an alkoxy group, an aryloxy group, an alkyl group, an aryl group, an alkylamino group, or an arylamino group; and $L_2$, $R_{d4}'$ and $R_{d5}'$ may be combined with each other to form a ring.

The alkoxy group represented by $R_{d4}'$ and $R_{d5}'$ is preferably a linear or branched alkoxy group having the carbon number of 2 to 20. The aryloxy group is preferably an aryloxy group having a carbon number of 6 to 20. The alkyl group is preferably a linear or branched alkyl group having a carbon number of 1 to 20. The aryl group is preferably an aryl group having a carbon number of 6 to 20. The alkylamino group is preferably a linear or branched alkylamino group having a carbon number of 2 to 20. The arylamino group is preferably an arylamino group having a carbon number of 6 to 36. The alkoxy group is particularly preferred for $R_{d4}'$ and $R_{d5}'$. Preferred for m' is 1.

Of the couplers represented by Formula (II), a more preferred one is represented by Formula (III):

Formula (III)

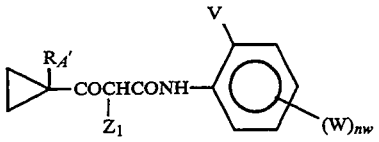

wherein $R_A'$ represents an ethyl group or a benzyl group; V, W, $Z_1$ and $m_w$ are defined the same as in Formula (II); provided that the group represented by Formula (P-IV-1') is the partial structure of W.

The exemplified compounds of the coupler represented by Formula (I) according to the present invention are shown below but the compounds of the present invention is not limited thereby.

Y-1

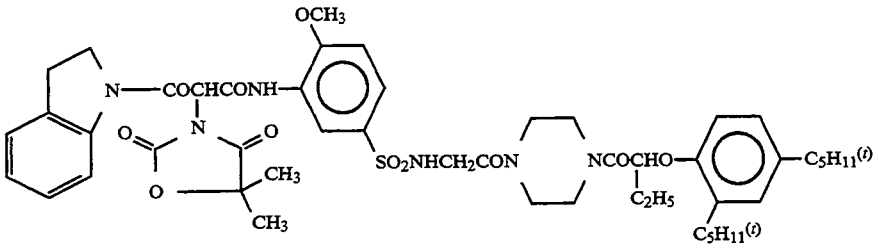

Y-2

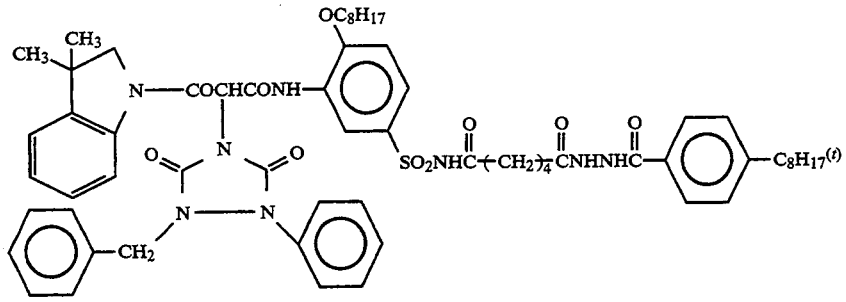

Y-3

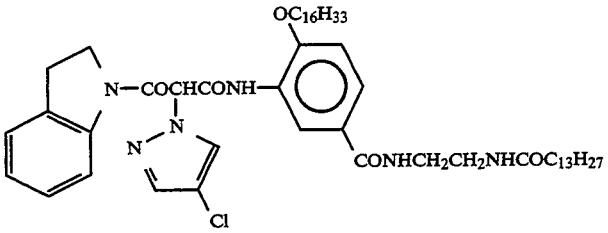

Y-4

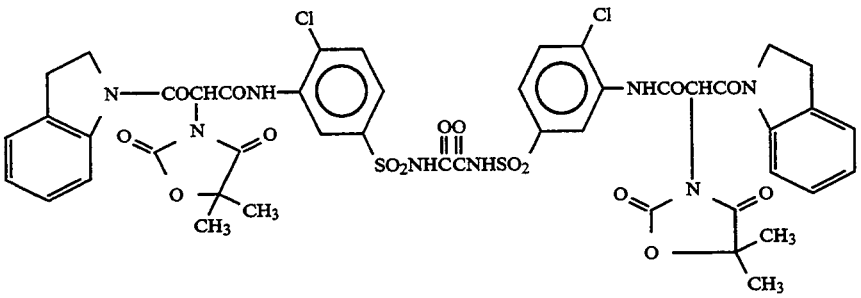

-continued
Y-5
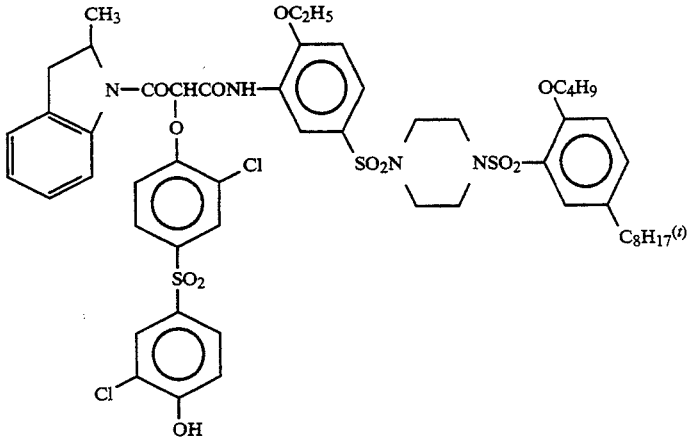
Y-6
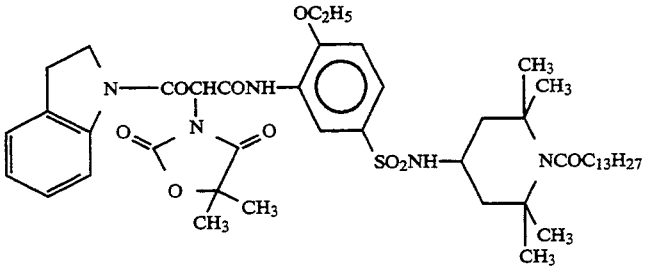
Y-7
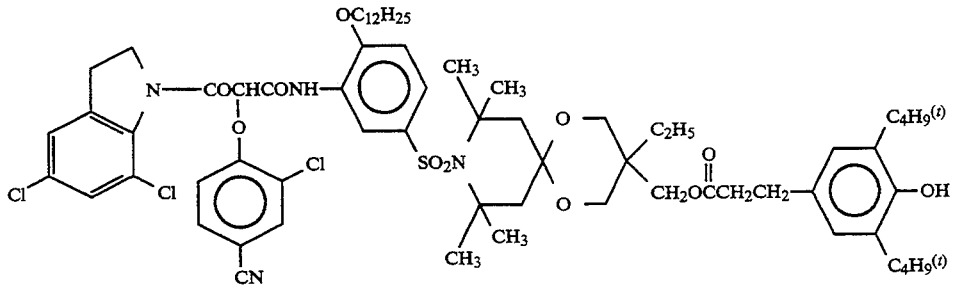
Y-8
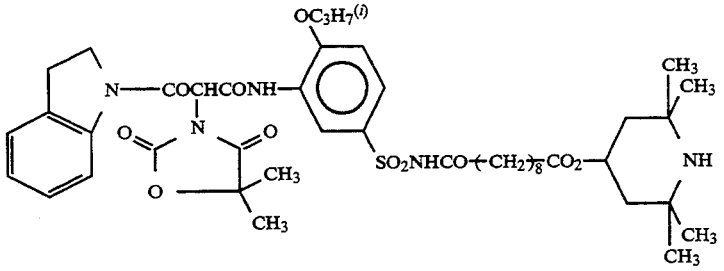
Y-9
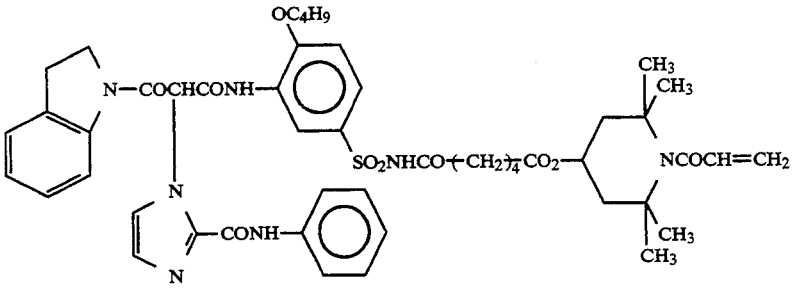

-continued
Y-10
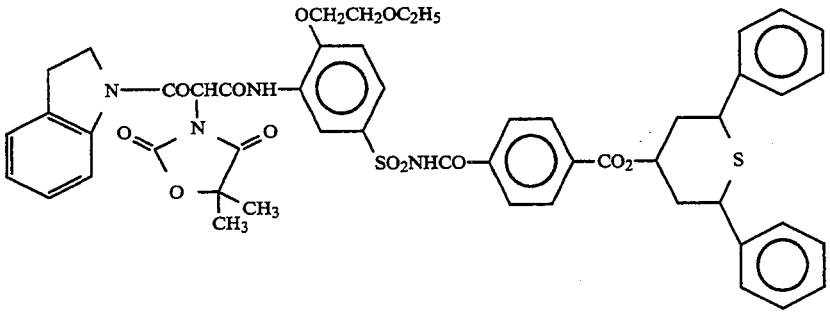
Y-11
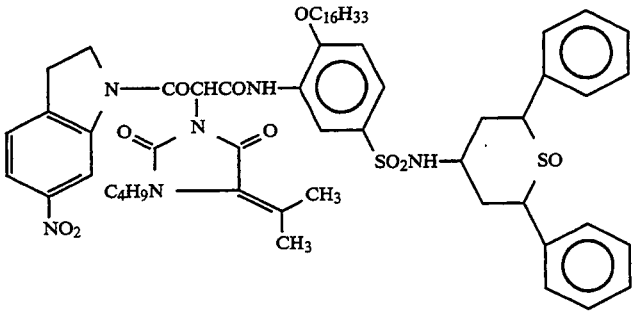
Y-12
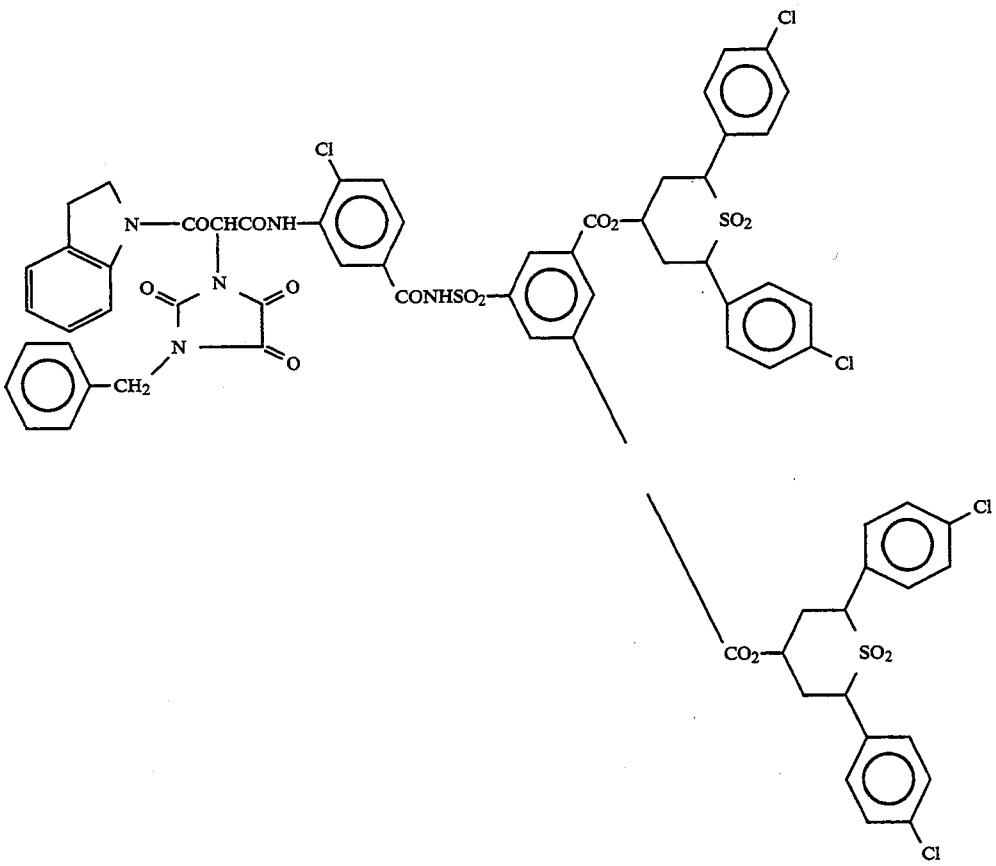

-continued
Y-13
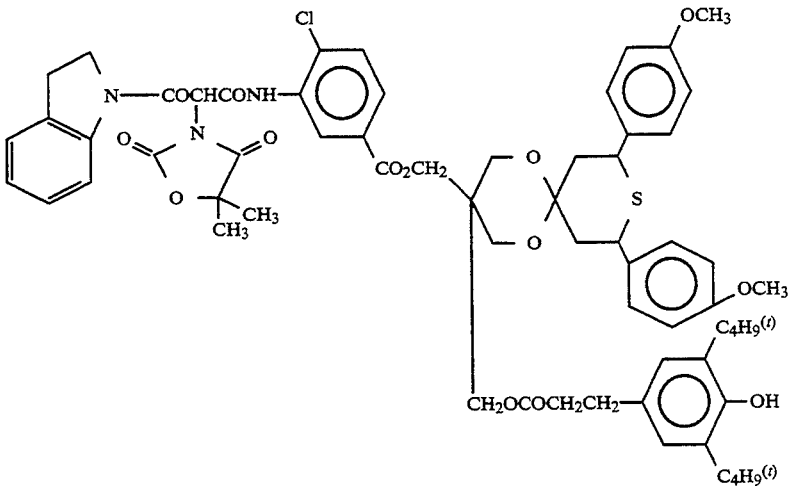
Y-14
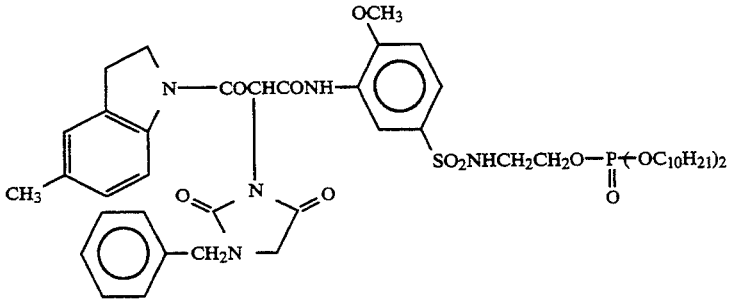
Y-15
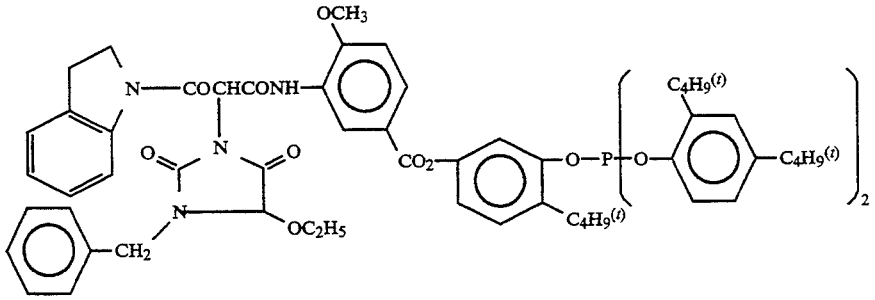
Y-16
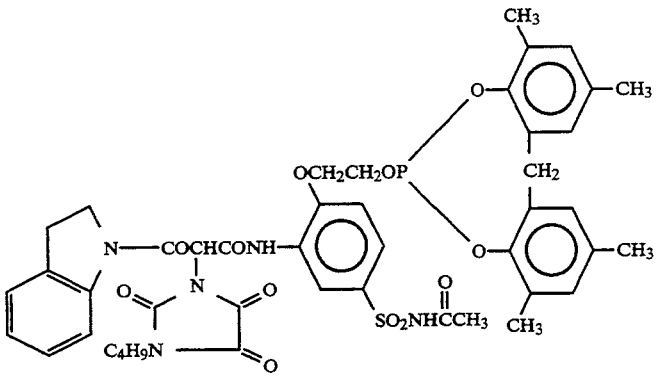

-continued
Y-17
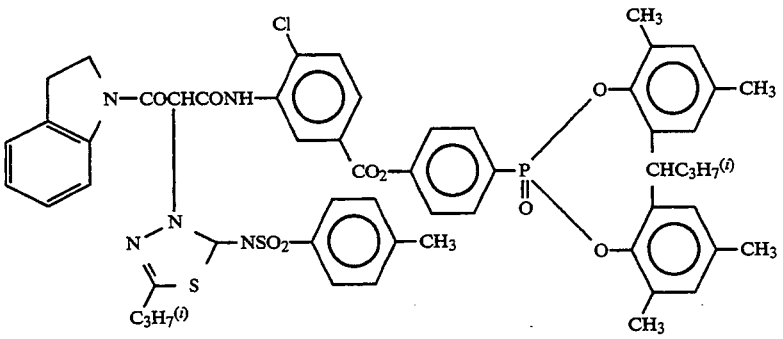
Y-18
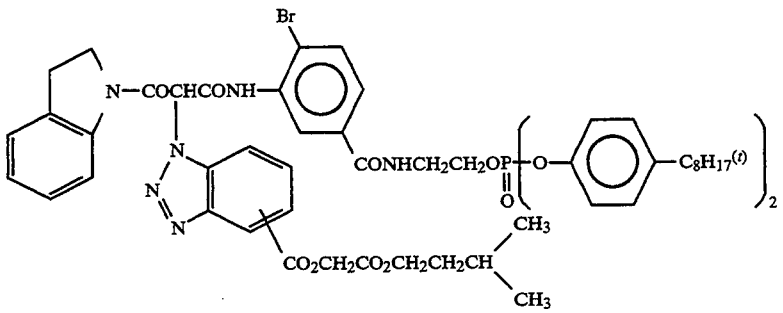
Y-19
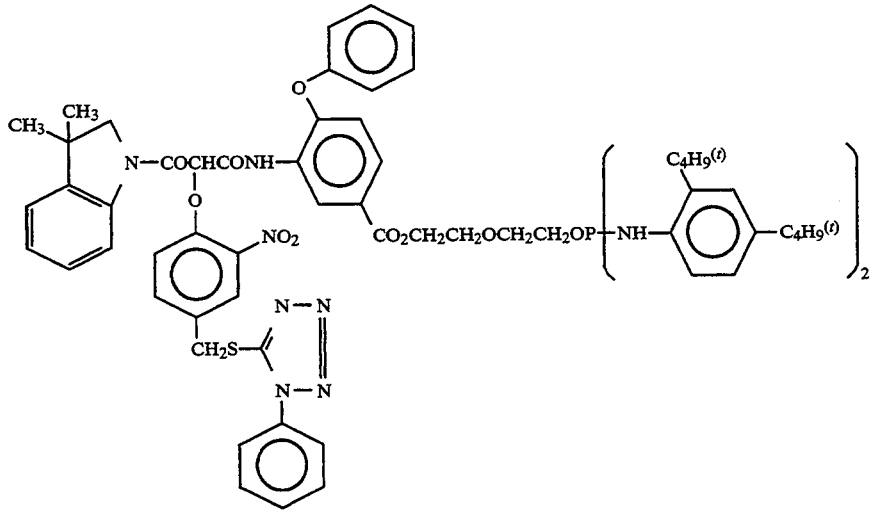
Y-20
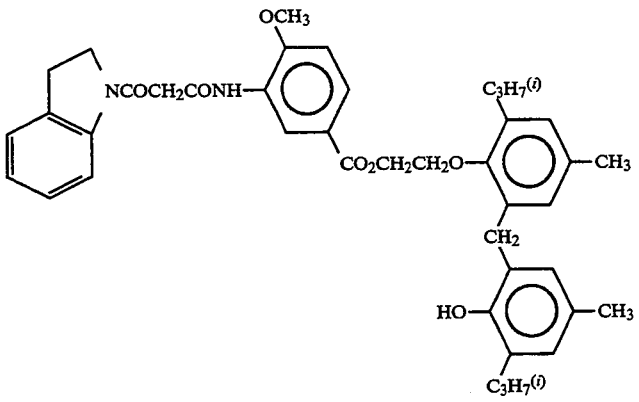

-continued
Y-21
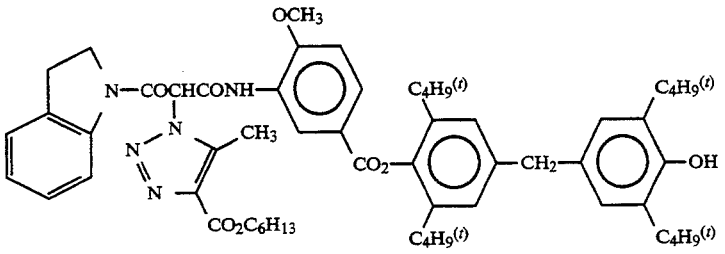
Y-22
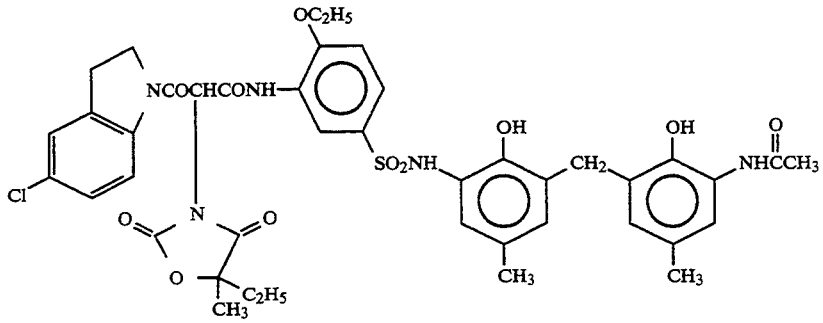
Y-23
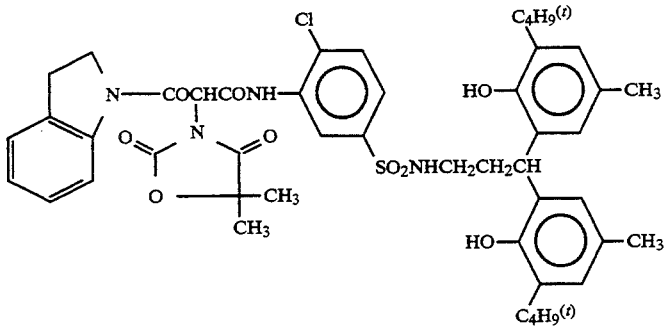
Y-24
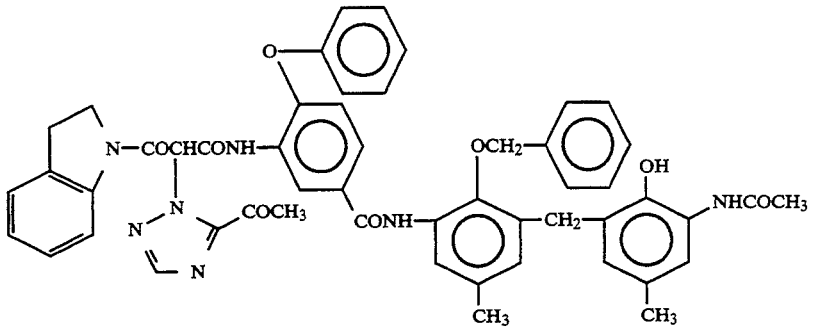

-continued
Y-25
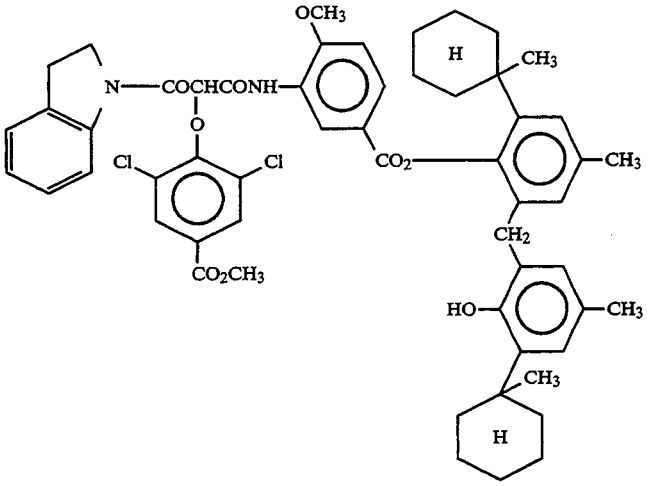
Y-26
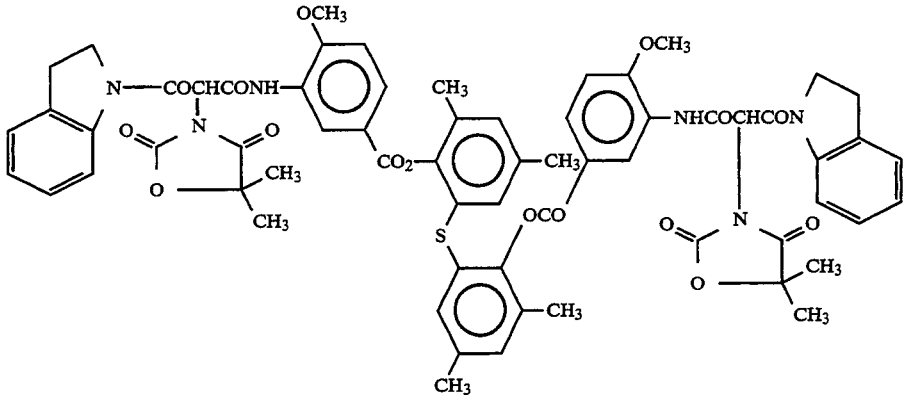
Y-27
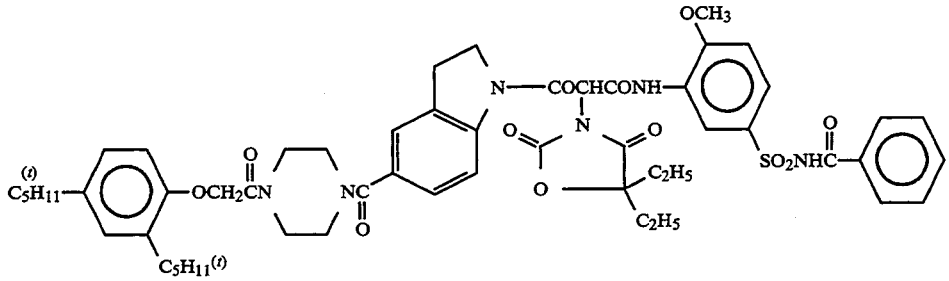
Y-28
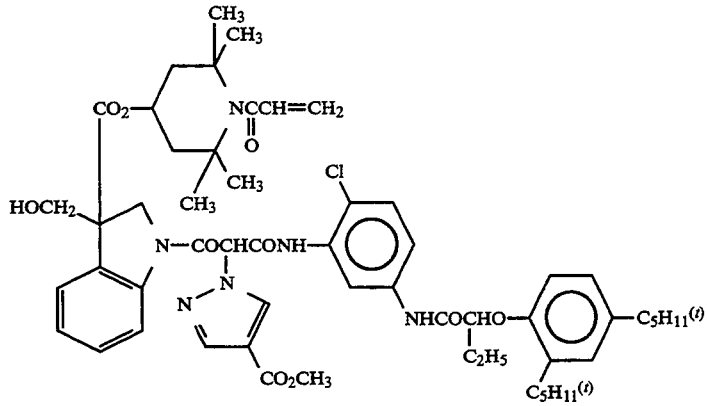

-continued
Y-29
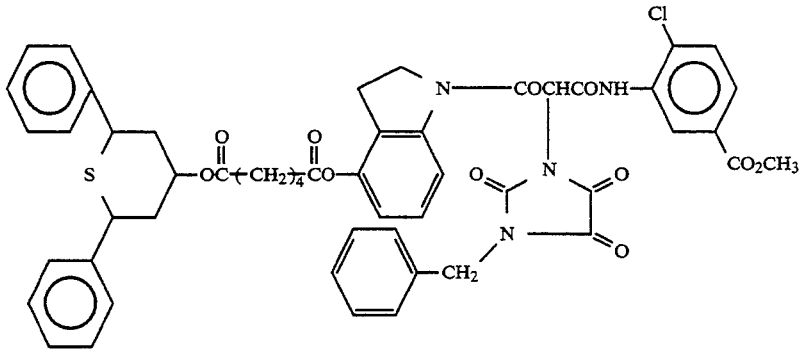
Y-30
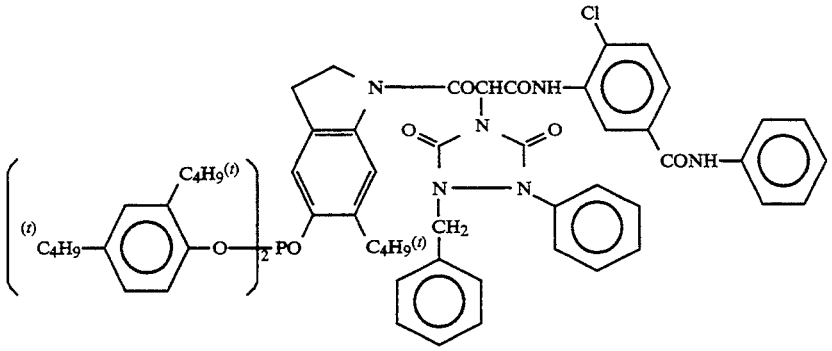
Y-31
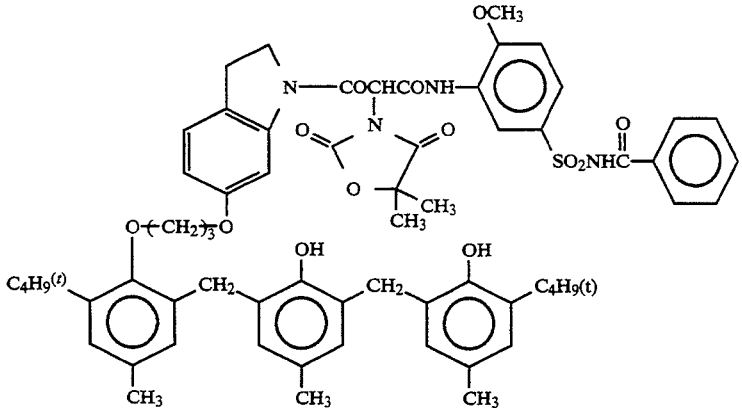
Y-32
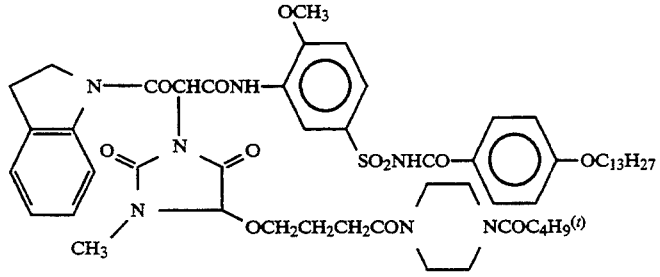

-continued
Y-33
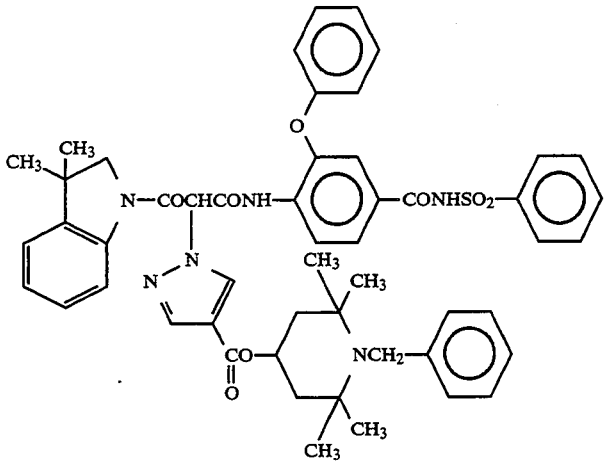
Y-34
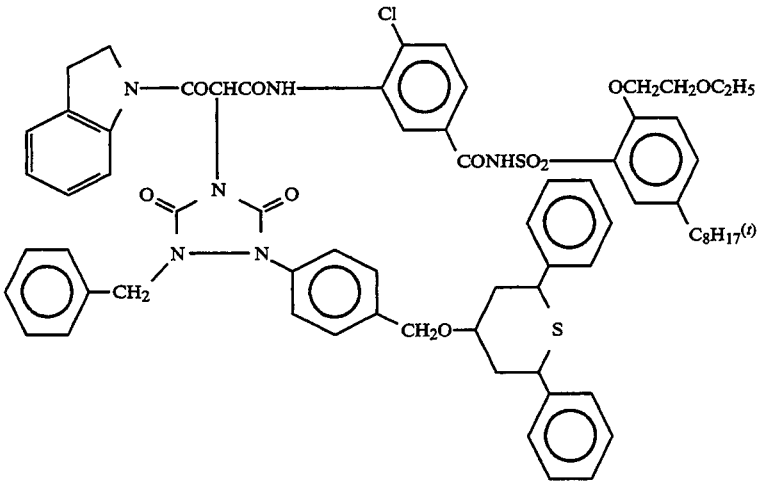
Y-35
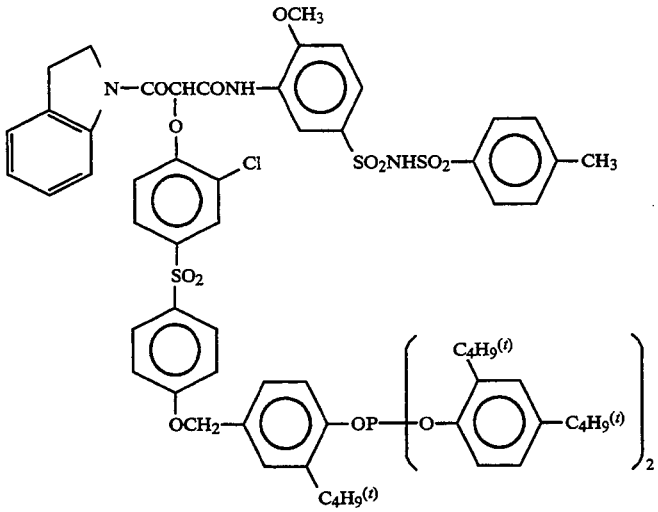

-continued
Y-36
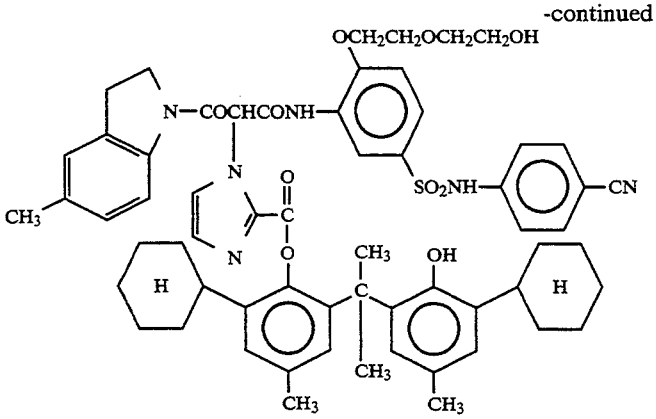
Y-37
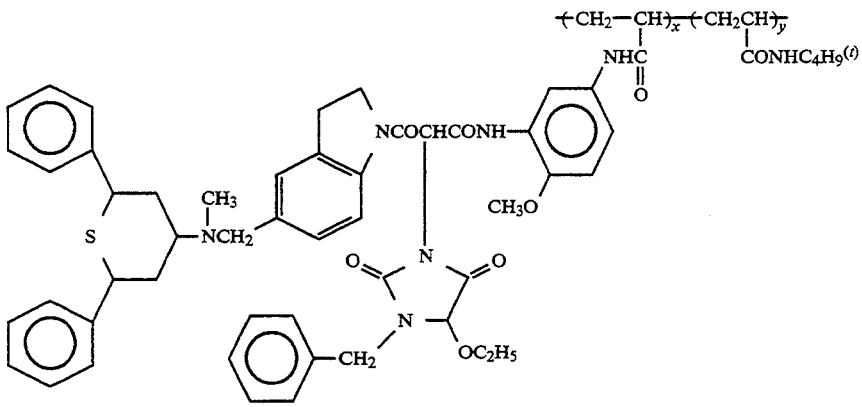
x:y = 50:50 (weight ratio)
Number average molecular weight: 50,000
Y-38
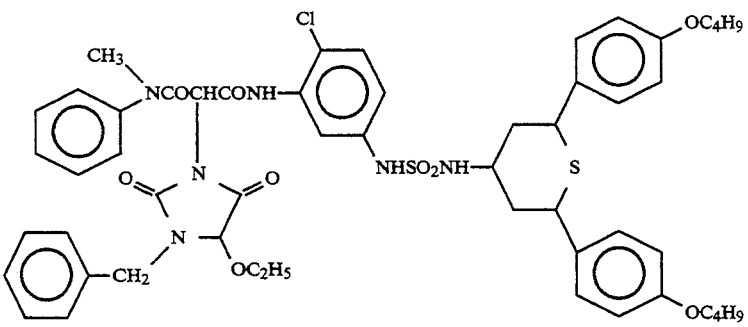
Y-39
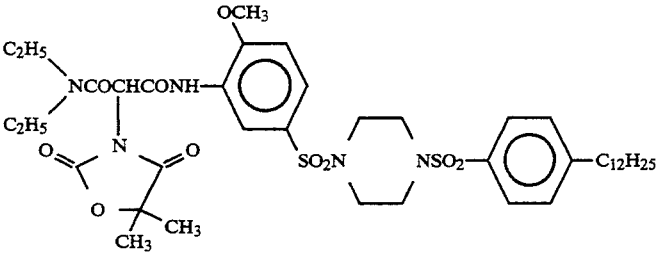
Y-40
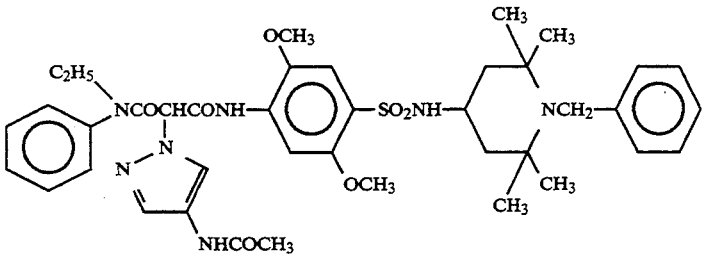

-continued
Y-41
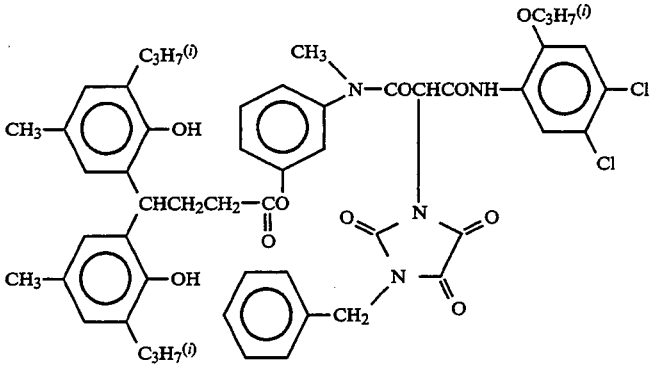
Y-42
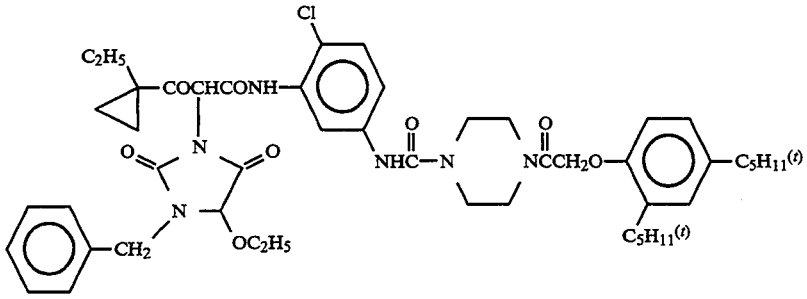
Y-43
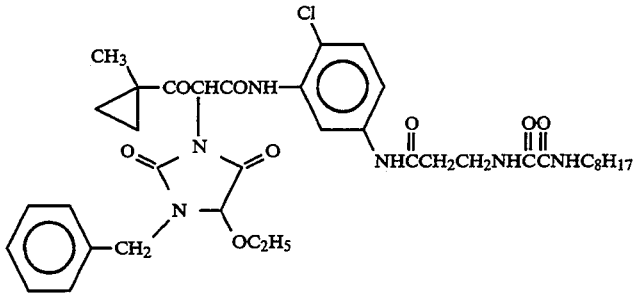
Y-44
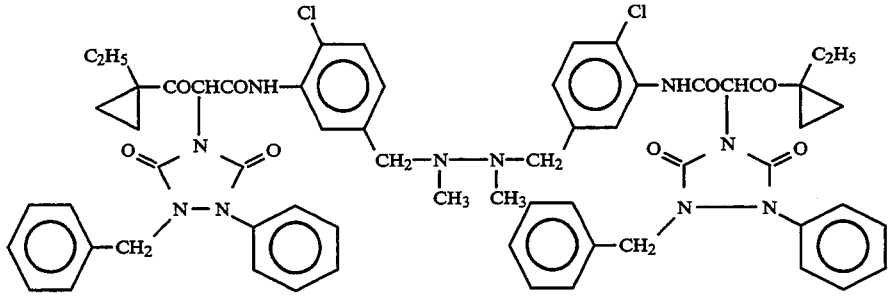
Y-45
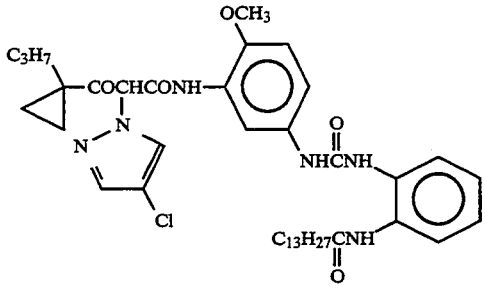

-continued
Y-46
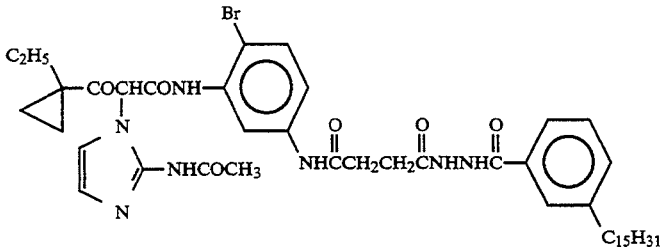
Y-47
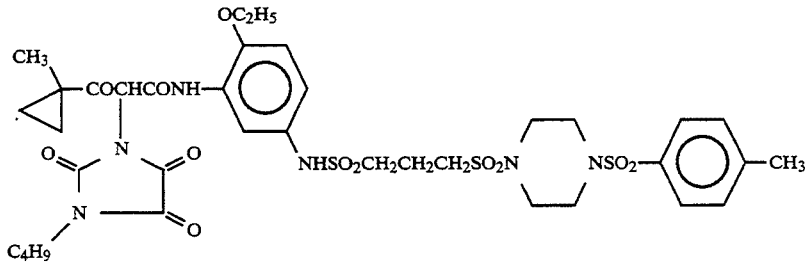
Y-48
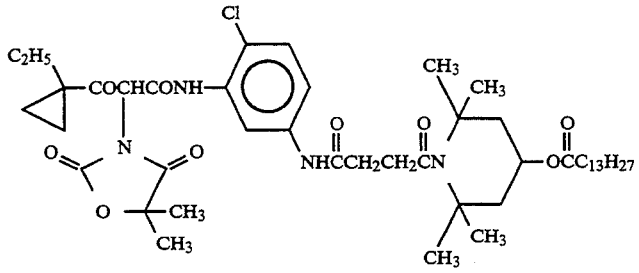
Y-49
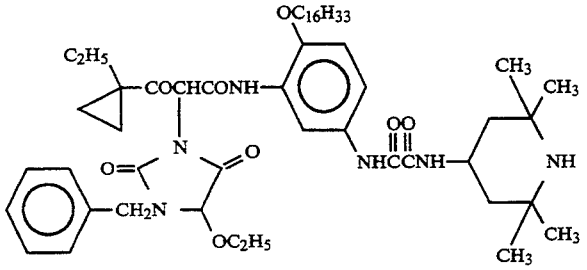
Y-50
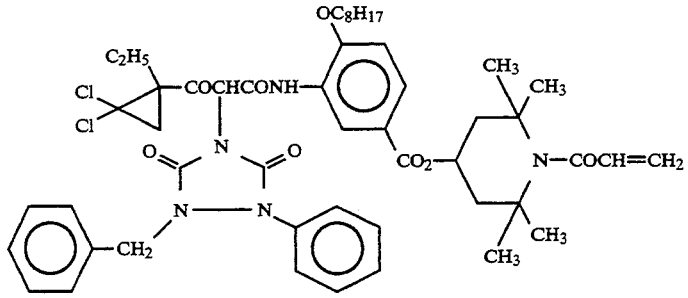
Y-51
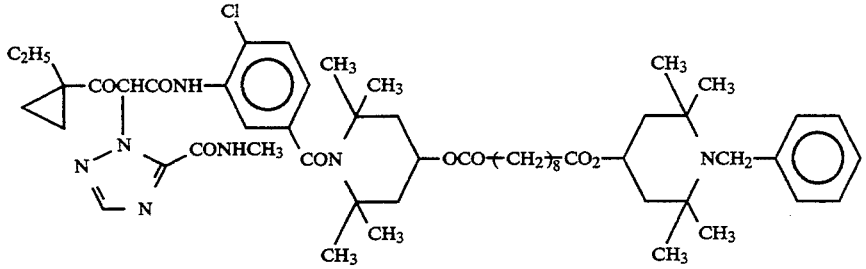

-continued
Y-52
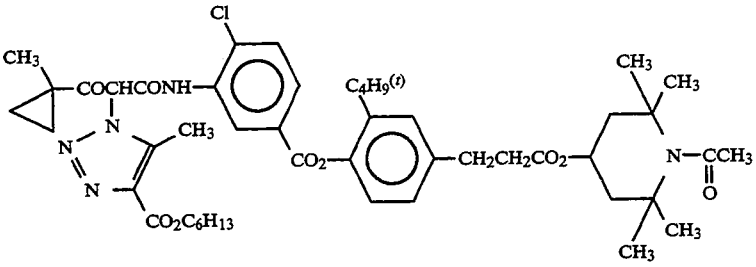
Y-53
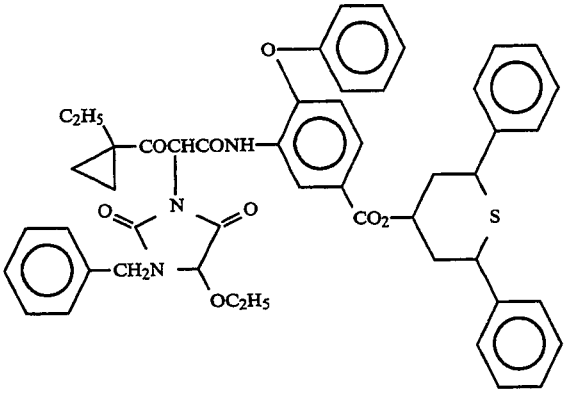
Y-54
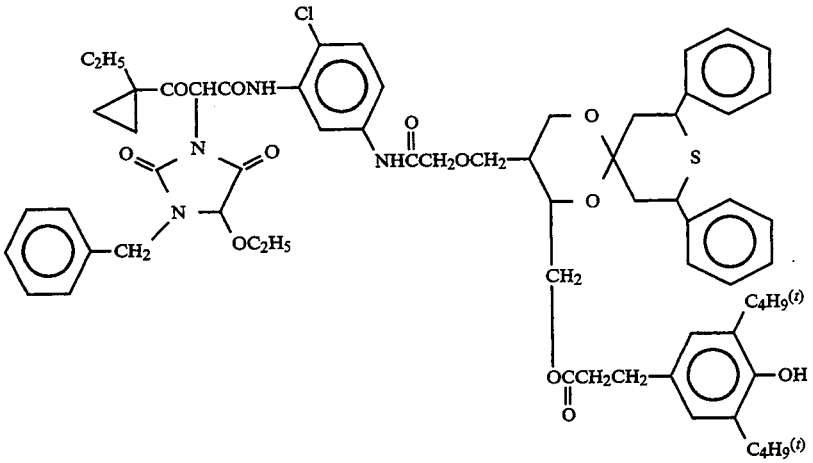
Y-55
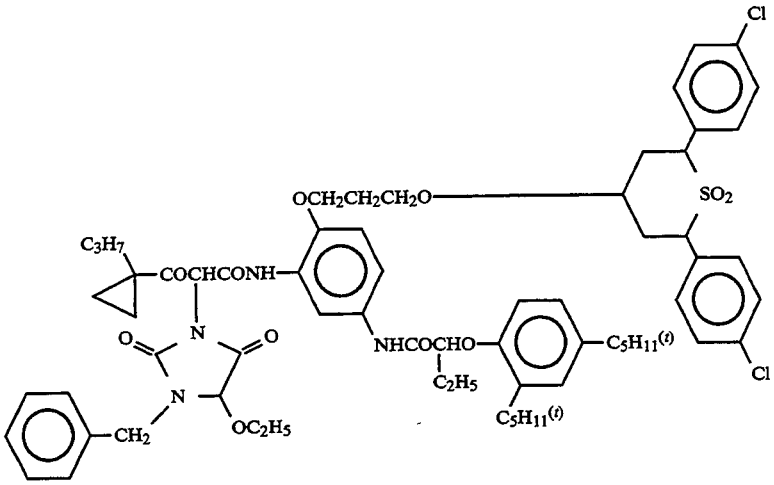

-continued
Y-56
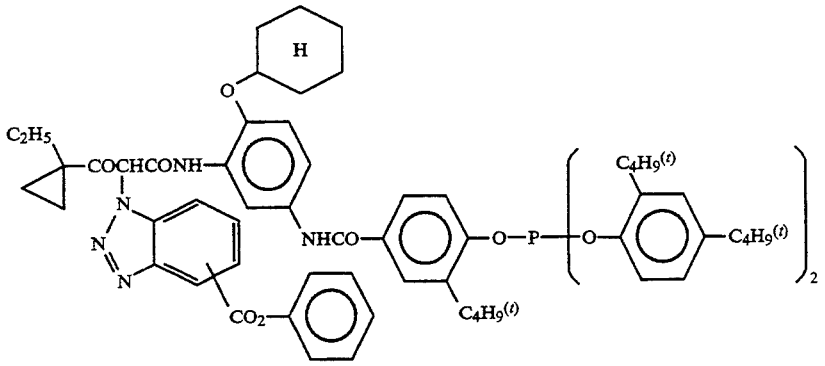
Y-57
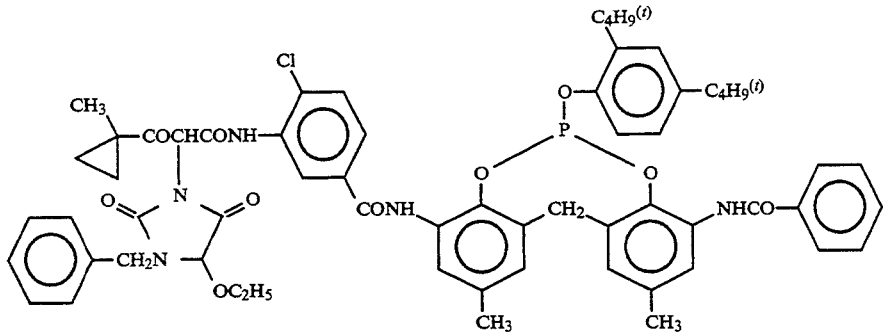
Y-58
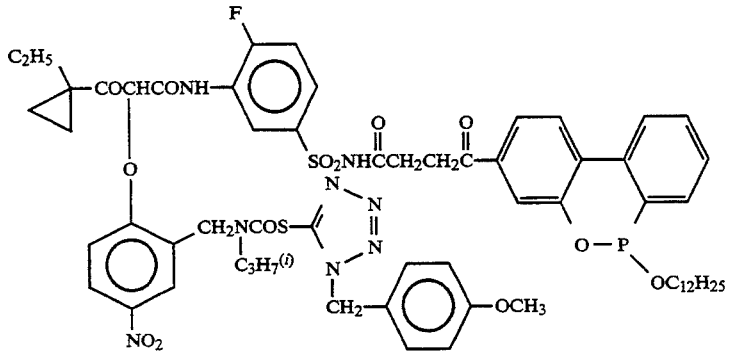
Y-59
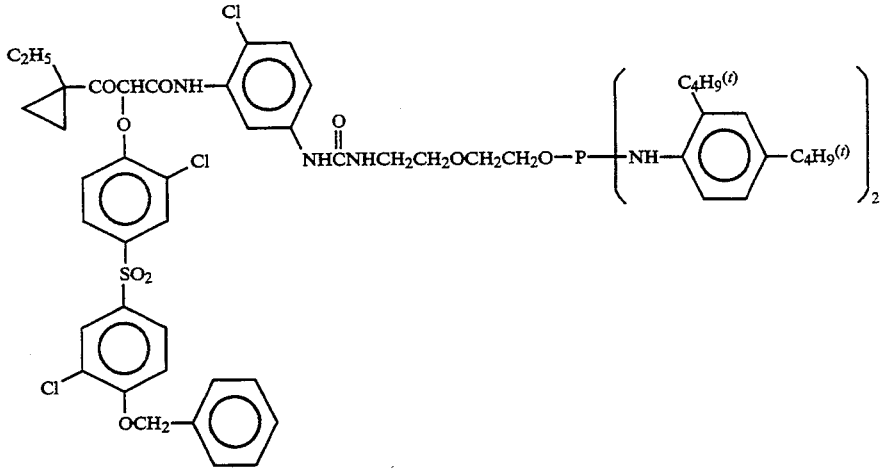

-continued
Y-60
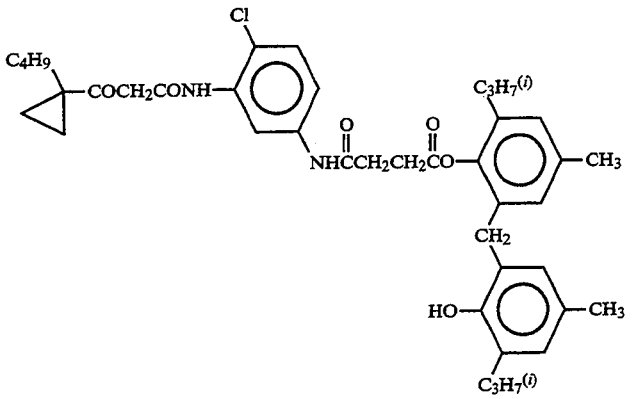
Y-61
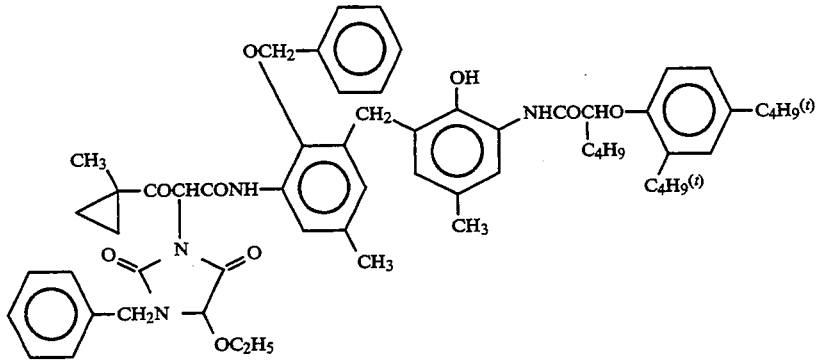
Y-62
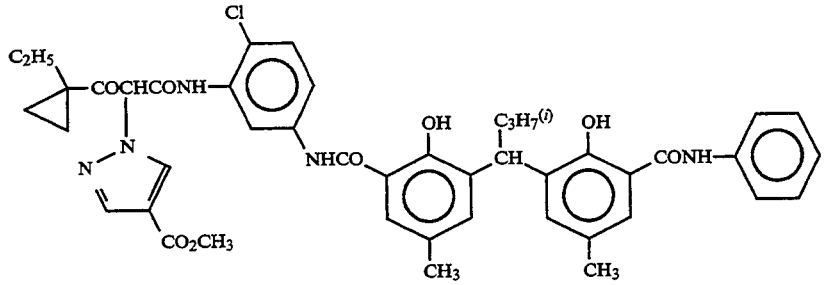
Y-63
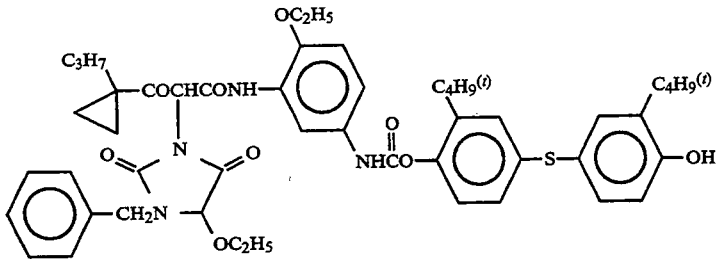

-continued
Y-64
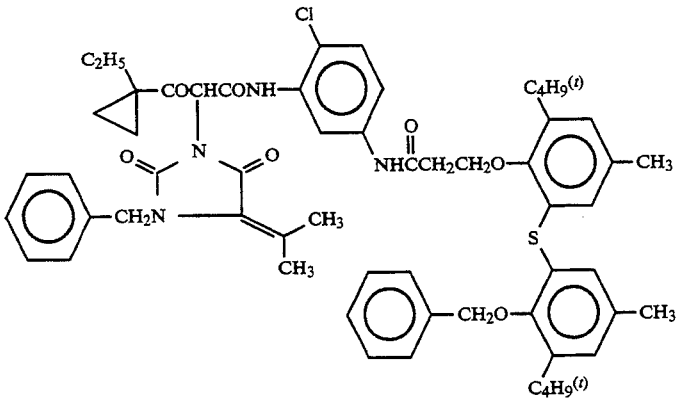
Y-65
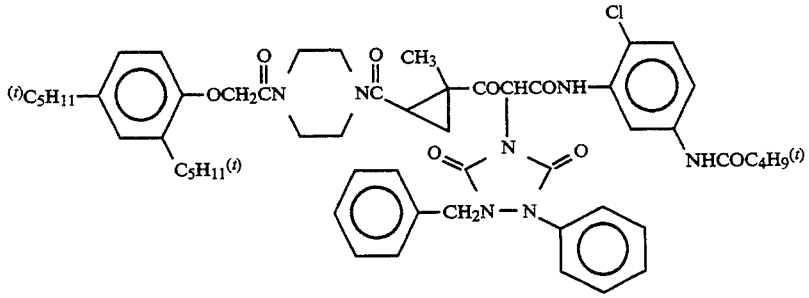
Y-66
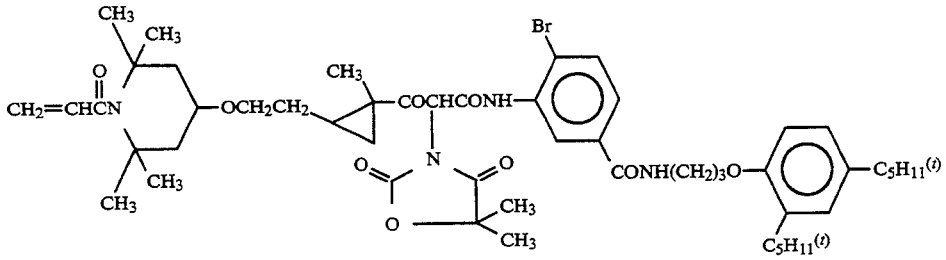
Y-67
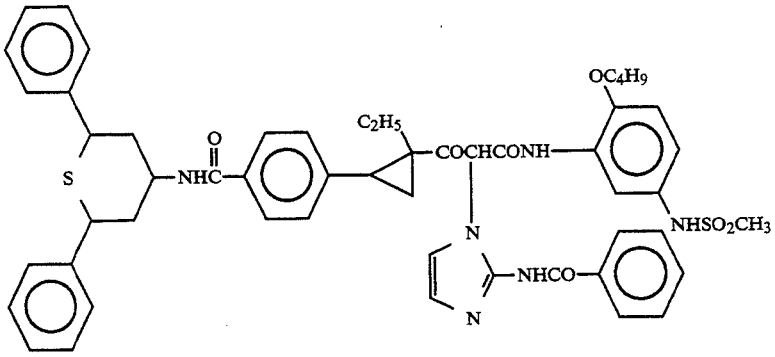
Y-68
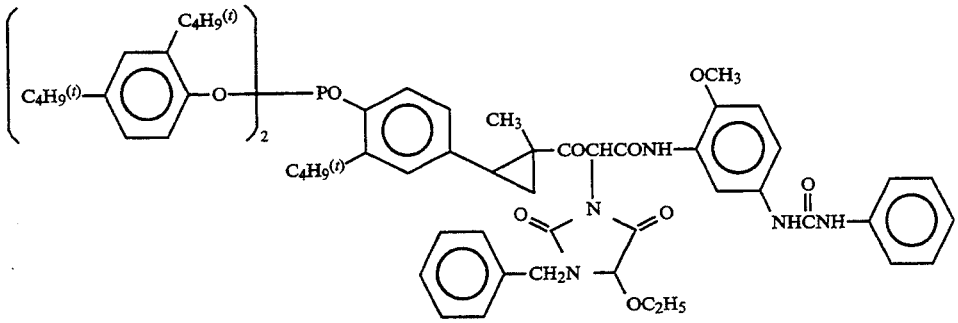

-continued
Y-69
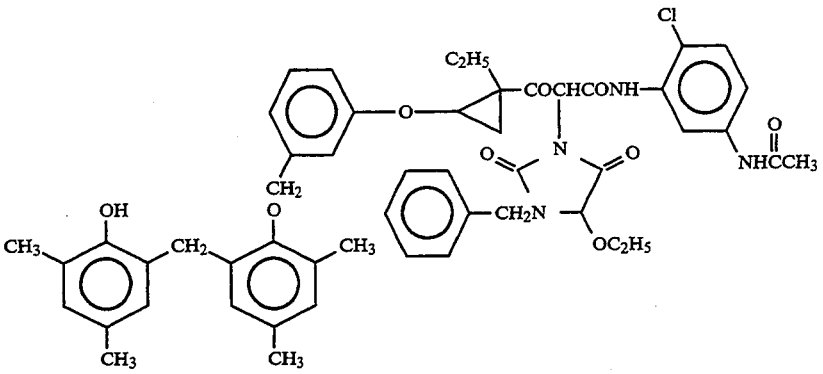
Y-70
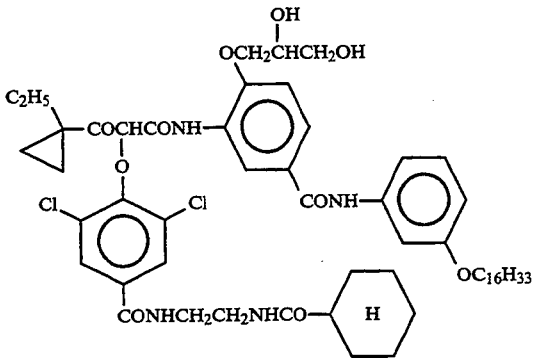
Y-71
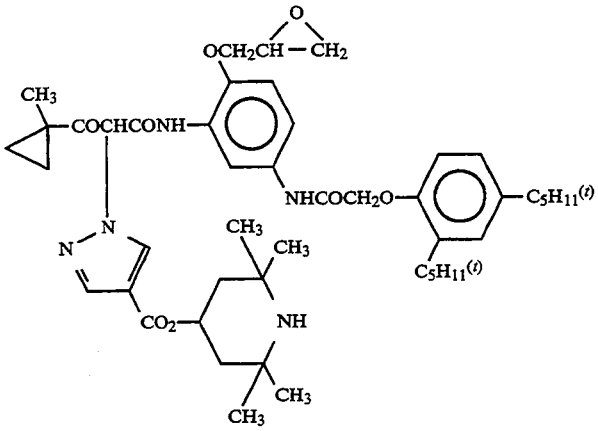
Y-72
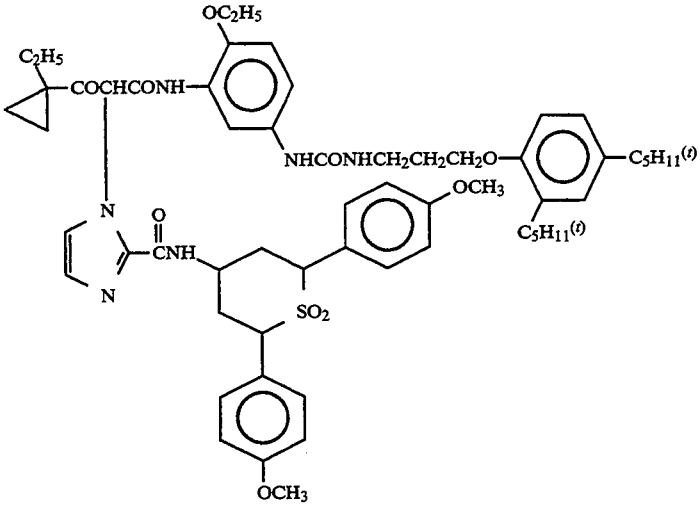

-continued
Y-73
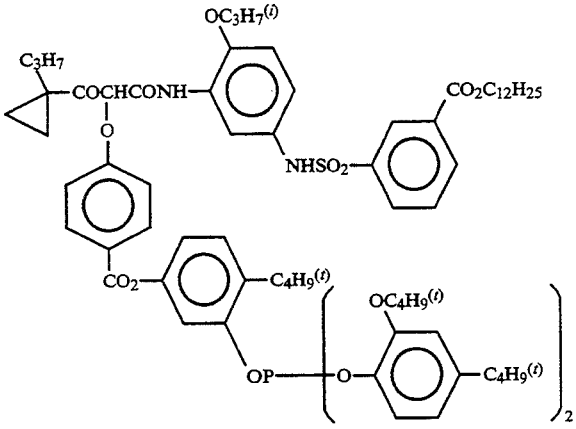
Y-74
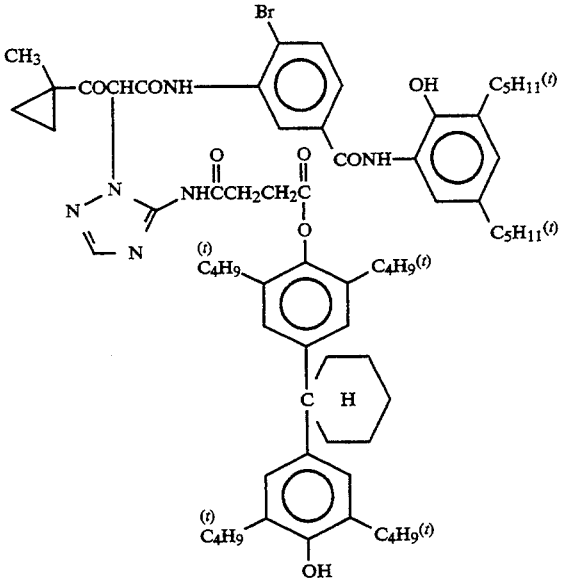
Y-75
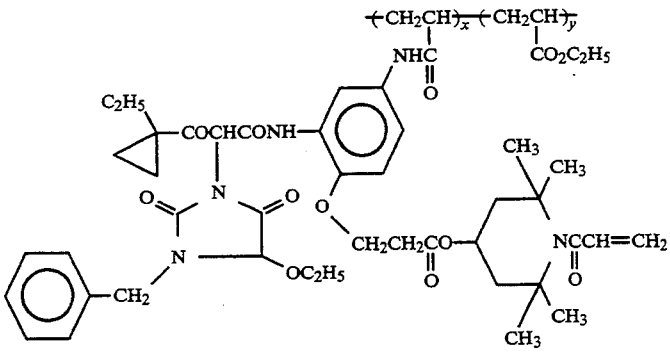
x:y = 50:50 (weight ratio)
Number average molecular weight: 45,000

-continued
Y-76
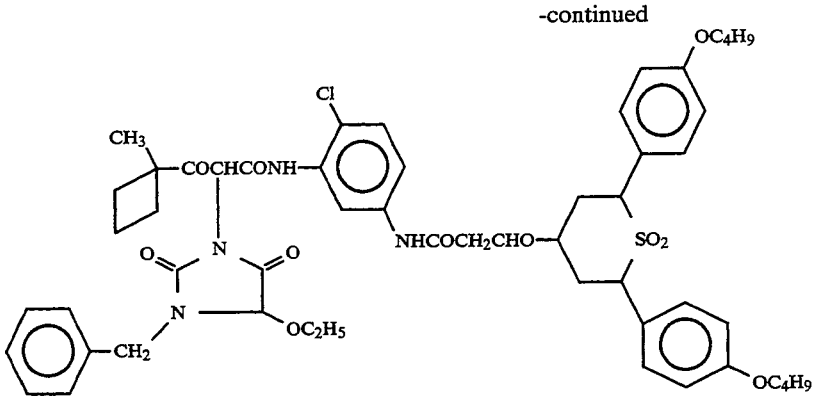
Y-77
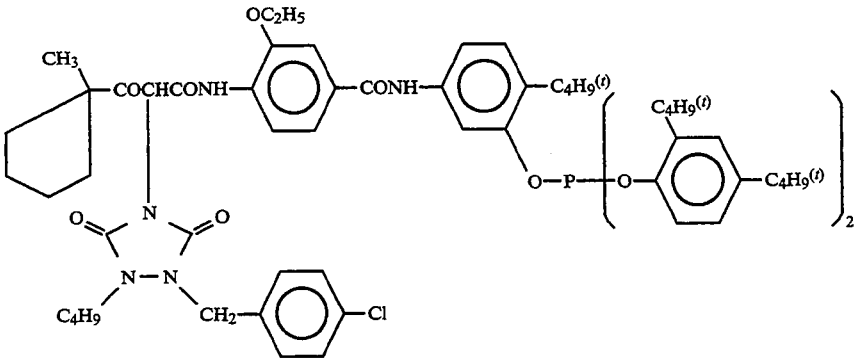
TABLE 1
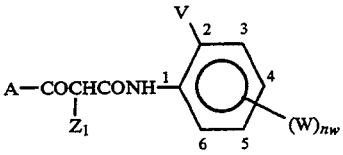
| | A | $Z_1$ | V | $n_w$ | W |
|---|---|---|---|---|---|
| Y-78 | 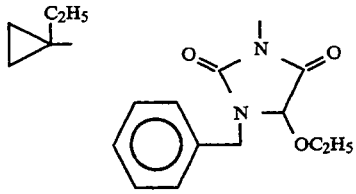 | | Cl | 1 | 5-NHCOCH(CH$_3$)CH$_2$P(=O)(OCH$_2$CH(C$_2$H$_5$)C$_4$H$_9$)$_2$ |
| Y-79 | " | " | " | " | 5-NHCOCH$_2$CH$_2$P(=O)(O-C$_6$H$_4$-C$_4$H$_9$(t))$_2$ |
| Y-80 | " | " | " | " | 5-NHCOCH(C$_2$H$_5$)-P(=O)(OCH$_2$CH(C$_2$H$_5$)C$_4$H$_9$)$_2$ |
| Y-81 | " | " | " | " | 5-NHCOCH$_2$P(=O)(OCH$_2$CH$_2$CH(CH$_3$)CH$_2$C(CH$_3$)$_3$)$_2$ |
| Y-82 | " | " | " | " | 5-NHCOCH(CH$_3$)CH$_2$P(=O)(OCH$_2$CH$_2$CH(CH$_3$)CH$_2$C(CH$_3$)$_3$)$_2$ |
| Y-83 | " | " | " | " | 5-NHCOCH(CH$_3$)O-P(=O)(OCH$_2$CH(C$_2$H$_5$)C$_4$H$_9$)$_2$ |

TABLE 1-continued
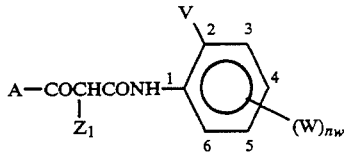
| | A | $Z_1$ | V | $n_w$ | W |
|---|---|---|---|---|---|
| Y-84 | " | " | " | " | 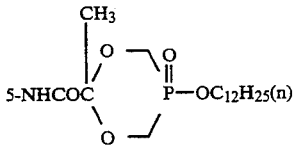 |
TABLE 2
| | A | $Z_1$ | V | $n_w$ | W |
|---|---|---|---|---|---|
| Y-85 | 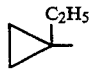 | 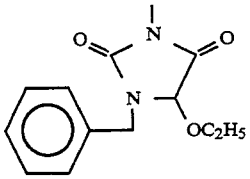 | Cl | 1 | 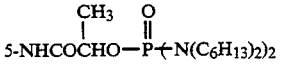 |
| Y-86 | 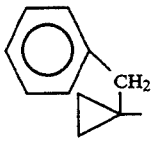 | " | " | " | 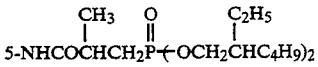 |
| Y-87 | " | " | " | " | 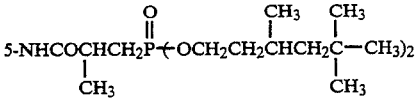 |
| Y-88 | " | " | " | " | 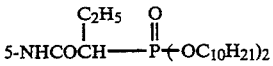 |
| Y-89 | " | " | " | " | 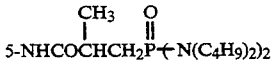 |
| Y-90 | " | " | " | " | 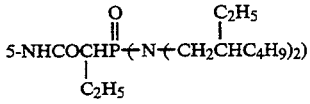 |
| Y-91 | " | " | " | " | 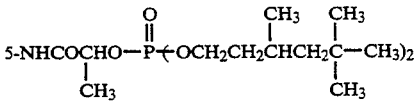 |
TABLE 3
| | A | $Z_1$ | V | $n_w$ | W |
|---|---|---|---|---|---|
| Y-92 | 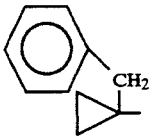 | 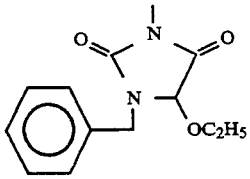 | Cl | 1 | 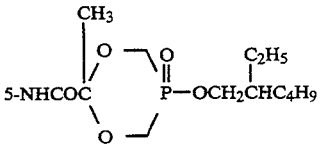 |

TABLE 3-continued

| | A | $Z_1$ | V | $n_w$ | W |
|---|---|---|---|---|---|
| Y-93 | " | " | " | " | $5\text{-}NHCO\underset{\underset{CH_3}{\mid}}{C}HCH_2CH_2\overset{\overset{O}{\parallel}}{P}(OCH_2\underset{\underset{C_2H_5}{\mid}}{C}HC_4H_9)_2$ |
| Y-94 | " | " | " | " | 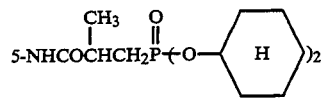 |
| Y-95 | " | 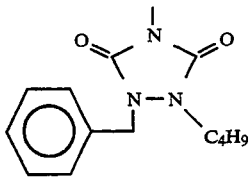 | " | " | $5\text{-}NHCO\underset{\underset{CH_3}{\mid}}{C}HCH_2\overset{\overset{O}{\parallel}}{P}(OCH_2CH_2\underset{\underset{CH_3}{\mid}}{C}HCH_2\underset{\underset{CH_3}{\mid}}{\overset{\overset{CH_3}{\mid}}{C}}-CH_3)_2$ |
| Y-96 | " | 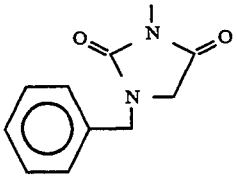 | " | " | 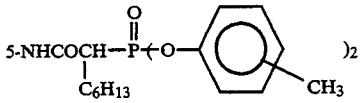 |
| Y-97 | " | 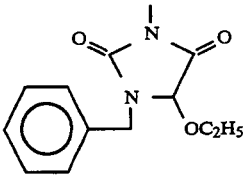 | " | " | 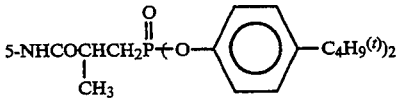 |
| Y-98 | " | " | " | " | $5\text{-}CONHCH_2CH_2O\overset{\overset{O}{\parallel}}{P}(C_{10}H_{21})_2$ |

TABLE 4
| | A | $Z_1$ | V | $n_w$ | W |
|---|---|---|---|---|---|
| Y-99 | 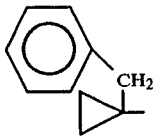 | 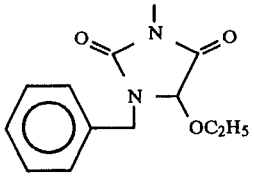 | Cl | 1 | $5\text{-}COOCH_2CH_2P(=O)(OC_8H_{17})_2$ |
| Y-100 | " | " | $-O(CH_2)_3P(=O)(OCH_2CH(C_2H_5)C_4H_9)_2$ | 1 | 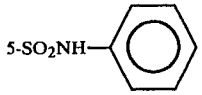 |
| Y-101 | " | " | $-OP(=O)(OCH_2CH_2CH(CH_3)CH_2C(CH_3)_3)_2$ | 1 | $5\text{-}SO_2NHC_4H_9$ |
| Y-102 | 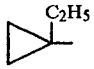 | 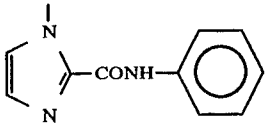 | Cl | 1 | $5\text{-}NHCOCH(C_2H_5)-P(=O)(OC_6H_{13})_2$ |
| Y-103 | 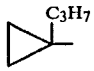 | 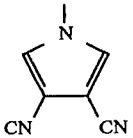 | " | " | 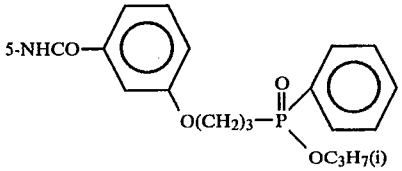 |
| Y-104 | 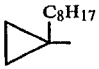 | 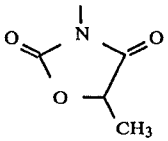 | " | " | $5\text{-}NHCO(CH_2)_3P(=O)(OC_6H_{13})_2$ |

TABLE 4-continued
| | A | $Z_1$ | V | $n_w$ | W |
|---|---|---|---|---|---|
| Y-105 | 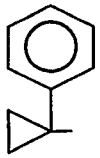 | 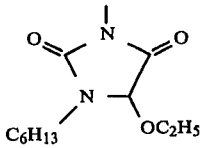 | " | 2 | 4-Cl-5-COO$(CH_2)_3$P(=O)$(OC_8H_{17})_2$ |

TABLE 5

| | A | $Z_1$ | V | $n_w$ | W |
|---|---|---|---|---|---|
| Y-106 | 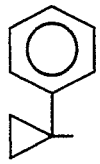 | 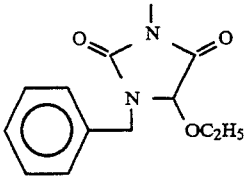 | $OCH_3$ | 1 | 5-NHCO$(CH_2)_2$OP(=O)(OC$_8H_{17})_2$ |
| Y-107 | 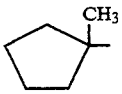 | " | Cl | 1 | 5-CONH$(CH_2)_3$—P(=O)(OC$H_2$CH($CH_3$)C$_4H_9)_2$ |
| Y-108 | 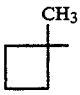 | " | Cl | 1 | 5-NHCOCH($CH_3$)$CH_2$—P(=O)(OC$H_2$CH($CH_3$)C$_4H_9$) |
| Y-109 | 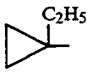 | " | 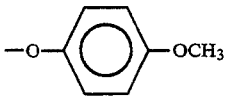 | 1 | 5-$SO_2$NH$(CH_2)_3$—P(=O)(OC$_6H_{13})_2$ |
| Y-110 | 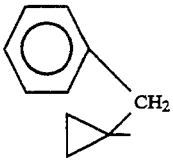 | " | Cl | 2 | 4-Cl-5-NHCO$(CH_2)_2$—P(=O)(OC$H_2$CH($CH_3$)C$_4H_9)_2$ |
| Y-111 | " | " | Cl | 1 | 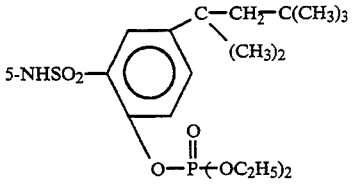 |

TABLE 6

| No. | A | $Z_1$ | V | $n_w$ | W |
|---|---|---|---|---|---|
| Y-112 | 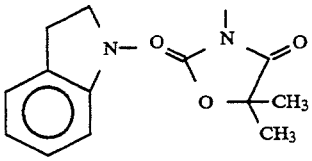 | | —$OCH_2CH_2OCOCH$($C_2H_5$)—P(=O)($C_2H_5$)(OC$H_2$CH($C_2H_5$)C$_4H_9)_2$ | 1 | 5-$SO_2$NHCONH$C_2H_5$ |
| Y-113 | " | " | —$OCH_2CH_2OCOCH$($CH_3$)$CH_2$P(=O)($C_2H_5$)(OC$H_2$CH($C_2H_5$)C$_4H_9)_2$ | 1 | 5-$SO_2$NHCONH$CH_2$CH($C_2H_5$)$CH_2CH_3$ |
| Y-114 | " | " | —$OCH_2CH_2CH_2$P(=O)(OC$H_2CH_2$CH($CH_3$)$CH_2$C($CH_3$)($CH_3$)—$CH_3)_2$ | 1 | " |
| Y-115 | " | " | —$OCH_2CH_2$OP(=O)(OC$H_2CH_2$CH($CH_3$)$CH_2$C($CH_3$)($CH_3$)—$CH_3)_2$ | 1 | " |
| Y-116 | " | " | Cl | 1 | 5-NHCOCH($C_2H_5$)—P(=O)($C_2H_5$)(OC$H_2$CH($C_2H_5$)C$_4H_9)_2$ |

TABLE 6-continued
| No. | A | $Z_1$ | V | $n_w$ | W |
|---|---|---|---|---|---|
| Y-117 | " | 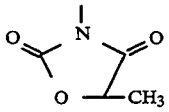 | " | 1 | " |
TABLE 7
| No. | A | $Z_1$ | V |
|---|---|---|---|
| Y-118 | 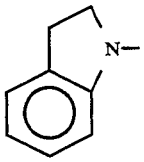 | 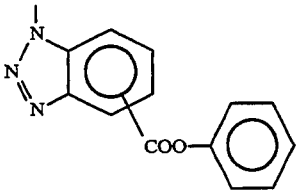 | Cl |
| Y-119 | " | 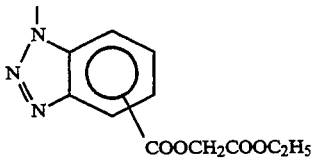 | Cl |
| Y-120 | " | 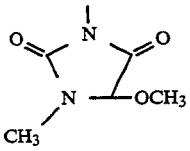 | $-OCH_2CH_2CH_2P(=O)(OCH_2CH(CH_3)C_4H_9)_2$ |
| Y-121 | " | 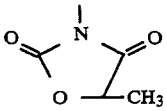 | $-OCH(CH_3)COO(CH_2)_3P(=O)(OC_6H_{13})_2$ |
| Y-122 | 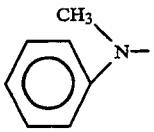 | " | Cl |
| Y-123 | 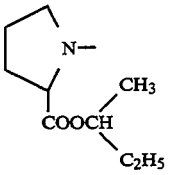 | " | " |
| No. | $n_w$ | W |
|---|---|---|
| Y-118 | 1 | $5\text{-}SO_2NHCO(CH_3)CHCH_2P(=O)(OC_8H_{17})_2$ |
| Y-119 | 1 | $5\text{-}SO_2NHCONHCH_2CH_2P(=O)(OC_6H_{13})_2$ |

TABLE 7-continued
| | | |
|---|---|---|
| Y-120 | 1 | 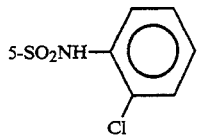 |
| Y-121 | 1 | 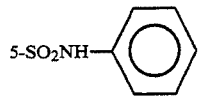 |
| Y-122 | 1 | 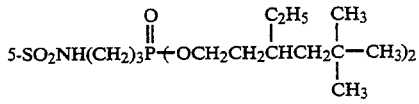 |
| Y-123 | 1 | 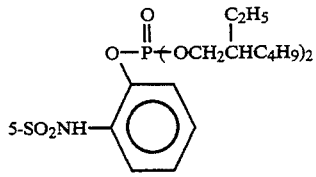 |
TABLE 8
| No. | A | $Z_1$ | V |
|---|---|---|---|
| Y-124 | 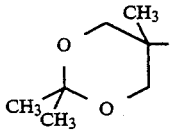 | 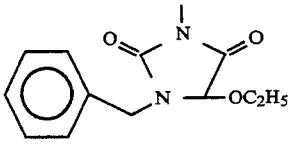 | Cl |
| Y-125 | 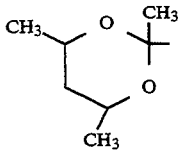 | " | Cl |
| Y-126 | 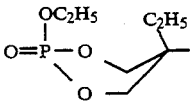 | " | Cl |
| Y-127 | 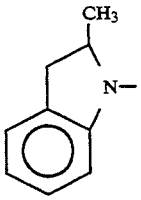 | 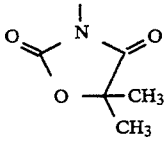 | 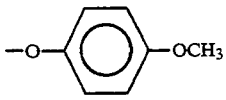 |
| Y-128 | 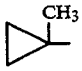 | 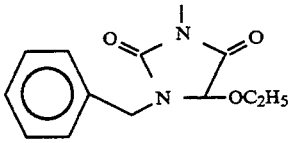 | Cl |
| No. | $n_w$ | W |
|---|---|---|
| Y-124 | 1 | 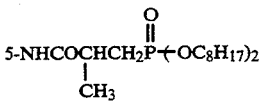 |

TABLE 8-continued

| | | |
|---|---|---|
| Y-125 | 1 | 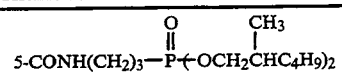 |
| Y-126 | 1 | 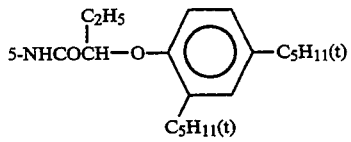 |
| Y-127 | 1 | 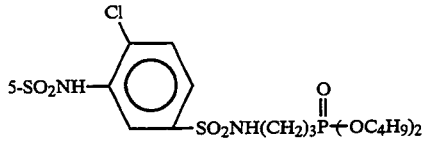 |
| Y-128 | 1 | 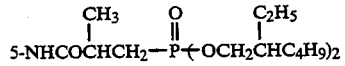 |

The yellow coupler of the present invention represented by Formula (I) can readily be synthesized by the publicly known methods.

Synthetic examples will be shown below, and the other compounds not specifically set forth can be synthesized in a similar manner.

SYNTHETIC EXAMPLE 1

Synthesis of the Exemplified Coupler Y-6

α-(Indolynylcarbonyl) acetic acid (22.6 g) (0.11 mole), and 2-ethoxy-5-[N-(1-tetradecanoyl-2,2,6,6-tetramethyl-4-piperidyl) sulfamoyl] aniline (56.5 g) (0.1 mole) were dissolved in ethyl acetate (200 ml) and dimethylacetamide (100 ml), and an acetonitrile solution (50 ml) of dicyclohexylcarbodiimide (33 g) (0.16 mole) was dropped at 20° to 30° C. while stirring. After reacting at 20° to 30° C., deposited dicyclohexyl urea was filtered off. Water was added to the filtrate, and the solution was extracted with ethyl acetate, followed by washing an organic phase with water. This organic phase was dried on magnesium sulfate anhydrous, and then ethyl acetate was distilled off under reduced pressure, whereby an oily product was obtained.

This oily product was dissolved in dichloromethane (300 ml), and the solution was cooled down to 10° to 15° C., followed by dropping sulfuryl chloride (11.4 g) (0.084 mole) while stirring. After reacting for 40 minutes, a 5% sodium bicarbonate aqueous solution (200 g) was dropped. An organic phase was washed with water and dried on magnesium sulfate anhydrous, followed by distilling the solvent off under a reduced pressure, whereby an oily product was obtained.

This oily product was dissolved in acetonitrile (200 ml) and 5,5-dimethyloxazolidine-2,4-dione (28.4 g) (0.22 mole) and triethylamine (22.2 g) (0.22 mole) were added while stirring. After reacting at 40° to 50° C. for 4 hours, the solution was poured into water (300 ml), and an oily deposit was extracted with ethyl acetate (300 ml). This extract was washed with a 5% sodium hydroxide aqueous solution (200 ml) and further washed with water (300 ml). The extract was acidified with diluted hydrochloric acid and then washed with water, followed by subjecting the extract to distillation under reduced pressure, whereby an oily product was obtained.

This oily product was refined with a silica gel column chromatography to obtain the desired compound (40.3 g). The constitution of the compound was confirmed with an MS spectrum, an NMR spectrum and an elemental analysis.

SYNTHETIC EXAMPLE 2

Synthesis of the Exemplified Coupler Y-53

α-(1-Ethylcyclopropanecarbonyl) acetic acid (17.2 g) (0.11 mole), and 5-(2,6-diphenylthiane-4-yloxycarbonyl)-2-phenoxyaniline (42.5 g) (0.1 mole) were dissolved in ethyl acetate 200 ml and dimethylacetamide (100 ml), and an acetonitrile solution (50 ml) of dicyclohexylcarbodiimide (33 g) (0.16 mole) was dropped at 20° to 30° C. while stirring. After reacting at the same temperature for 3 hours, deposited dicyclohexyl urea was filtered off. Water was added to the filtrate, and the solution was extracted with ethyl acetate, followed by washing this extract with water. The extract was dried on magnesium sulfate anhydrous, and then the solvent was distilled off under reduced pressure, whereby an oily product was obtained.

This oily product was dissolved in dichloromethane (300 ml) and sulfuryl chloride (11.4 g) (0.084 mole) was dropped while cooling with ice. After reacting for 30 minutes, the reaction solution was washed with water and dried on magnesium sulfate anhydrous, followed by distilling the solvent off under a reduced pressure, whereby an oily product was obtained. This oily product was dissolved in N,N-dimethylformamide (150 ml), and this solution was dropped in the N,N-dimethylformamide solution (150 ml) of 1-benzyl-5-ethoxyhydantoin (51.5 g) (0.22 mole) and triethylamine (22.2 g) (0.22 mole) over a period of 30 minutes at room temperature.

After reacting at 40° C. for 4 hours, the solution was poured into water (300 ml), and an oily deposit was extracted with ethyl acetate (300 ml). This extract was washed with a 2% triethylamine aqueous solution (300 ml) and then neutralized with a diluted hydrochloric acid aqueous solution. An organic phase was washed with water and dried on magnesium sulfate, followed by distilling the solvent off under reduced pressure. The oily product thus obtained was refined with a silica gel column chromatography to obtain the desired compound (31.4 g). The constitution of the compound was confirmed with an MS spectrum, an NMR spectrum and an elemental analysis.

SYNTHETIC EXAMPLE 3

Synthesis of the Exemplified Coupler Y-78

The coupler was synthesized according to the following scheme:

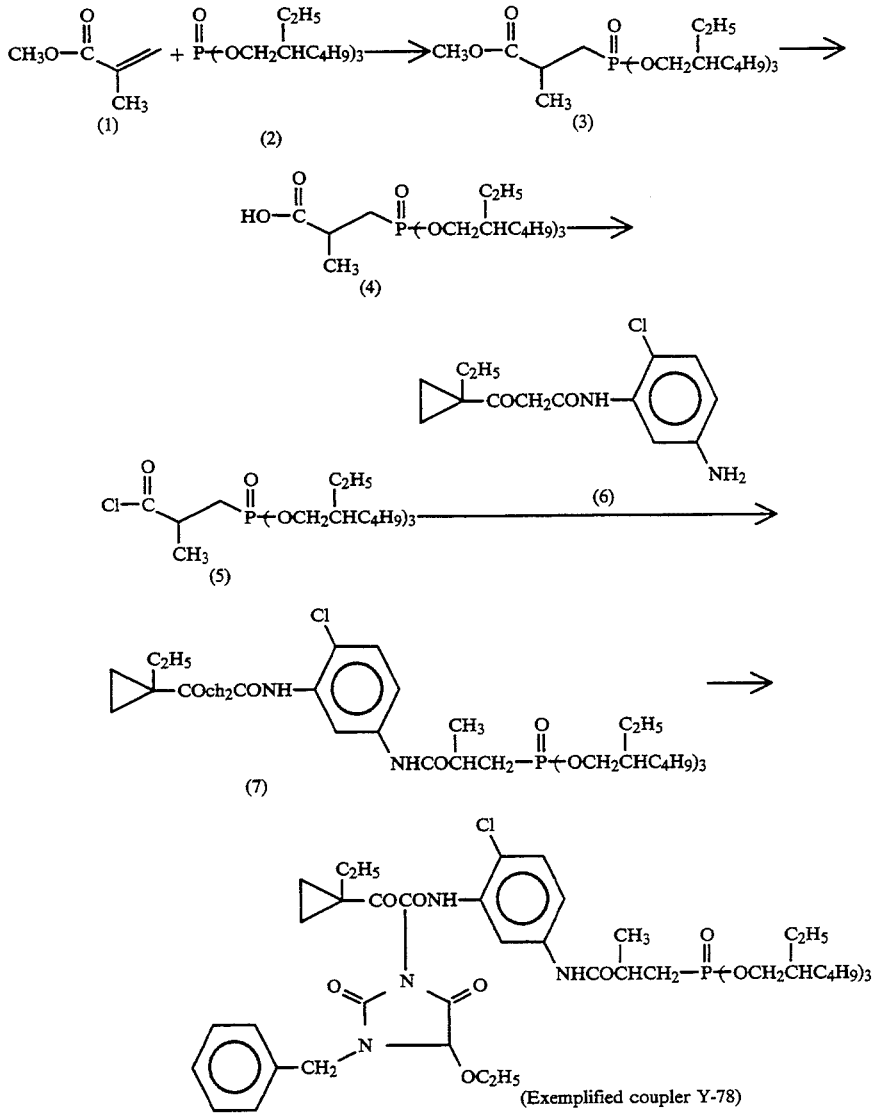

(Exemplified coupler Y-78)

Methyl methacrylate (1) (12 g), tris(2-ethylhexyl) phosphite (2) (50 g) and phenol (11.2 g) were mixed and reacted at 110° C. for 2 hours. The compound (3), which was obtained by distillation under reduced pressure, was processed with one equivalent potassium hydroxide to obtain the oily compound (4).

The compound (4) was chlorinated with oxalyl chloride in dichloromethane to obtain a corresponding acid chloride [compound (5)] and then was reacted with compound (6) under the presence of triethylamine in acetonitrile. The reactant was subjected to an after treatment in a normal manner and then to a refining with a column chromatography, whereby the oily compound (7) was obtained.

Compound (7) was chlorinated with sulfuryl chloride in dichloromethane and then the reaction liquid was subjected to distillation under reduced pressure to obtain an oily product. Each two equivalences of triethylamine and 5-ethoxy-1-benzylhydantoin were added thereto, and then dimethylformamide was further added as a solvent, followed by reacting at 80° C. for 3 hours. The reactant was subjected to a normal after treatment and then to refining with a column chromatography, whereby the desired exemplified coupler Y-78 was obtained.

The yellow coupler of the present invention is added preferably to a light-sensitive silver halide emulsion layer or the layer adjacent thereto in a light-sensitive material. More preferably, the yellow coupler is added to a light-sensitive silver halide emulsion layer, and particularly preferably to a blue-sensitive silver halide emulsion layer.

The standard amount used of the coupler represented by Formula (I) used in the present invention is from 0.001 to 1 mole, preferably 0.01 to 0.5 mole per mole of silver halide contained in the same layer.

The yellow dye-forming coupler represented by Formula (I) used in the present invention may be used in combination with a conventionally known coupler.

The light-sensitive material of the present invention has a hydrophilic colloid layer containing the coupler of the present invention. Preferred as the hydrophilic colloid layer is a yellow color-developing silver halide emulsion layer or the layer adjacent thereto. The light-sensitive material preferably has silver halide emulsion layers each having yellow color developability, a magenta color developability and a cyan color developability and they are preferably blue-sensitive, green-sensitive and red-sensitive, respectively. The light-sensitive material of the present invention can be formed by coating the layers in this order, but the order may be different from this. An infrared-sensitive silver halide emulsion layer can be used in place of at least one of the above light-sensitive emulsion layers.

The yellow couplers of the present invention can be incorporated into a light-sensitive material by various conventional dispersion methods. Preferred is an oil-in-water dispersion method in which the couplers are dissolved in a high boiling solvent (a low boiling solvent can be used in combination according to necessity) and are emulsified and dispersed in a gelatin aqueous solution to be added to a silver halide emulsion.

Examples of the high boiling solvent used in the oil-in-water dispersion method are described in U.S. Pat. No. 2,322,027.

The steps and effect of latex dispersing methods as one of the polymer dispersing methods, and concrete examples of a latex for impregnation are described in U.S. Pat. No. 4,199,363, German Patent Applications (OLS) 2,541,274 and 2,541,230, JP-B-53-41091, and European Patent Publication 029104. Further, a dispersion method using an organic solvent-soluble polymer is described in PCT International Patent Publication W088/00723.

Examples of the high boiling organic solvent which can be used in the above oil-in-water dispersion method include phthalic acid esters (for example, dibutyl phthalate, dioctyl phthalate, dicyclohexyl phthalate, di-2-ethylhexyl phthalate, decyl phthalate, bis(2,4-di-tert-amylphenyl) isophthalate, and bis(1,1-di-ethylpropyl) phthalate), phosphoric acid or phosphonic acid esters (for example, diphenyl phosphate, triphenyl phosphate, tricresyl phosphate, 2-ethylhexyl-diphenyl phosphate, dioctylbutyl phosphate, tricyclohexyl phosphate, tri-2-ethylhexyl phosphate, tridodecyl phosphate, and di-2-ethylhexylphenyl phosphate), benzoic acid esters (for example, 2-ethylhexyl benzoate, 2,4-dichlorobenzoate, dodecyl benzoate, and 2-ethylhexyl p-hydroxybenzoate), amides (for example, N,N-diethyl dodecanamide and N,N-diethyl laurylamide), alcohols or phenols (for example, isostearyl alcohol and 2,4-di-tert-amylphenol), aliphatic esters (for example, dibutoxyethyl succinate, di-2-ethylhexyl succinate, 2-hexyldecyl tetradecanate, tributyl citrate, diethyl azelate, isostearyl lactate, and trioctyl citrate), aniline derivatives (for example, N,N-dibutyl-2-butoxy-5-tert-octylaniline), chlorinated paraffins (for example, paraffins in which 10 to 80% of the hydrogen atoms are replaced with chlorine atoms), trimesic acid esters (for example, tributyl trimesate), dodecylbenzene, diisopropylnaphthalene, phenols (for example, 2,4-di-tertamylphenol, 4-dodecylphenol, 4-dodecyloxycarbonylphenol, and 4-(4-dodecyloxyphenylsulfonyl) phenol), carboxylic acids (for example, 2-(2,4-di-tert-amylphenoxy) butyric acid, and 2-ethoxyoctanedecanoic acid), and alkylphosphoric acids (for example, di-2(ethylhexyl) phosphoric acid and diphenylphosphoric acid). Further, there may be used in combination as an auxiliary solvent, an organic solvent having the boiling point of 30° C. or higher and about 160° C. or lower (for example, ethyl acetate, butyl acetate, ethyl propionate, methyl ethyl ketone, cyclohexanone, 2-ethoxyethyl acetate, and dimethylformamide).

The high boiling organic solvents can be used in an amount of 0 to 2.0 times, preferably in an amount of 0 to 1.0 times of a coupler by weight.

The following patent publications, particularly European Patent EP 0,355,660A2 describe materials preferably used as the silver halide emulsions, other materials (the additives) and photographic layer arrangement in the present invention, and further describe processing methods and additives for processing, which are applied for processing the light-sensitive material:

TABLES 9 to 13

| Photographic constituent layer | JP-A-62-215272 | JP-A-2-33144 | EP0,355,660A2 |
|---|---|---|---|
| Silver halide emulsion | The 6th line of right upper column of page 10 to the 5th line of left lower column of page 12; and the 4th line from the bottom of right lower column of page 12 to the 17th line of left upper column of page 13 | The 16th line of right upper column of page 28 to the 11th line of right lower column of page 29; and the 2nd line to the 5th line of page 30 | The 53th line of page 45 to the 3rd line of page 47; and the 20th line to the 22nd line of page 47 |
| Solvents for silver halide | The 6th line to the 14th line of left lower column of page 12; and the third line from the bottom of left upper column of page 13 to the bottom of left lower column of page 18 | — | — |
| Chemical sensitizing agent | The 3rd line from the bottom of left lower column of page 12 to the 5th line from the bottom of page 12; and the first line of right lower column of page 18 to the 9th line from the bottom of right upper column of page 22 | The 12th line to the bottom of right lower column of page 29 | The 4th line to the 9th line of page 47 |
| Spectral sensitizing | The 8th line from the bottom of right upper | The first line to the 13th line of left upper column | The 10th line to the 15th line of page 47 |

TABLES 9 to 13-continued

| Photographic constituent layer | JP-A-62-215272 | JP-A-2-33144 | EP0,355,660A2 |
|---|---|---|---|
| agent (spectral sensitization method | column of page 22 to the bottom of page 38 | of page 30 | |
| Emulsion stabilizer | The 1st line of left upper column of page 39 to the bottom of right upper column of page 72 | The 14th line of left upper column of page 30 to the first line of right upper column of page 30 | The 16th line to the 19th line of page 47 |
| Development accelerator | The 1st line of left lower column of page 72 to the 3rd line of right upper column of page 91 | — | — |
| Color coupler (cyan, magenta and yellow couplers) | The 4th line of right upper column of page 91 to the 6th line of left upper column of page 121 | The 14th line of right upper column of page 3 to the bottom of left upper column of page 18; and the 6th line of right upper column of page 30 to the 11th line of right lower column of page 35 | The 15th line to the 27th line of page 4; the 30th line of page 5 to the bottom of page 28; the 29th line to the 31st line of page 45; and the 23rd line of page 47 to the 50th line of page 63 |
| Supersensitizing agent | The 7th line of left upper column of page 121 to the first line of right upper column of page 125 | — | — |
| Ultraviolet light absorber | The 2nd line of right upper column of page 125 to the bottom of left lower column of page 127 | The 14th line of right lower column of page 37 to the 11th line of left upper column of page 38 | The 22nd line to the 31st line of page 65 |
| Anti-fading agent (image stabilizer) | The 1st line of right lower column of page 127 to the 8th line of left lower column of page 137 | The 12th line of right upper column of page 36 to the 19th line of left upper column of page 37 | The 30th line of page 4 to the 23rd line of page 5; the 1st line of page 29 to the 25th line of page 45; the 33rd line to the 40th line of page 45; and the 2nd line to the 21st line of page 65 |
| High-boiling and/or low-boiling organic solvent | The 9th line of left lower column of page 137 to the bottom of right upper column of page 144 | The 14th line of right lower column of page 35 to the 4th line from the bottom of left upper column of page 36 | The 1st line to the 51st line of page 64 |
| Dispersion method of photographic additive | The 1st line of left lower column of page 144 to the 7th line of right upper column of page 146 | The 10th line of right lower column of page 27 to the bottom of left upper column of page 28; and the 12th line of right lower column of page 35 to the 7th line of right upper column of page 36 | The 51st line of page 63 to the 56th line of page 64 |
| Hardening agent | The 8th line of right upper column of page 146 to the 4th line of left lower column of page 155 | — | — |
| Developing agent precursor | The 5th line of left lower column of page 155 to the 2nd line of right lower column of page 155 | — | — |
| Restrainer releasing compound | The 3rd line to the 9th line of right lower column of page 155 | — | — |
| Support | The 19th line of right lower column of page 155 to the 14th line of left upper column of page 156 | The 18th line of right upper column of page 38 to the 3rd line of left upper column of page 39 | The 29th line of page 66 to the 13th line of page 67 |
| Layer structure | The 15th line of left upper column of page 156 to the 14th line of right lower column of page 156 | The 1st line to the 15th line of right upper column of page 28 | The 41st line to the 52nd line of page 45 |
| Dye | The 15th line of right lower column of page 156 to the bottom of right lower column of page 184 | The 12th line of left upper column of page 38 to the 7th line of right upper column of page 38 | The 18th line to the 22nd line of page 66 |
| Color mixing inhibitor | The 1st line of left upper column of page 185 to the 3rd line of right lower column of page 188 | The 8th line to the 11th line of right upper column of page 36 | The 57th line of page 64 to the 1st line of page 65 |
| Gradation controller | The 4th line to the 8th line of right lower | — | — |

TABLES 9 to 13-continued

| Photographic constituent layer | JP-A-62-215272 | JP-A-2-33144 | EP0,355,660A2 |
|---|---|---|---|
| | column of page 188 | | |
| Stain inhibitor | The 9th line of right lower column of page 188 to the 10th line of right lower column of page 193 | The bottom of left upper column of page 37 to the 13th line of right lower column of page 37 | The 32nd line of page 65 to the 17th line of page 66 |
| Surfactant | The 1st line of left lower column of page 201 to the bottom of right upper column of page 210 | The 1st line of right upper column of page 18 to the bottom of right lower column of page 24; and the 10th line from the bottom of left lower column of page 27 to the 9th line of right lower column of page 27 | — |
| Fluorine-containing compound (antistatic agent, coating aid, lubricant, anti-sticking agent, etc.) | The 1st line of left lower column of page 210 to the 5th line of left lower column of page 222 | The 1st line of left upper column of page 25 to the 9th line of right lower column of page 27 | — |
| Binder (hydrophilic colloid) | The 6th line of left lower column of page 222 to the bottom of left upper column of page 225 | The 8th line to the 18th line of right upper column of page 38 | The 23rd line to the 28th line of page 66 |
| Thickener | The 1st line of right upper column of page 225 to the 2nd line of right upper column of page 227 | — | — |
| Antistatic agent | The 3rd line of right upper column of page 227 to the 1st line of left upper column of page 230 | — | — |
| Polymer latex | The 2nd line of left upper column of page 230 to the bottom of page 239 | — | — |
| Matting agent | The 1st line of left upper column of page 240 to the bottom of right upper column of page 240 | — | — |
| Photographic processing method (processing stage, additive, etc.) | The 7th line of right upper column of page 3 to the 5th line of right upper column of page 10 | The 4th line of left upper column of page 39 to the bottom of left upper column of page 42 | The 14th line of page 67 to the 28th line of page 69 |

Note
The cited places of JP-A-62-215272 include an amendment dated March 16, 1987 attached to the end of this publication. Among the above-described couplers, short wave type yellow couplers described in JP-A-63-231451, JP-A-63-123047, JP-A-63-241547, JP-A-1-173499, JP-A-1-213648, and JP-A-1-250944 can be preferably used as the yellow couplers.

As the silver halide used in the present invention, silver chloride, silver bromide, silver bromochloride, silver chloroiodide, silver bromochloroiodide, and silver bromoiodide can be used. Particularly preferred for rapid processing is silver chlorobromide containing substantially no silver iodide and having a silver chloride content of 90 mole % or more, more preferably 95 mole % or more, and particularly 98 mole % or more, or pure silver chloride.

For improving image sharpness, dyes (among them, an oxonol series dye) capable of being decolored by processing, described at pages 27 to 76 of European Patent EP 0,337,490A2, are preferably incorporated into a hydrophilic colloid layer of the light-sensitive material according to the present invention so that an optical reflection density of the light-sensitive material in 680 nm becomes 0.70 or more. Titanium oxide which is subjected to a surface treatment with di- to tetrahydric alcohols (for example, trimethylolethane) in the proportion of 12% by weight or more (more preferably 14% by weight or more) may be incorporated into an antiwater resin layer as another way of improving image sharpness.

Also, in the light-sensitive material according to the present invention, the color image preservability-improving compounds described in European Patent EP 0,277,589A2 are preferably used together with couplers. In particular, they are preferably used in combination with a pyrazoloazole series magenta coupler.

Preferably used simultaneously or singly for preventing side effects of, for example, the generation of stain due to the reaction of a color developing agent or an oxidation product thereof remained in a layer during storage after processing with a coupler are the compounds (F) described in EP 0,277,589A2 which are chemically combined with an aromatic amine series developing agent remaining after a color development processing to form a chemically inactive and substantially colorless compound, and/or the compounds (G) described in EP 0,277,589A2 which are chemically combined with the oxidation product of an aromatic amine series developing agent remaining after color development processing to form a chemically inactive and substantially colorless compound.

Further, the anti-mold agents described in JP-A-63-271247 are preferably added to the light-sensitive material according to the present invention for the purpose of preventing various molds and bacteria which grow in a hydrophilic colloid layer to deteriorate an image.

A suitable support for the light-sensitive material according to the present invention for display is a white color polyester series support or a support in which a layer containing a white pigment is provided on a support side having a silver halide emulsion layer. Further, an anti-halation layer is preferably provided on a support side coated thereon with a silver halide emulsion layer or the backside thereof in order to improve sharpness. In particular, a transmission density of a support is controlled preferably in the range of 0.35 to 0.8 so that a display can be viewed with either a reflected light or a transmitted light.

The light-sensitive material according to the present invention may be exposed with either a visible infrared light ray. The method of exposure may be either a low illuminance exposure or a high illuminance exposure for a short time. Particularly in the latter case, a laser scanning exposing method in which an exposing time per a pixel is shorter than $10^{-4}$ second is preferred.

In exposure, the band stop filter described in U.S. Pat. No. 4,880,726 is preferably used, whereby a light mixture is removed to notably improve a color reproduction.

The present invention can be applied to, for example, a color paper, a color reversal paper, a direct positive color light-sensitive material, a color negative film, a color positive film, and color reversal film. Above all, it is preferably applied to a color light-sensitive material having a reflective support (for example, a color paper and a color reversal paper) and a color light-sensitive material for forming a positive image (for example, a direct positive color light-sensitive material, a color positive film and a color reversal film), and particularly preferably applied to a color light-sensitive material having a reflective support.

The compounds of the present invention are preferably used in combination with magenta dye-forming coupler and cyan dye-forming coupler which forth magenta and cyan dyes, respectively, upon a coupling reaction with the oxidation product of an aromatic primary amine developing agent.

These couplers used in combination may be either tetraequivalent or diequivalent and may be in the form of a polymer or an oligomer. Further, the couplers used in combination may be of single kind or a mixture of two or more kinds.

The couplers preferably used in combination with the cyan couplers of the present invention will be explained.

Phenol type and naphthol type couplers can be used as a cyan coupler. Preferred are the compounds described in U.S. Pat. Nos. 4,052,212, 4,146,396, 4,228,233, 4,296,200, 2,369,929, 2,801,171, 2,772,162, 2,895,826, 3,772,002, 3,758,308, 4,334,011, and 4,327,173; German Patent Publication 3,329,729; European Patents 121,365A and 249,453A; U.S. Pat. Nos. 3,446,622, 4,333,999, 4,775,616, 4,451,559, 4,427,767, 4,690,889, 4,254,212, and 4,296,199; and JP-A-61-42658. Further, the pyrazoloazole series couplers described in JP-A-64-553, JP-A-64-554, JP-A-64-555, and JP-A-64-556, and the imidazole series couplers described in U.S. Pat. No. 4,818,672 can be used in combination with the phenol or naphthol type couplers.

Particularly preferred are the cyan couplers described in JP-A-4-174429, EP 488248A, JP-A-4-190348, EP 491197A, JP-A-64-32260, and JP-A-2-141745, and the couplers represented by Formulas (C-I) and (C-II) described at a left lower column at page 17 to a left lower column at page 20 of JP-A-2-139544.

The 5-pyrazolone series and pyrazoloazole series compounds are preferred as a magenta coupler. More preferred are the compounds described in U.S. Pat. Nos. 4,310,619 and 4,351,897, European Patent 73,636, U.S. Pat. Nos. 3,061,432 and 3,725,067, Research Disclosure No. 24220 (June 1984), JP-A-60-33552, Research Disclosure No. 24230 (June 1984), JP-A-60-43659, JP-A-61-72238, JP-A-60-35730, JP-A-55-118034, and JP-A-60-185951, U.S. Pat. Nos. 4,500,630, 4,540,654, and 4,556,630, and International Publication WO 88/04795.

Particularly preferred magenta couplers include the pyrazoloazole series magenta couplers described at a right lower column at page 3 to a right lower column at page 10 of JP-A-2-139544 and the 5-pyrazolone magenta couplers represented by Formula (M-I) described at a left lower column at page 17 to a left upper column at page 21 of JP-A-2-139544. Most preferred are the above pyrazoloazole series magenta couplers.

A yellow coupler which may be used in combination with the yellow couplers of the present invention include the compounds described in, for example, U.S. Pat. Nos. 3,933,501, 4,022,620, 4,326,024, 4,401,752, and 4,248,961, JP-B-58-10739, British Patents 1,425,020 and 1,476,760, U.S. Pat. Nos. 3,973,968, 4,314,023 and 4,511,649, European Patent 249,473A, and JP-A-63-23145, JP-A-63-123047, JP-A-1-250944, and JP-A-1-213648, as long as the effects of the present invention are not adversely affected.

In the present invention, couplers releasing a photographically useful groups upon coupling can preferably be used. Preferred as a DIR coupler releasing a development inhibitor are the compounds described in the patents abstracted in above RD No. 17643, VII-F, JP-A-57-151944, JP-A-57-154234, JP-A-60-184248, and JP-A-63-37346, and U.S. Pat. Nos. 4,248,962 and 4,782,012.

Preferred as the coupler which imagewise releases a nucleus-forming agent or a development accelerator in developing, are the compounds described in British Patents 2,097,140 and 2,131,188, and JP-A-59-157638 and JP-A-59-170840.

In addition to the above, couplers which can be used in combination in the light-sensitive material of the present invention include the competitive couplers described in U.S. Pat. No. 4,130,427; the polyequivalent couplers described in U.S. Pat. Nos. 4,283,472, 4,338,393 and 4,310,618; the DIR redox compound-releasing couplers, DIR coupler-releasing couplers, DIR coupler-releasing redox compounds or DIR redox-releasing redox compounds described in JP-A-60-185950 and JP-A-62-24252; the couplers releasing a dye whose color is recovered after splitting off, described in European Patent 173,302A; the bleaching accelerator-releasing couplers described in RD NO. 11449 and 24241, and JP-A-61-201247; the regand-releasing couplers described in U.S. Pat. No. 4,553,477; the couplers releasing a leuco dye, described in JP-A-63-75747; and the couplers releasing a fluorescent dye, described in U.S. Pat. No. 4,774,181.

The standard amount used of these color couplers which can be used in combination in the present invention is in the range of 0.001 to 1 mole per mole of light-sensitive silver halide, preferably 0.01 to 0.5 mole in a yellow coupler, 0,003 to 0.3 mole in a magenta coupler and 0.002 to 0.3 mole in a cyan coupler.

Various anti-fading agents can be used in combination in the light-sensitive material of the present invention. Representative examples of an organic anti-fading agent for cyan, magenta and/or yellow images include hydroquinones, 6-hydroxychromans, 5-hydroxycoumarans, spirochromans, p-alkoxyphenols, hindered phenols represented by bisphenols, gallic acid derivatives, methylenedioxybenzenes, aminophenols, hindered amines, and ether or ester derivatives thereof in which the phenolic hydroxy groups thereof are silylated and alkylated. Further, the metal complex compounds represented by (bis-salicylaldoximate) nickel complex and (bis-N,N-dialkyldithiocarbamate) nickel complex can also be used.

Concrete examples of the organic anti-fading agent include hydroquinones described in U.S. Pat. Nos. 2,360,290, 2,418,613, 2,700,453, 2,701,197, 2,728,659, 2,732,300, 2,735,765, 3,982,944, and 4,430,425, British Patent 1,363,921, U.S. Pat. Nos. 2,710,801 and 2,816,028; 6-hydroxychromans, 5-hydroxychromans and spirochromans described in U.S. Pat. Nos. 3,432,300, 3,573,050, 3,574,627, 3,698,909, and 3,764,337, and JP-A-52-152225; spiroindanes described in U.S. Pat. No. 4,360,589; p-alkoxyphenols described in U.S. Pat. No. 2,735,765, British Patent 2,066,975, JP-A-59-10539, and JP-B-57-19765; hindered phenols described in U.S. Pat. Nos. 3,700,455 and 4,228,235, JP-A-52-72224, and JP-B-52-6623; gallic acid derivatives described in U.S. Pat. No. 3,457,079; methylenedioxybenzenes described in U.S. Pat. No. 4,332,886; aminophenols described in JP-B-56-21144; hindered amines described in U.S. Pat. Nos. 3,336,135 and 4,268,593, British Patents 1,326,889, 1,354,313, and 1,410,846, JP-B-51-1420, JP-A-58-114036, JP-A-59-53846, and JP-A-59-73844; and metal complex compounds described in U.S. Pat. Nos. 4,050,938 and 4,241,155, and British Patent 2,027,731 (A). These compounds, which are emulsified together with the respective corresponding couplers in the ratio of 5 to 100% by weight based on the amount of the couplers, can be added to a light-sensitive layer to achieve the objects of the present invention.

The color light-sensitive material of the present invention may contain a hydroquinone derivative, an aminophenol derivative, a gallic acid derivative and an ascorbic acid derivative as an anti-foggant.

Also, for the purpose of preventing the deterioration of a cyan dye image by heat and particularly by light, it is more effective to incorporate a UV absorber into a cyan color developing layer and both layers adjacent thereto.

Suitable as a UV absorber are the benzotriazole compounds substituted with an aryl group (for example, the compounds described in U.S. Pat. No. 3,533,794), the 4-thiazolidone compounds (for example, the compounds described in U.S. Pat. Nos. 3,314,794 and 3,352,681), the benzophenone compounds (for example, the compounds described in JP-A-46-2784 and European Patent Publication 521823A), the cinnamic acid ester compounds (for example, the compounds described in U.S. Pat. Nos. 3,705,805 and 3,707,395), the butadiene compounds (for example, the compounds described in U.S. Pat. No. 4,045,229), the triazine compounds (for example, the compounds described in JP-A-46-3335 and European Patent Publication 520938A), and benzoxazole compounds (for example, the compounds described in U.S. Pat. Nos. 3,406,070 and 4,271,307). Further, a absorptive coupler (for example, an α-naphthol series cyan dye-forming coupler) and a UV absorptive poisoners may be used. These UV absorbers may be mordanted in a specific layer. Of the above compounds, the above benzotriazole compounds substituted with an aryl group and the triazine compounds are preferred.

These anti UV agents can also be added to the layer containing a yellow coupler.

The light-sensitive material according to the present invention can be subjected to development processing by the conventional method described at pages 28 to 29 of the above mentioned Research Disclosure No. 17643 and at the left column to the right column of 615 of Research Disclosure No. 18716. For example, a color development processing step, a desilver processing step, and a rinsing processing step are carried out. At the desilver processing step, a bleaching step using a bleaching solution and a fixing step using a fixing solution can be replaced with a bleach-fixing step using a bleach-fixing solution, and a bleaching step, a fixing step and a bleach-fixing step may be combined in an arbitrary order. The rinsing step may be replaced with a stabilizing step, and the stabilizing step may be carried out following the rinsing step. Further, there can also be carried out a mono bath processing step in which color developing, bleaching and fixing are carried out in a single bath using a mono bath develop-bleach-fixing processing solution. In combination with these processing steps, there may also be carried out a pre-hardening processing step, a neutralizing step therefor, a stop-fixing processing step, a post-hardening processing step, an adjusting step, and an intensifying step. An intermediate rinsing step may be arbitrarily included between the above steps. In these types of processing, the color development processing step may be replaced with a so-called activator processing step.

EXAMPLES

Example 1

A paper support laminated on both sides thereof with polyethylene, which was subjected to a corona discharge treatment, was provided with a gelatin subbing layer containing sodium dodecylbenzenesulfonate and further was coated with the various photographic constitutional layers, whereby the multilayered color photographic paper (101) having the following layer constitution was prepared. The coating solutions were prepared in the following manner.

Preparation of the First Layer Coating Solution

A yellow coupler (the comparative coupler A) (153.0 g) was dissolved in a solvent (Solv-1) (25 g), (Solv-2) (25 g) and ethyl acetate (180 ml), and this solution was dispersed in a 10% gelatin aqueous solution (1000 g) containing a 10% sodium dodecylbenzenesulfonate aqueous solution (60 ml) and citric acid (10 g), to prepare the emulsified dispersion A.

Meanwhile, there was prepared the silver bromochloride emulsion A (cube, the 3:7 mixture (Ag mole ratio) of the large size emulsion A with the average grain size of 0.88 mm and the small size emulsion A with the average grain size of 0.70 mm, wherein the fluctuation coefficients in the grain size distributions were 0.08 and 0.10, respectively, and either size emulsions contained the grains in which silver bromide (0.3 mol %) was localized on a part of a grain surface). Added to this emulsion were the following blue-sensitive sensitizing dyes A and B each at $2.0\times10^{-4}$ mole per mole of silver to the large size emulsion A and each at $2.5\times10^{-4}$ mole per mole of silver to the small size emulsion A. Further, this emulsion was subjected to chemical ripening by adding a sulfur sensitizer and a gold sensitizer. The foregoing emulsified dispersion A and this silver bromochloride emulsion A were mixed and dissolved, whereby the first layer coating solution was prepared so that it was of the following composition.

The coating solutions for the 2nd layer to the 7th layer were prepared in the same manner as the 1st layer coating solution. Sodium 1-oxy-3,5-dichloro-s-triazine was used as the gelatin hardener for the respective layers.

Further, Cpd-14 and Cpd-15 were added to the respective layers so that the entire amounts thereof became 25.0 mg/m$^2$ and 50.0 mg/m$^2$, respectively.

The spectral sensitizing dyes used for the silver bromochloride emulsions contained in the respective light-sensitive emulsion layers are shown below.

Blue-sensitizing emulsion layer

Sensitizing dye A

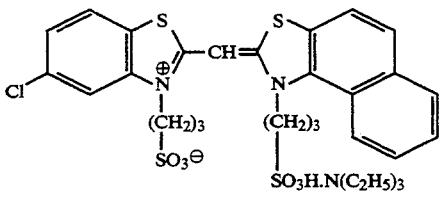

-continued

Sensitizing dye B

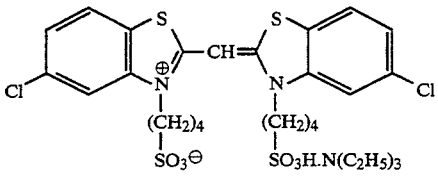

(each $2.0\times10^{-4}$ mole per mole of silver halide to the large size emulsion and each $2.5\times10^{-4}$ mole per mole of silver halide to the small size emulsion).

Green-sensitive emulsion layer

Sensitizing dye C

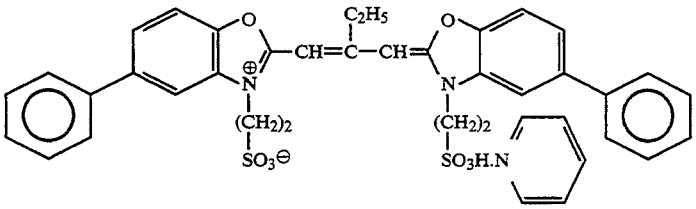

($4.0\times10^{-4}$ mole per mole of silver halide to the large size emulsion and $5.6\times10^{-4}$ mole per mole of silver halide to the small size emulsion)

Sensitizing dye D

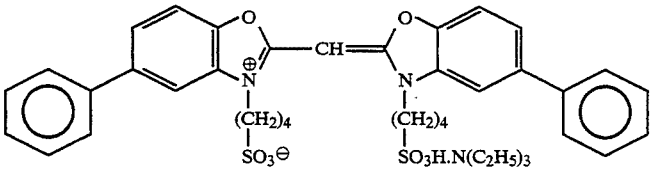

($7.0\times10^{-5}$ mole per mole of silver halide to the large size emulsion and $1.0\times10^{-5}$ mole per mole of silver halide to the small size emulsion).

Red-sensitive emulsion layer

Sensitizing dye E

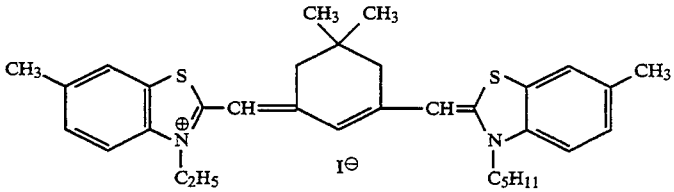

($1.0\times10^{-4}$ mole per mole of silver halide to the large size emulsion and $1.2\times10^{-4}$ mole per mole of silver halide to the small size emulsion).

Further, the following compound F was added in an amount of $2.6\times10^{-3}$ mole per mole of silver halide:

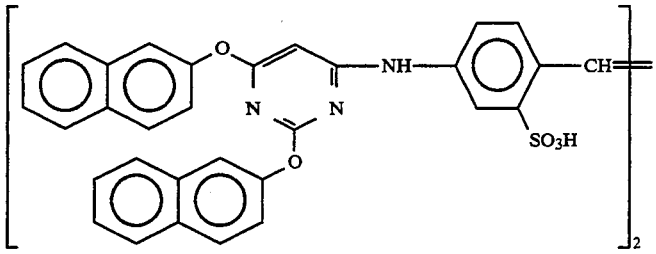

Further added to the blue-sensitive emulsion layer, green-sensitive emulsion layer and red-sensitive emulsion layer, was 1-(5-methylureidophenyl)-5-mercaptotetrazole in the amounts of $8.5\times10^{-5}$ mole, $7.7\times10^{-4}$ mole and $2.5\times10^{-4}$ mole per mole of silver halide, respectively.

Further added to the blue-sensitive emulsion layer and green-sensitive emulsion layer were 4-hydroxy-6-methyl-1,3,3a,7-tetrazaindene in the amounts of $1\times10^{-4}$ mole and $2\times10^{-4}$ mole per mole of silver halide, respectively.

The following dyes (the numeral in a parenthesis represents coated amount) was added to an emulsion layer for preventing an irradiation:

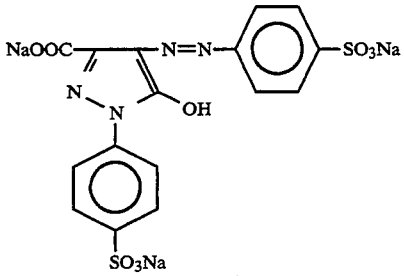

(10 mg/m²),

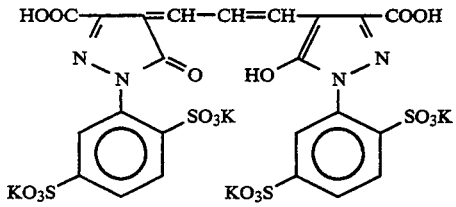

(10 mg/m²),

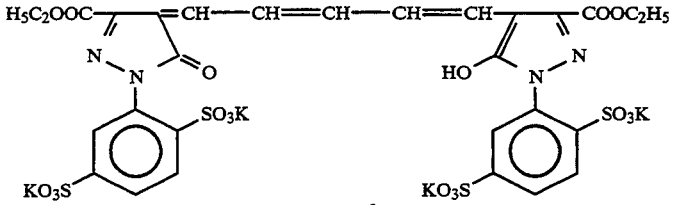

(40 mg/m²)

and

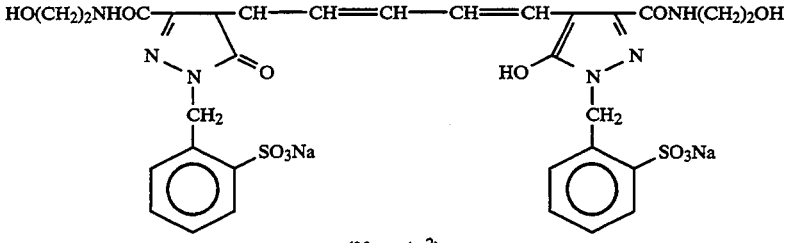

(20 mg/m²)

Layer Constitution

The compositions of the respective layers are shown below. The numerals represent the coated amounts (g/m²). The coated amounts of the silver halide emulsions are shown in terms of the amounts converted to silver.

Support

Polyethylene laminated paper [polyethylene coated on the first layer side contains a white pigment ($TiO_2$) and a blue dye (ultramarine)].

| First layer (a blue-sensitive emulsion layer) | |
|---|---|
| Above silver bromochloride emulsion A | 0.27 |
| Gelatin | 1.36 |
| Yellow coupler (comparative coupler A) | 0.79 |
| Solvent (Solv-1) | 0.13 |
| Solvent (Solv-2) | 0.13 |

| Second layer (an anti-color mixing layer) | |
|---|---|
| Gelatin | 1.00 |
| Anti-color mixing agent (Cpd-4) | 0.06 |
| Solvent (Solv-7) | 0.03 |
| Solvent (Solv-2) | 0.25 |
| Solvent (Solv-3) | 0.25 |

Third layer (a green-sensitive emulsion layer)

-continued

| | |
|---|---|
| Silver bromochloride emulsion (cube; 1:3 mixture (silver mole ratio) of the large size emulsion B having the average grain size of 0.55 μm and the small size emulsion B having the average grain size of 0.39 μm, wherein the fluctuation coefficients in the grain size distributions are 0.10 and 0.08, respectively, and either size emulsions contain the grains in which AgBr 0.8 mol % is localized on a part of the grain surface) | 0.13 |
| Gelatin | 1.45 |
| Magenta coupler (ExM) | 0.16 |
| Dye image stabilizer (Cpd-5) | 0.15 |
| Dye image stabilizer (Cpd-2) | 0.03 |
| Dye image stabilizer (Cpd-6) | 0.01 |
| Dye image stabilizer (Cpd-7) | 0.01 |
| Dye image stabilizer (Cpd-8) | 0.08 |
| Solvent (Solv-3) | 0.50 |
| Solvent (Solv-4) | 0.15 |
| Solvent (Solv-5) | 0.15 |
| Fourth layer (an anti-color mixing layer) | |
| Gelatin | 0.70 |
| Anti-color mixing agent (Cpd-4) | 0.04 |
| Solvent (Solv-7) | 0.02 |
| Solvent (Solv-2) | 0.18 |
| Solvent (Solv-3) | 0.18 |
| Fifth layer (a red-sensitive emulsion layer) | |
| Silver bromochloride emulsion (cube; 1:3 mixture (silver mole ratio) of the large size emulsion C having the average grain size of 0.50 μm and the small size emulsion C having the average grain size of 0.41 μm, wherein the fluctuation coefficients in the grain size distributions are 0.09 and 0.11, respectively, and either size emulsions contain the grains in which AgBr 0.8 mol % is localized on a part of the grain surface) | 0.18 |
| Gelatin | 0.85 |
| Cyan coupler (ExC) | 0.25 |
| UV absorber (UV-2) | 0.18 |
| Dye image stabilizer (Cpd-1) | 0.25 |
| Dye image stabilizer (Cpd-6) | 0.01 |
| Dye image stabilizer (Cpd-7) | 0.01 |
| Dye image stabilizer (Cpd-8) | 0.03 |
| Dye image stabilizer (Cpd-9) | 0.01 |
| Dye image stabilizer (Cpd-10) | 0.01 |
| Dye image stabilizer (Cpd-11) | 0.01 |
| Solvent (Solv-6) | 0.20 |
| Solvent (Solv-1) | 0.01 |
| Sixth layer (a UV absorbing layer) | |
| Gelatin | 0.55 |
| UV absorber (UV-1) | 0.38 |
| Dye image stabilizer (Cpd-12) | 0.15 |
| Dye image stabilizer (Cpd-5) | 0.02 |
| Seventh layer (a protective layer) | |
| Gelatin | 1.13 |
| Acryl-modified copolymer of polyvinyl alcohol (a modification degree: 17%) | 0.05 |
| Liquid paraffin | 0.02 |
| Dye image stabilizer (Cpd-13) | 0.01 |

The compounds used in Example 1 of the present invention and Examples 6 and 7 thereof described hereinafter are shown below.

Yellow coupler (comparative coupler A)

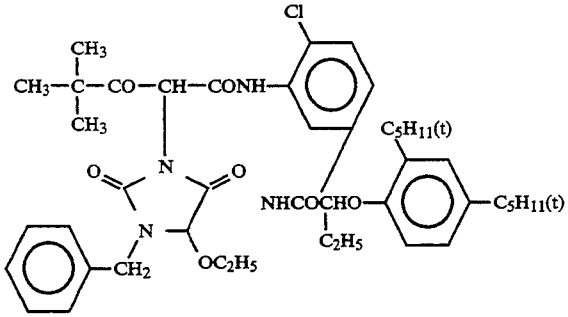

-continued

Magenta coupler (ExM)

1:1:0.5 mixture (mole ratio) of

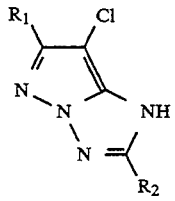

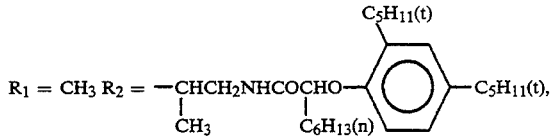

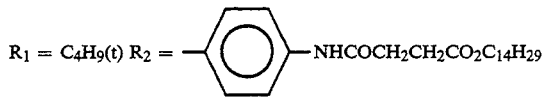

and

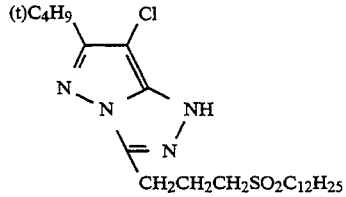

Cyan coupler (ExC)

3:6:1 mixture (mole ratio) of

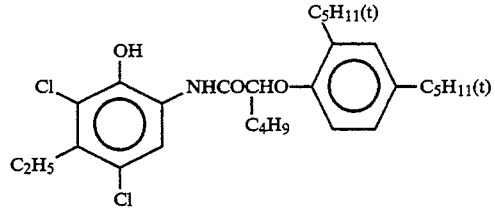

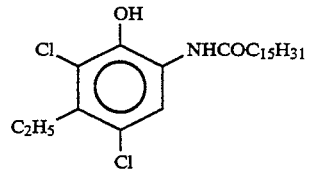

and

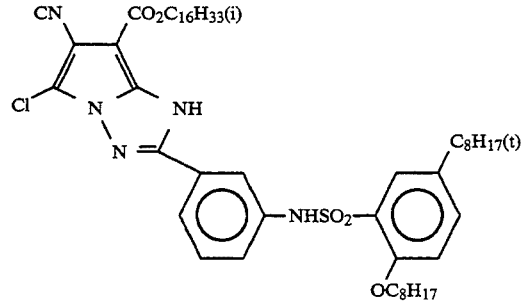

Dye image stabilizer (Cpd-1)

-continued

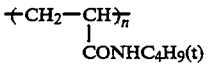

Average molecular weight: 60,000

Dye image stabilizer (Cpd-2)

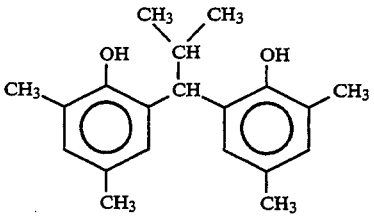

Dye image stabilizer (Cpd-3)

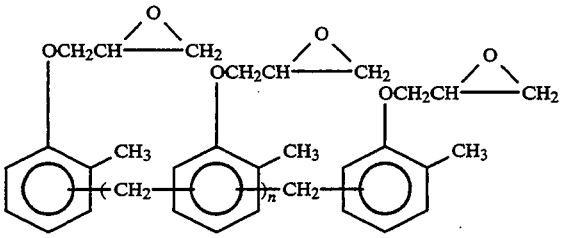

n = 7 to 8 (average value)

Anti-color mixing agent (Cpd-4)

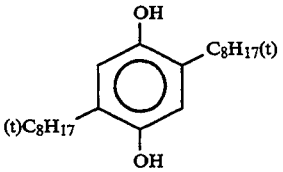

Dye image stabilizer (Cpd-5)

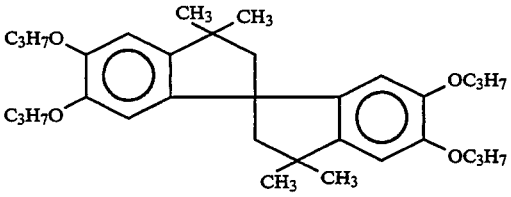

Dye image stabilizer (Cpd-6)

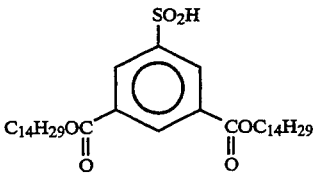

Dye image stabilizer (Cpd-7)

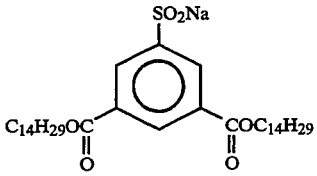

Dye image stabilizer (Cpd-8)

-continued

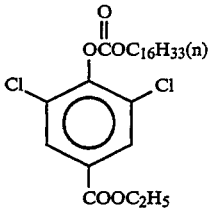

Dye image stabilizer (Cpd-9)

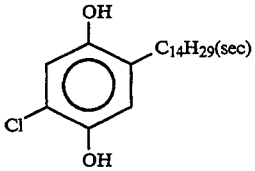

Dye image stabilizer (Cpd-10)

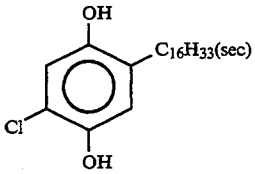

Dye image stabilizer (Cpd-11)

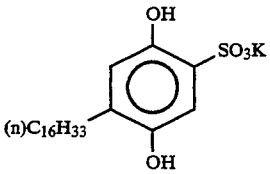

Dye image stabilizer (Cpd-12)

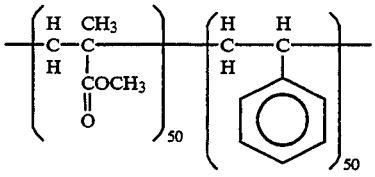

Average molecular weight: 60,000

Dye image stabilizer (Cpd-13)

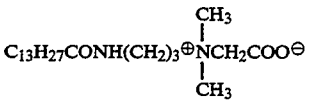

Preservative (Cpd-14)

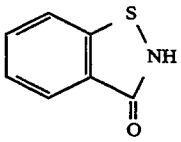

Preservative (Cpd-15)

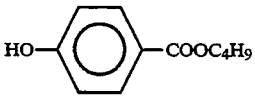

Anti-color mixing agent (Cpd-16)

1:1 mixture (weight ratio)

-continued
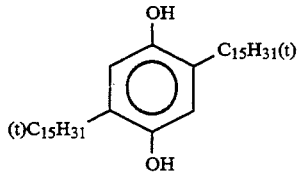
and
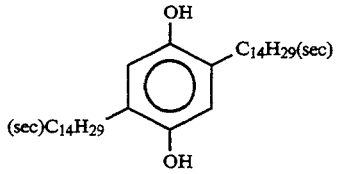
UV absorber (UV-1)
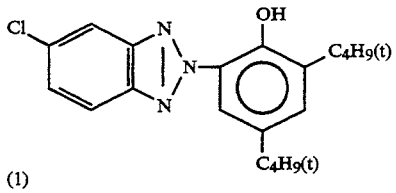
(1)
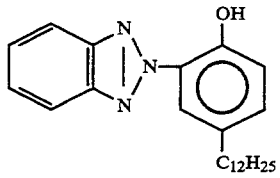
(2)
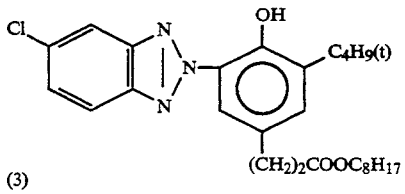
(3)
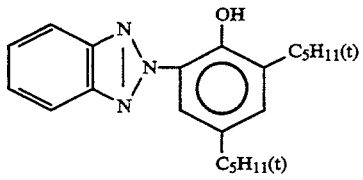
(4)
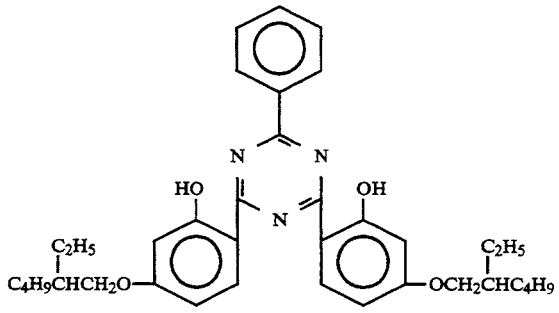
(5)
-continued
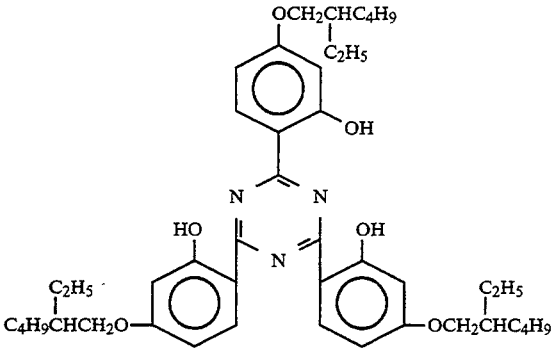
(6)
Mixture of (1), (2), (3), (4), (5) and (6)
by 10:5:1:5:1:1 (weight ratio)
UV absorber (UV-2)
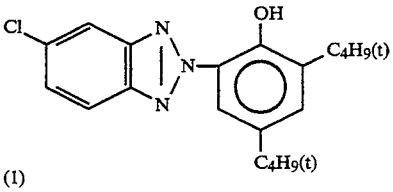
(1)
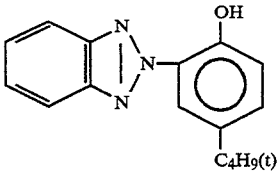
(2)
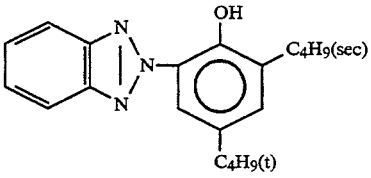
(3)
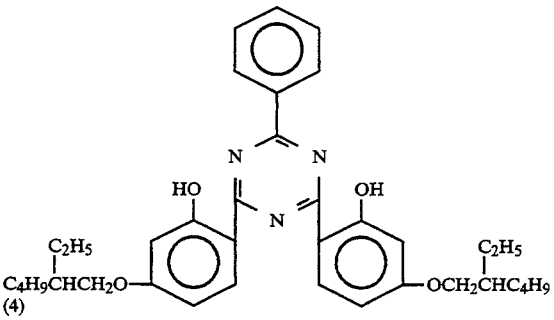
(4)

-continued

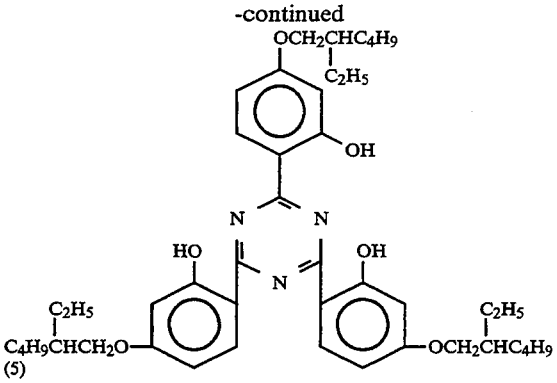

(5)

Mixture of (1), (2), (3), (4) and (5) by 1:2:2:1:1 (weight ratio)

Solvent (Solv-1)

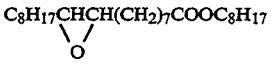

Solvent (Solv-2)

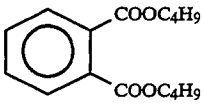

Solvent (Solv-3)

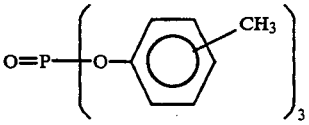

Solvent (Solv-4)

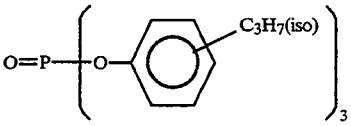

Solvent (Solv-5)

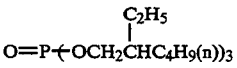

Solvent (Solv-6)

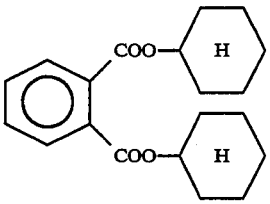

Solvent (Solv-7)

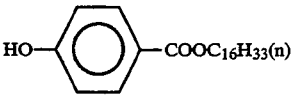

Solvent (Solv-8)

-continued

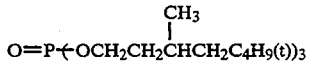

Solvent (Solv-9)

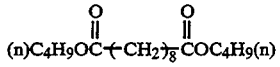

Solvent (Solv-10)

First, Sample 101 was subjected to gradational exposure of three color separation for a sensitometry with a sensitometer (FWH type, the color temperature of a light source: 3200° K., manufactured by Fuji Photo Film Co., Ltd.), wherein the exposure was given so that an exposure became 250 CMS at the exposing time of 0.1 second.

The samples thus exposed were subjected to continuous processing of 250 $m^2$ at the following steps in the processing solutions of the following compositions with a paper processing machine.

| Processing step | Temperature | Time | Replenishing amount* | Tank capacity |
|---|---|---|---|---|
| Color developing | 35° C. | 45 seconds | 161 ml | 10 l |
| Bleach/fixing | 35° C. | 45 seconds | 218 ml | 10 l |
| Rinsing (1) | 35° C. | 30 seconds | — | 5 l |
| Rinsing (2) | 35° C. | 30 seconds | — | 5 l |
| Rinsing (3) | 35° C. | 30 seconds | 360 ml | 5 l |
| Drying | 80° C. | 60 seconds | | |

*Replenishing amount is per $m^2$ of the light-sensitive material.

Rinsing was of a three tanks countercurrent system from (3) to (1).

The compositions of the respective processing solutions are as follows:

| | Tank solution | Replenishing solution |
|---|---|---|
| Color developing solution | | |
| Water | 800 ml | 800 ml |
| Ethylenediaminetetraacetic acid | 3.0 g | 3.0 g |
| Disodium 4,5-dihydroxybenzene-1,3-disulfonate | 0.5 g | 0.5 g |
| Potassium bromide | 0.01 g | — |
| Triethanolamine | 12.0 g | 12.0 g |
| Sodium chloride | 2.5 g | — |
| Potassium carbonate | 27.0 g | 27.0 g |
| Sodium sulfite | 0.1 g | 0.2 g |
| N-ethyl-N-(b-methanesulfon—amidoethyl)-3-methyl-4-aminoaniline sulfate | 5.0 g | 7.1 g |
| Sodium N,N-di(sulfoethyl) hydroxylamine | 5.0 g | 8.0 g |
| Fluorescent whitening agent (Whitex 4B manufactured by Sumitomo Chem. Ind. Co., Ltd.)) | 1.0 g | 2.5 g |
| Water was added to | 1000 ml | 1000 ml |
| pH (25° C., adjusted by potassium hydroxide and sulfuric acid) | 10.05 | 10.45 |

Bleach/fixing solution (Common to the tank solution and replenishing solution)

| | |
|---|---|
| Water | 600 ml |
| Ammonium thiosulfate (700 g/liter) | 100 ml |
| Sodium sulfite | 40 g |
| Iron (III) ammonium ethylenediaminetetraacetate | 55 g |
| Disodium ethylenediaminetetracetate | 5 g |

-continued

| | Tank solution | Replenishing solution |
|---|---|---|
| Ammonium bromide | 40 g | |
| Nitric acid (67%) | 30 g | |
| Water was added to | 1000 ml | |
| pH (25° C., adjusted by acetic acid and aqueous ammonia) | 5.8 | |
| Rinsing solution (Common to the tank solution and replenishing solution) | | |
| Sodium chloroisocyanurate | 0.02 g | |
| Deionized water (electroconductivity: 5 μs/cm or less) | 1000 ml | |
| pH (25° C.) | 6.5 | |

Next, the other samples were prepared in the same manner as that in Sample 101 except that the yellow coupler (the comparative coupler. A) contained in the first coupler of Sample 101 was replaced with the comparative couplers and couplers of the present invention as shown in Table 24 in the same molar amounts. They were subjected to exposure and development processing in the same manner as Sample 101.

The respective samples on which the dye images were thus formed were subjected to a fading test. An anti-fading effect was evaluated by a yellow density residual rate in the initial density of 1.0 after exposing with a xenone tester (illuminance: 200,000 lux) for 16 days. The results thus obtained are shown in Table 24.

TABLE 24

| Sample | Coupler | Dye residual rate (initial density: 1.0) |
|---|---|---|
| 101 (Comp.) | Comp. coupler A | 39% |
| 102 (Comp.) | Comp. coupler B | 65% |
| 103 (Comp.) | Comp. coupler C | 69% |
| 104 (Comp.) | Comp. coupler D | 64% |
| 105 (Comp.) | Comp. coupler E | 63% |
| 106 (Comp.) | Comp. coupler F | 22% |
| 107 (Comp.) | Comp. coupler G | 42% |
| 108 (Comp.) | Comp. coupler H | 39% |
| 109 (Comp.) | Comp. coupler I | 55% |
| 110 (Inv.) | Y-1 | 87% |
| 111 (Inv.) | Y-8 | 88% |
| 112 (Inv.) | Y-10 | 86% |
| 113 (Inv.) | Y-15 | 85% |
| 114 (Inv.) | Y-22 | 87% |
| 115 (Inv.) | Y-29 | 84% |
| 116 (Inv.) | Y-35 | 84% |
| 117 (Inv.) | Y-42 | 87% |
| 118 (Inv.) | Y-49 | 88% |
| 119 (Inv.) | Y-54 | 86% |
| 120 (Inv.) | Y-56 | 86% |
| 121 (Inv.) | Y-64 | 87% |
| 122 (Inv.) | Y-66 | 85% |
| 123 (Inv.) | Y-72 | 84% |

Comparative coupler B

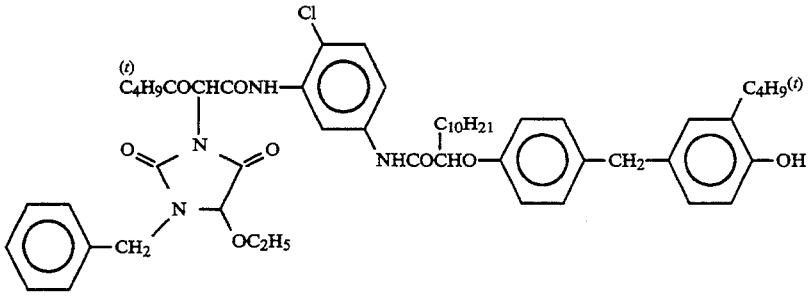

Compound (Y-15) described in JP-A-1-180547

Comparative coupler C

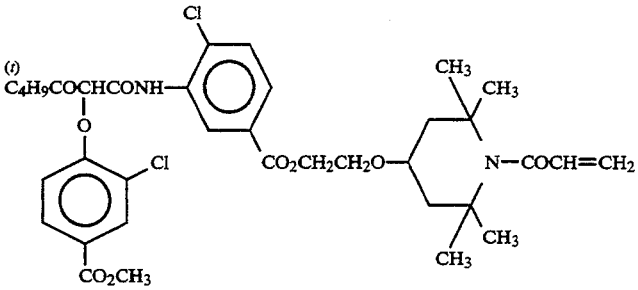

Compound (Y-8) described in JP-A-1-191141

Comparative coupler D

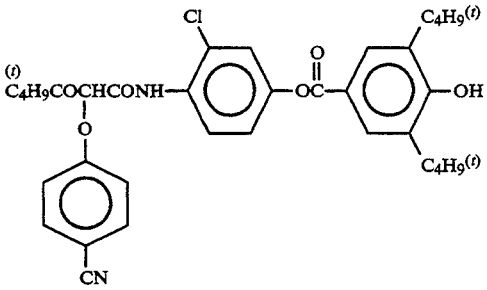

The compound described in U.S. Pat. No. 4,758,501

-continued
Comparative coupler E
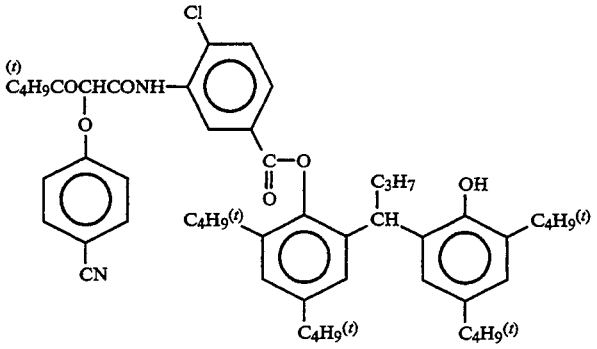
The compound described in U.S. Pat. No. 4,824,771
Comparative coupler F
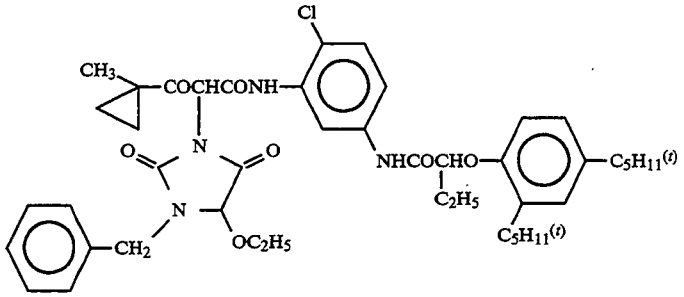
The compound described in published European Patent 447969
Comparative coupler G
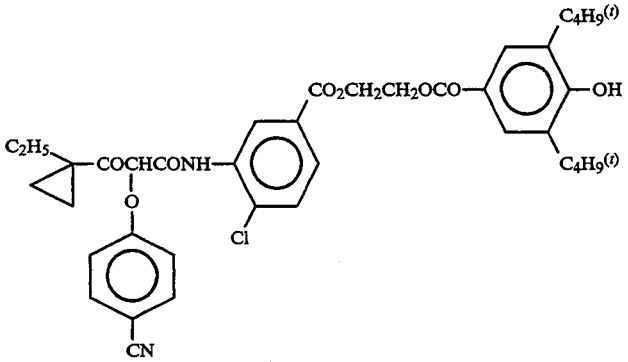
The compound described in published European Patent 447969
Comparative coupler H
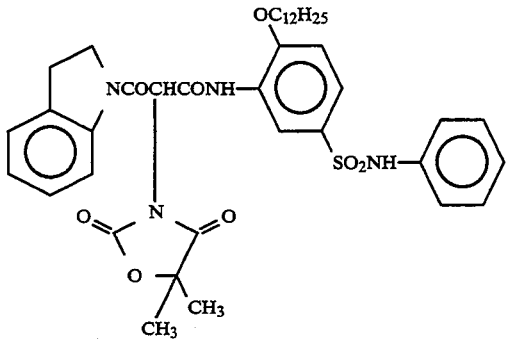

-continued
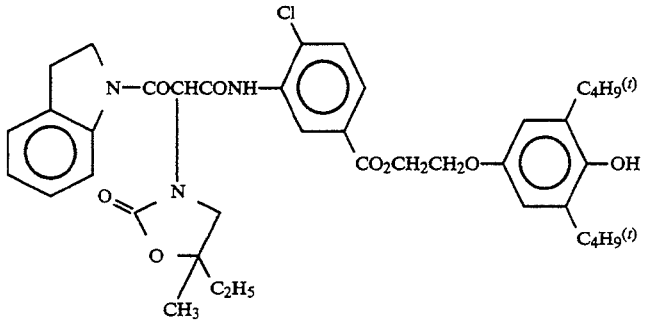
Comparative coupler I
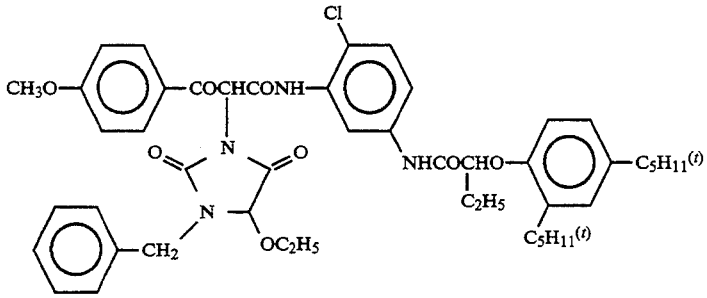
Comparative coupler J
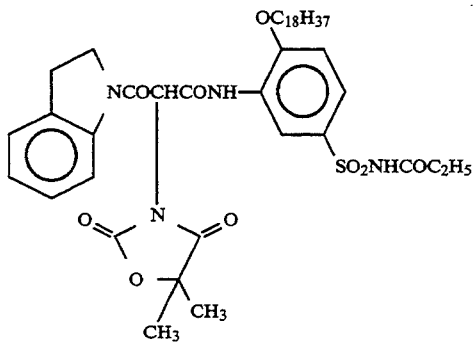
Comparative coupler K
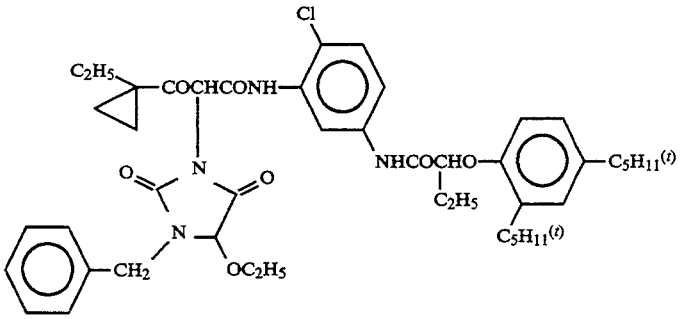
Comparative coupler L
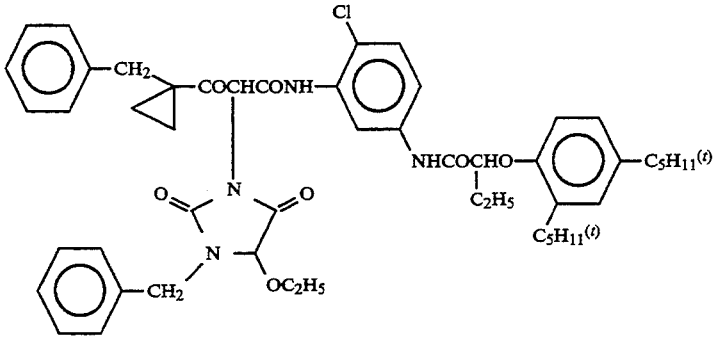
Comparative coupler M -continued Comparative coupler N

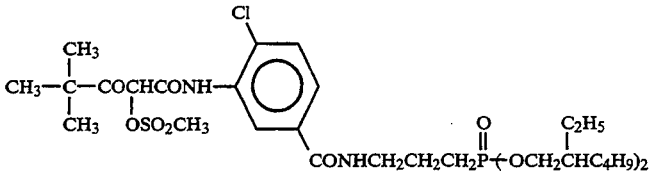

The compound described in U.S. Pat. No. 4,026,709

Comparative coupler O

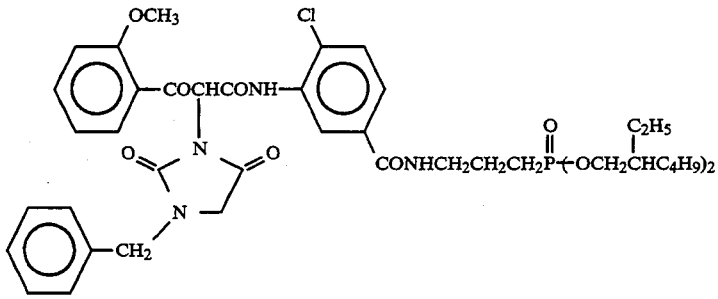

The compound described in U.S. Pat. No. 4,026,709

It can be found from the results summarized in Table 24 that the couplers of the present invention can provide dye images having a very high light fastness at a level that can not be expected from the publicly known couplers. Further, while the yellow density increase at the background portion is about 0.2 in any of the comparative couplers, it is 0.1 or less in any of the couplers of the present invention and the generation of a yellow stain is low.

While fogging is observed in any of Comparative Samples 102, 103, 104, 105, 106, and 109, the generation of fogging is substantially not observed and color developing also is excellent in Samples 110 to 124 of the present invention.

Further, the comparison of the hues of the respective samples shows that Samples 106 to 124 provide more brilliant yellow colors than those of Samples 101 to 105.

Example 2

The samples were prepared in the same manner as Sample 201 (a color negative film) in Example 2 described in JP-A-2-90151 except that the coupler Cp-L contained in the 10th layer and 11th layer was replaced with the same molar amount of the coupler Y-1, Y-10, Y-20, Y-50 Y-57 or Y-64 of the present invention.

These samples were subjected to exposure and development processing and then to a fading test in the same manners as that in Example 2 described in JP-A-2-90151, and the samples of the present invention showed excellent fastness and good photographic characteristics.

Example 3

The samples were prepared in the same manner as in the light-sensitive material 1 (a color negative film) in Example 1 described in JP-A-2-93641 except that the coupler EX-9 contained in the 11th layer, 12th layer and 13th layer was replaced with the same molar amount of the coupler Y-6, Y-15, Y-42, or Y-57 of the present invention.

These samples were subjected to exposure and development processing and then to a fading test in the same manner as in the light-sensitive material 1 in Example 1 described in JP-A-2-93641, and the samples of the present invention showed excellent fastness and had good photographic characteristics.

Example 4

The samples were prepared in the same manner as that in Sample 101 (a color reversal film) in Example 1 described in JP-A-2-854 except that the coupler C-5 or C-7 contained in the 12th layer and 13th layer was replaced with the same molar amount of the coupler Y-1, Y-10, Y-15, Y-42 Y-54 or Y-64 of the present invention.

These samples were subjected to exposure and development processing and then to a fading test in the same manners as in Example 1 described in JP-A-2-854, and the samples of the present invention showed excellent fastness and had good photographic characteristics.

Example 5

The samples were prepared in the same manner as the color photographic light-sensitive material (a color reversal paper) in Example 2 described in JP-A-1-158431 except that the coupler ExY-1 contained in the 11th layer and 12th layer was replaced with the same molar amount of the coupler Y-6, Y-15, Y-42 Y-57 or Y-64 of the present invention.

These samples were subjected to exposure and development processing and then to a fading test in the same manner as in Example 2 described in JP-A-2-158431, and the samples of the present invention showed an excellent fastness and had good photographic characteristics.

Example 6

Sample 601, in which the first layer in Example 1 was changed as follows, was prepared:

| First layer (a blue-sensitive emulsion layer) | |
|---|---|
| Foregoing silver bromochloride emulsion A | 0.23 |
| Gelatin | 1.30 |
| Yellow coupler (ExY) | 0.55 |
| Dye image stabilizer (Cpd-1) | 0.27 |
| Dye image stabilizer (Cpd-2) | 0.20 |
| Dye image stabilizer (Cpd-3) | 0.07 |
| Solvent (Solv-4) | 0.10 |
| Solvent (Solv-5) | 0.10 |

Samples 602 to 612 were prepared in the same manner as that in Sample 601 except that the yellow coupler contained in the first layer (the blue-sensitive layer) was replaced with the couplers shown in Table 26 in the same mole amount.

Samples 601 to 612 were exposed with a densitometer (FWH type, the color temperature of a light source: 3200° K., manufactured by Fuji Photo Film Co., Ltd.) so that about 30% of the coated silver amount was developed to give grey, and were subjected to development processing in the same manner as in Example 1.

Next, Samples 601 to 612, which were subjected to gradational exposure using a plateau wedge of a three colors separation, were processed in the foregoing processing solutions. The optical density of the samples thus processed at a yellow color developing portion was measured with light passing through a B filter (blue color) and a G filter (green color). The use of the B filter enabled yellow color developing density to be measured, and the use of the G filter enabled magenta component density at the yellow color developing portion to be measured. The maximum densities measured through the B filter are shown in Table 26 as the value showing the color developability of the couplers. Further, the magenta component densities at the exposure giving the yellow color developing density of 2.0 are shown in Table 26 as the degree showing a hue. The lower value the magenta component density shows, the more excellent yellow color reproducibility with less redish color is provided.

After storing the above samples under the conditions of 80° C. and 60% RH for three months, the yellow densities were measured once again to obtain the residual rates in the dye images with the initial density of 2.0. These values are shown as well in Table 26.

TABLE 26

| Sample | Coupler | Color developability (Dmax) | Hue | Dark fastness |
|---|---|---|---|---|
| 601 (Comp.) | Comp. coupler A | 1.81 | 0.25 | 80 |
| 602 (Comp.) | Comp. coupler J | 2.23 | 0.34 | 62 |
| 603 (Comp.) | Comp. coupler F | 2.28 | 0.17 | 83 |
| 604 (Comp.) | Comp. coupler K | 2.25 | 0.17 | 95 |
| 605 (Comp.) | Comp. coupler L | 2.23 | 0.18 | 90 |
| 606 (Comp.) | Comp. coupler M | 2.16 | 0.17 | 93 |
| 607 (Comp.) | Comp. coupler N | 1.88 | 0.25 | 78 |
| 608 (Comp.) | Comp. coupler O | 2.25 | 0.33 | 45 |
| 609 (Inv.) | Y-128 | 2.45 | 0.15 | 85 |
| 610 (Inv.) | Y-112 | 2.49 | 0.14 | 96 |
| 611 (Inv.) | Y-78 | 2.43 | 0.16 | 92 |
| 612 (Inv.) | Y-86 | 2.55 | 0.14 | 95 |

It can be found from the results summarized in Table 26 that while color developability is improved only a little bit in the light-sensitive materials containing the comparative couplers N and O having a phosphoric ester group, the color developability is improved to a large extent in the light-sensitive materials containing the couplers Y-128, Y-112, Y-78 and Y-86 of the present invention prepared by introducing a lipophilic group into the comparative couplers F, K, L and M.

Further, it can be found that the magenta component at the yellow color developing portion is small and hue is excellent in the light-sensitive materials containing the comparative couplers F, K, L and M compared with the light-sensitive materials containing the comparative couplers A and J. The introduction of the lipophilic group into the comparative coupler A or B scarcely leads to the improvement in the hue but in the light-sensitive materials containing the couplers prepared by introducing the lipophilic group into the comparative couplers F, K, L and M, further improvement in the hue can be seen. The actual visual observation of these samples shows that so-called lemon yellow is present, and the difference in the hue from those of the comparative couplers is clearly shown. It can be found that the couplers of the present invention are excellent as well in terms of dye image fastness in storage in a dark room.

It can be found from the above results that the couplers of the present invention are excellent couplers in terms of the color developability, hue and fastness.

Example 7

Sample 701 was prepared in the same manner as that in Sample 601 in Example 6 except that there were replaced Solv-5 contained in the first layer of Sample 601 with Solv-8 (coated amount: 0.15 g/m$^2$), Cpd-4 with Cpd-16 (coated amount: 0.07 g/m$^2$), Solv-3 with Solv-4 (coated amount: 0.07 g/m$^2$), and the coated amount of Solv-4 with 0.15 g/m$^2$, each contained in the second layer and fourth layer, and Solv-3 with Solv-9 (coated amount: 0.30 g/m$^2$), and Solv-4 with Solv-10 (coated amount: 0.15 g/m$^2$), each contained in the third layer.

Next, Samples 702 to 714 were prepared in the same manner as in Sample 701 except that the kinds and amounts of the yellow couplers were changed as shown in Table 27, wherein the silver amounts were changed at the same time so that the mole ratio of the coupler to silver halide was kept fixed.

The samples thus prepared were exposed and then processed in the processing solutions shown in Example 6 (Processing A) to measure the maximum developed color density (Dmax).

Next, the respective samples were subjected to imagewise exposure and then to continuous processing (a running test) at the following steps in the processing solutions of the following compositions with a paper processing machine until the amount of two times as much as the capacity of a color developing tank was replenished. (Processing B)

| Processing step | Temperature | Time | Replenishing amount* | Tank capacity |
|---|---|---|---|---|
| Color developing | 35° C. | 45 seconds | 161 ml | 17 l |
| Bleach/fixing | 35° C. | 45 seconds | 215 ml | 17 l |
| Stabilizing (1) | 35° C. | 20 seconds | — | 10 l |
| Stabilizing (2) | 35° C. | 20 seconds | — | 10 l |
| Stabilizing (3) | 35° C. | 20 seconds | — | 10 l |
| Stabilizing (4) | 35° C. | 20 seconds | 248 ml | 10 l |
| Drying | 80° C. | 60 seconds | | |

*Replenishing amount is per m$^2$ of the light-sensitive material.

The stabilizing step is of a four tanks countercurrent system from (4) to (1).

The compositions of the respective processing solutions are as follows:

| | Tank solution | Replenishing solution |
|---|---|---|
| Color developing solution | | |

-continued

| | Tank solution | Replenishing solution |
|---|---|---|
| Water | 800 ml | 800 ml |
| 1-Hydroxyethylidene-1,1-diphosphonic acid (60%) | 0.8 ml | 0.8 ml |
| Lithium sulfate (anhydrous) | 2.7 g | 2.7 g |
| Triethanolamine | 8.0 g | 8.0 g |
| Sodium chloride | 1.4 g | — |
| Potassium bromide | 0.03 g | 0.025 g |
| Diethylhydroxylamine | 4.8 g | 7.6 g |
| Potassium carbonate | 27 g | 27 g |
| Sodium sulfite | 0.1 g | 0.2 g |
| N-ethyl-N-(β-methanesulfonamidethyl)-3-methyl-4-aminoaniline 3/2 sulfate monohydrate | 4.4 g | 7.1 g |
| Fluorescent whitening agent (4,4'-diaminostilbene series) | 1.0 g | 1.5 g |
| Water was added to | 1000 ml | 1000 ml |
| pH (potassium hydroxide was added) | 10.25 | 10.80 |
| Bleach/fixing solution (Common to the tank solution and replenishing solution) | | |
| Water | 400 ml | |
| Ammonium thiosulfate (700 g/liter) | 100 ml | |
| Sodium sulfite | 17 g | |
| Iron (III) ammonium ethylenediaminetetraacetate | 55 g | |
| Disodium ethylenediaminetetracetate | 5 g | |
| Glacial acetic acid | 9 g | |
| Water was added to | 1000 ml | |
| pH (adjusted with acetic acid and aqueous ammonia) | 5.40 | |
| Stabilizing solution (Common to the tank solution and replenishing solution) | | |
| Benzoisothiazline-3-one | 0.02 g | |
| Polyvinyl pyrrolidone | 0.05 g | |
| Water was added to | 1000 ml | |
| pH (25° C.) | 7.0 | |

Further, the running processing solutions C and D were prepared in the same manner as in the processing B except that the replenishing amount of the color developing solution was changed to 1.25 times and 0.8 time as much as that in the processing B. The processings B to D were carried out in the same manner as that in the processing A.

The yellow color developing densities of the Samples 701 to 714, which were subjected to the processings A to D, are shown in Table 27. The color developing densities in the processings C and D are shown by the percentage to the value in the processing B.

TABLE 27

| Sample | Coupler (coated amount) | Proceccing dependency* Processing A | B | C | D |
|---|---|---|---|---|---|
| 701 (Comp.) | Comp. coupler A (100%) | 2.24 | 2.13 | 107% | 78.9% |
| 702 (Comp.) | Comp. coupler L (80%) | 2.30 | 2.19 | 90.3% | 92.3% |
| 703 (Comp.) | Comp. coupler M (75%) | 2.27 | 2.02 | 85.6% | 90.7% |
| 704 (Comp.) | Comp. coupler N (100%) | 2.28 | 2.21 | 112.0% | 85.6% |
| 705 (Inv.) | Y-78 (80%) | 2.32 | 2.33 | 97.3% | 98.2% |
| 706 (Inv.) | Y-79 (80%) | 2.34 | 2.33 | 95.5% | 97.3% |
| 707 (Inv.) | Y-80 (80%) | 2.31 | 2.30 | 96.8% | 97.9% |
| 708 (Inv.) | Y-82 (80%) | 2.29 | 2.30 | 96.1% | 96.1% |
| 709 (Inv.) | Y-83 (80%) | 2.32 | 2.31 | 97.0% | 97.3% |
| 710 (Inv.) | Y-86 (80%) | 2.34 | 2.31 | 96.1% | 96.8% |

TABLE 27-continued

| Sample | Coupler (coated amount) | Proceccing dependency* Processing A | B | C | D |
|---|---|---|---|---|---|
| 711 (Inv.) | Y-87 (80%) | 2.36 | 2.33 | 94.8% | 97.1% |
| 712 (Inv.) | Y-88 (80%) | 2.27 | 2.28 | 95.5% | 95.9% |
| 713 (Inv.) | Y-91 (80%) | 2.30 | 2.29 | 95.0% | 95.2% |
| 714 (Inv.) | Y-96 (80%) | 2.31 | 2.29 | 95.7% | 95.8% |

*Dmax

The following can be found from the results summarized in Table 27. In the couplers of the present invention, the difference between the processings A and B is small, and a stable finishing having a small difference between the processings can be obtained. In the processing C in which the replenishing amount is increased, while the comparative couplers L and M have the defect that the densities are a little lowered, the couplers of the present invention are improved in this matter. Further, in the processing D in which the replenishing amount is small, the couplers of the present invention demonstrate stable performances.

Thus, it can be seen that the couplers of the present invention are excellent couplers which show stable performance against fluctuations in processing solution components.

Example 8

Samples 801 to 811 were prepared in the same manner as in Sample 701 in Example 7 except that the coupler was changed as shown in Table 28. These samples were processed in the processing B in Example 7.

The samples thus obtained were put in a sunlight fading test chamber (the test pieces were put therein with the faces toward a south at the angle of 45° to a vertical axis and exposed to sunlight through a glass plate with the thickness of 2 mm) and exposed to the sunlight for three months.

The dye image residual rates at the initial density of 1.0 are shown in Table 28.

TABLE 28

| Sample | Coupler | Dye residual rate (sunlight 3 months) |
|---|---|---|
| 801 (Comp.) | Comp. coupler A | 88% |
| 802 (Comp.) | Comp. coupler L | 82% |
| 803 (Comp.) | Comp. coupler M | 75% |
| 804 (Comp.) | Comp. coupler N | 87% |
| 805 (Inv.) | Y-79 | 95% |
| 806 (Inv.) | Y-82 | 95% |
| 807 (Inv.) | Y-84 | 94% |
| 808 (Inv.) | Y-87 | 95% |
| 809 (Inv.) | Y-91 | 93% |
| 810 (Inv.) | Y-94 | 94% |
| 811 (Inv.) | Y-97 | 94% |

It can be seen from the results shown in Table 28 that the samples containing the couplers of the present invention provide improved fastness compared with samples containing the comparative couplers.

While the invention has been described in detail and with reference to specific embodiments thereof, it will be apparent to one skilled in the art that various changes and modifications can be made therein without departing from the spirit and scope thereof.

What is claimed is:

1. A silver halide color photographic light-sensitive material comprising a support provided thereon at least one blue-sensitive silver halide emulsion layer containing a yellow coupler represented by the following Formula (I):

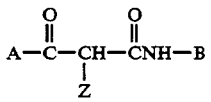

Formula (I)

wherein A represents a group represented by the following Formula (a), (b) or (c):

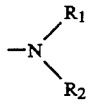

Formula (a)

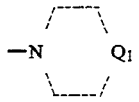

Formula (b)

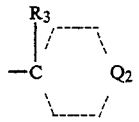

Formula (c)

wherein $R_1$ and $R_2$ may be the same or different and each represents an aliphatic group, an aromatic group or a heterocyclic group; $Q_1$ represents an organic group necessary to form a nitrogen-containing heterocyclic ring; $R_3$ represents a monovalent organic group; $Q_2$ represents an organic group necessary to form a 3- or 6-membered ring; provided that $R_3$ is not a hydrogen atom and is not combined with $Q_2$ to form a ring; B represents an aromatic group or a heterocyclic group; Z represents a hydrogen atom or a group capable of splitting off upon a coupling reaction with an oxidation product of an aromatic primary amine developing agent; provided that at least one of the groups represented by $R_1$, $R_2$, $Q_1$, $Q_2$, B and Z when Z is a group capable of splitting off is substituted with a group represented by Formulas (P-III-a) or (P-IV-a):

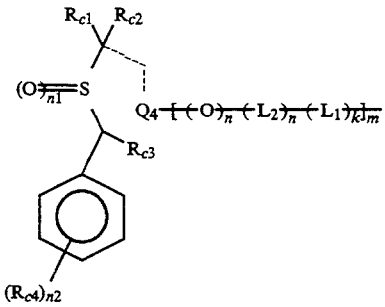

Formula (P-III-a)

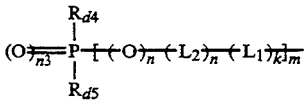

Formula (P-IV-a)

wherein $R_{c1}$ represents an aliphatic group, an aromatic group or a heterocyclic group; $R_{c2}$ and $R_{c3}$ may be the same or different and each represents a hydrogen atom or a group defined for $R_{c1}$; $Q_4$ represents an organic group necessary to form a thiane ring; $n_1$ represents 0, 1 or 2; $R_{c4}$ represents a substituent; $n_2$ represents an integer of 0 to 4; when $n_2$ is 2 or more, a plurality of $R_{c4}$ groups may be the same or different; $n_3$ represents 0 or 1; $L_1$ represents a linkage group formed by combining at least one of —CO— and —$SO_2$— with —NH—, —CO—, or —COO—*; the mark * represents a bond to $L_2$; $L_2$ represents an alkylene group or an arylene group; k, h and n each represents 0 or 1; m represents an integer of 0 and 1 to 3; $R_{d4}$ and $R_{d5}$ each represents an aliphatic group, an aromatic group, an aliphatic oxy group, an aromatic oxy group, an aliphatic amino group, or an aromatic amino group; and $L_2$, $R_{d4}$ and $R_{d5}$ may be combined with each other to form a ring.

2. The silver halide color photographic light-sensitive material as in claim 1, wherein the nitrogen-containing heterocyclic group formed by $Q_1$ with =N— is selected from the group consisting of a pyrolidino group, a piperidino group, a morpholino group, a 1-piperadinyl group, a 1-indolinyl group, a 1,2,3,4-tetrahydroquinoline-1-yl group, a 1-imidazolidinyl group, a 1-pyrazolyl group, a 1-pyrrolinyl group, a 1-pyrazolidinyl group, a 2,3-dihydro-1-indazolyl group, a 2-isoindolinyl group, a 1-indolyl group, a 1-pyrrolyl group, a 4-thidine-s,s-dioxo-4-yl group, and a benzoxazine-4-yl group.

3. The silver halide color photographic light-sensitive material as in claim 1, wherein $R_3$ represents an aliphatic group, an aromatic group, a halogen atom, or cyano group.

4. The silver halide color photographic light-sensitive material as in claim 1, wherein the organic group formed by $Q_2$ is selected from the group consisting of a cyclopropyl group, a cyclobutyl group, a cyclopentyl group, a 2-cyclobutene-1-yl group, a 2-cylcopentene-1-yl group, a bicyclo[2,1,0]pento-5-yl group, a bicyclo[3,1,0]hexy-6-yl group, a oxetane-3-yl group, a thietane-3-yl group, a oxolane-3-yl group, a oxolane-2-yl group, a thiolane-2-yl group, a N-alkylpyrrolidinyl group, a N-alkylpyrrolidine-3-yl group, a 2-oxabicyclo[3,2,0]pento-6-yl group, a 1,3-dioxolane-2-yl group, a 1,3-dioxane-5-yl group, a 2,2-dimethyl-1,3-dioxane-5-yl group, a 1,3-dioxane-2-yl group, and a 1,4-dioxane-2-yl group.

5. The silver halide color photographic light-sensitive material as in claim 1, wherein B represents an aromatic group.

6. The silver halide color photographic light-sensitive material as in claim 1, wherein Z represents a nitrogen-containing heterocyclic group bonded to a coupling site via a nitrogen atom or aromatic oxy group.

7. The silver halide color photographic light-sensitive material as in claim 1, wherein A is represented by the following Formula (a-1), (b-1), (b-2) or (c-1):

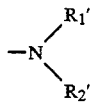

(a-1)

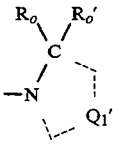

(b-1)

-continued (b-2)

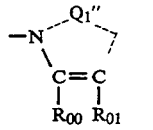

(c-1)

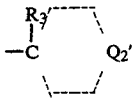

wherein $R_1'$ represents an alkyl group; $R_2'$ represents an alkyl group or an aromatic group; $Q_1'$ and $Q_1''$ each represents an organic group which forms a nitrogen-containing heterocyclic ring; $R_0$, $R_0'$, $R_{00}$ and $R_{01}$ may be the same or different and each represents a hydrogen atom or a substituent; $R_0$ and $R_0'$, and $R_{00}$ and $R_{01}$ may be combined with each other to form a 5- to 7-membered ring; $R_3'$ represents a halogen atom or an alkyl group; $Q_2'$ represents an organic group which forms a 3- to 6-membered hydrocarbon ring; provided that the alkyl group represented by $R_3'$ is not combined with $Q_2'$ to form a ring; the alkyl group represented by $R_1'$, $R_2'$ or $R_3'$ is linear, branched or cyclic, substituted or unsubstituted alkyl group having a carbon number of 1 to 50; the aromatic group represented by $R_2'$ is defined the same as the aromatic group represented by $R_2$.

8. The silver halide color photographic light-sensitive material as in claim 7, wherein groups represented by Formula (b-2) are those represented by the following Formula (b-2');

(b-2')

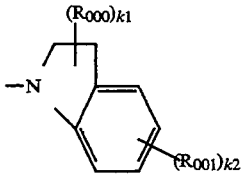

wherein $R_{000}$ and $R_{001}$ each represents a substituent; $k_1$ represents 0 to 2; $k_2$ represents 0 to 4; when a plurality of $R_{000}$ and $R_{001}$ groups are present, they may be the same as or different from each other.

9. The silver halide color photographic light-sensitive material as in claim 7, wherein the hydrocarbon ring formed by $Q_2'$ is a 3- to 5-membered saturated hydrocarbon ring.

10. The silver halide color photographic light-sensitive material as in claim 1, wherein A is represented by the following Formula (c-1):

(c-1)

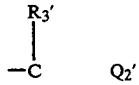

wherein $R_3'$ represents a halogen atom or an alkyl group; $Q_2'$ represents an organic group which forms a 3- to 6-membered hydrocarbon ring; provided that the alkyl group represented by $R_3'$ is not combined with $Q_2'$ to form a ring.

11. The silver halide color photographic light-sensitive material as in claim 1, wherein the nitrogen-containing heterocyclic ring formed by $Q_3$ represents a pyrrolidine ring, an imidazoline ring, a piperazine ring, a piperidine ring, a morpholine ring, or an isoindoline ring.

12. The silver halide color photographic light-sensitive material as in claim 1, wherein $R_{c1}$ represents an aromatic group; $R_{c2}$ and $R_{c3}$ each represents a hydrogen atom; $R_{c4}$ represents an aliphatic group, an aromatic group, a heterocyclic group, a halogen atom, an aliphatic oxy group, an aromatic oxy group, an amino group, an acylamino group, a sulfonamide group, an aliphatic thio group, an aromatic thio group, an acyl group, a sulfonyl group, or a hydroxyl group.

13. The silver halide color photographic light-sensitive material as in claim 1, wherein the aromatic group or the heterocyclic group represented by B is substituted with the group represented by Formula (P-III-a) or Formula (P-IV-a).

14. The silver halide color photographic light-sensitive material as in claim 1, wherein at least one of the groups represented by $R_1$, $R_2$, $Q_1$, $Q_2$, B and Z when Z is a group capable of splitting off is substituted with a group represented by Formula (P-IV-a).

15. The silver halide color photographic light-sensitive material as in claim 14, wherein said yellow coupler is represented by the following Formula (II):

(II)

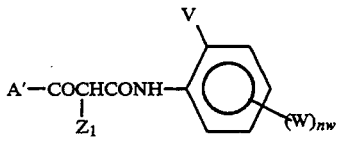

wherein A' is defined the same as A defined in Formula (I); $Z_1$ represents a nitrogen-containing heterocyclic group which is bonded to a coupling site via the nitrogen atom; V represents a halogen atom, an alkoxy group, or an aryloxy group; W represents a substituent; $n_w$ represents 1 or 2; provided that at least one of the groups represented by $R_1$, $R_2$, $Q_1$, $Q_2$, the alkoxy group and the aryloxy group of V and W is substituted with a group represented by Formula (P-IV-a).

16. The silver halide color photographic light-sensitive material as in claim 15, wherein W is represented by Formula (P-IV-a'):

(P-IV-a')

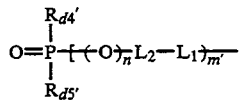

wherein $L_1$ represents a linkage group formed by combining at least one of —CO— and —$SO_2$— with —NH—, —CO—, or —COO—*; the mark * represents a bond to $L_2$; $L_2$ represents an alkylene group or an arylene group; n represents 0 or 1; m' represents 1 or 2; $R_{d4}'$ and $R_{d5}'$ each represents an alkoxy group, an aryloxy group, an alkyl group, an aryl group, an alkylamino group, or arylamino group; and $L_2$, $R_{d4}'$ and $R_{d5}'$ may be combined with each other to form a ring.

17. The silver halide color photographic light-sensitive material as in claim 16, wherein the coupler represented by Formula (II) represents the following Formula (III):

(III)

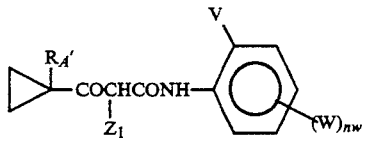

wherein $R_A'$ represents an ethyl group or a benzyl group; V, $Z_1$ and $n_w$ are defined the same as in Formula (II); and W represents a group represented by Formula (P-IV-a').

18. The silver halide color photographic light-sensitive material as in claim 1, wherein the coupler of Formula (I) is present in an amount of from 0.001 to 1 mole per mole of silver halide contained in the same layer.

19. The silver halide color photographic light-sensitive material as in claim 1, wherein the coupler of Formula (I) is present in an amount of from 0.01 to 0.5 mole per mole of silver halide contained in the same layer.

20. The silver halide color photographic light-sensitive material as in claim 1, wherein the silver halide used in the light-sensitive material is silver chlorobromide containing 90 mole % or more silver chloride.

* * * * *